US007651206B2

(12) United States Patent
Hawkins et al.

(10) Patent No.: US 7,651,206 B2
(45) Date of Patent: Jan. 26, 2010

(54) OUTPUT IMAGE PROCESSING FOR SMALL DROP PRINTING

(75) Inventors: Gilbert A. Hawkins, Mendon, NY (US); Douglas W. Couwenhoven, Fairport, NY (US); Bradley A. Phillips, Honeoye Falls, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 353 days.

(21) Appl. No.: 11/612,694

(22) Filed: Dec. 19, 2006

(65) Prior Publication Data

US 2008/0143766 A1 Jun. 19, 2008

(51) Int. Cl.
*B41J 2/02* (2006.01)

(52) U.S. Cl. ..... 347/73; 358/1.2

(58) Field of Classification Search ..... 347/73–78, 347/81–82, 9–11; 358/1.2, 1.9
See application file for complete search history.

(56) References Cited

U.S. PATENT DOCUMENTS

| | | | | |
|---|---|---|---|---|
| 1,941,001 | A | 12/1933 | Hansell | 176/96 |
| 3,373,437 | A | 3/1968 | Sweet et al. | 347/74 |
| 4,613,871 | A | 9/1986 | Katerberg | 347/76 |
| 4,620,196 | A | 10/1986 | Hertz et al. | 347/15 |
| 4,636,808 | A | 1/1987 | Herron | 347/76 |
| 5,224,843 | A | 7/1993 | van Lintel | 417/413.2 |
| 6,554,410 | B2 | 4/2003 | Jeanmaire et al. | 347/77 |
| 6,575,566 | B1 | 6/2003 | Jeanmaire et al. | 347/77 |
| 6,588,888 | B2 | 7/2003 | Jeanmaire et al. | 347/77 |
| 2004/0233243 | A1 | 11/2004 | Jeanmaire | |
| 2006/0082606 | A1 | 4/2006 | Hawkins et al. | |

*Primary Examiner*—Lamson D Nguyen
(74) *Attorney, Agent, or Firm*—William R. Zimmerli

(57) ABSTRACT

A method of forming a liquid pattern according to liquid pattern data on a receiving medium using a liquid drop emitter that emits a continuous stream of liquid from a nozzle that is broken into drops of predetermined volumes by the application of drop forming energy pulse is disclosed comprising associating a pixel area of the receiving medium with a nozzle and a time interval during which a plurality of fluid drops ejected from the nozzle can impinge the pixel area of the receiving medium. The time interval is divided into a plurality of subintervals that are, in turn, grouped into a plurality of blocks. Each block is defined as a printing block or a non-printing block. A drop forming energy pulse is provided between each pair of consecutive blocks and between the subintervals of each printing block. No drop forming energy pulses are provided between the subintervals of the non-printing blocks. The so-formed energy pulse sequence is applied to the stream of liquid causing the formation of small print drops and large non-print drops. The liquid pattern is formed on the receiver of print drops comprised of liquid emitted during subintervals associated with printing blocks. The block configuration is designed to ensure that non-print drops have the proper volume. In an alternate set of embodiments, individual subintervals rather than blocks of subintervals are individually defined as print or non-print subintervals subject to a non-print drop rule that forces non-print drops to be formed of adequate volume for differentiation from print drops and a maximum drop rule that ensures that non-print drops are not too large to be reliably captured and guttered.

21 Claims, 33 Drawing Sheets

101
104
i-2
i-1
i
i+1
i+2
i+3
k =
j
j+1
j+2
j
j
37
102
108
109
96
107
e
c
a
b
d
....0,1,0,1,0,1,

OUTPUT IMAGE PROCESSING FOR SMALL DROP PRINTING

CROSS REFERENCE TO RELATED APPLICATIONS

Reference is made to commonly assigned U.S. patent application Ser. No. 10/903,047 entitled "CONTINUOUS INKJET PRINTER HAVING ADJUSTABLE DROP PLACEMENT," in the name of Gilbert A. Hawkins, et al., and Ser. No. 10/903,051 entitled "SUPPRESSION OF ARTIFACTS IN INKJET PRINTING," in the name of Gilbert A. Hawkins, et al., the disclosures of which are incorporated herein by reference.

FIELD OF THE INVENTION

This invention generally relates to digitally controlled printing devices and more particularly relates to a continuous ink jet printhead that integrates multiple nozzles on a single substrate and in which the breakup of a liquid ink stream into printing drops is caused by a periodic disturbance of the liquid ink stream.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop-on-demand ink jet or continuous ink jet.

The first technology, drop-on-demand ink jet printing, typically provides ink drops for impact upon a recording surface using a pressurization actuator (thermal, piezoelectric, etc.). Selective activation of the actuator causes the formation and ejection of a flying ink drop that crosses the space between the print head and the print media and strikes the print media. The formation of printed images is achieved by controlling the individual formation of ink drops, as is required to create the desired image. With thermal actuators, a heater, located at a convenient location, heats the ink causing a quantity of ink to phase change into a gaseous steam bubble. This increases the internal ink pressure sufficiently for an ink drop to be expelled. Piezoelectric actuators, such as that disclosed in U.S. Pat. No. 5,224,843, issued to vanLintel, on Jul. 6, 1993, have a piezoelectric crystal in an ink fluid channel that flexes in an applied electric field forcing an ink drop out of a nozzle.

The second technology, continuous ink jet printing, uses a pressurized ink source that produces a continuous stream of ink drops. Conventional continuous ink jet printers utilize electrostatic charging devices that are placed close to the point where a filament of ink breaks into individual ink drops. The ink drops are electrically charged and then directed to an appropriate location by deflection electrodes. When no print is desired, the ink drops are directed into an ink-capturing mechanism (often referred to as catcher, interceptor, or gutter). When print is desired, the ink drops are directed to strike a print medium.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink drops to be printed are selectively charged and deflected towards the recording medium. This early technique is known as electrostatic binary deflection continuous ink jet.

U.S. Pat. No. 4,636,808, issued to Herron et al., U.S. Pat. No. 4,620,196 issued to Hertz et al. and U.S. Pat. No. 4,613,871 disclose techniques for improving image quality in electrostatic continuous ink jet printing including printing with a variable number of drops within pixel areas on a recording medium produced by extending the length of the voltage pulses which charge drops so that many consecutive drops are charged and using non-printing or guard drops interspersed in the stream of printing drops.

Later developments for continuous flow ink jet improved both the method of drop formation and methods for drop deflection. For example, U.S. Pat. No. 3,709,432, issued to Robertson on Jan. 9, 1973, discloses a method and apparatus for stimulating a filament of working fluid causing the working fluid to break up into uniformly spaced ink drops through the use of transducers. The lengths of the filaments before they break up into ink drops are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air-flow affects the trajectories of the filaments before they break up into drops more than it affects the trajectories of the ink drops themselves. By controlling the lengths of the filaments, the trajectories of the ink drops can be controlled, or switched from one path to another. As such, some ink drops may be directed into a catcher while allowing other ink drops to be applied to a receiving member.

U.S. Pat. No. 6,588,888 entitled "Continuous ink-jet printing method and apparatus," issued to Jeanmaire, et al. (Jeanmaire '888, hereinafter) and U.S. Pat. No. 6,575,566 entitled "Continuous inkjet printhead with selectable printing volumes of ink," issued to Jeanmaire, et al. (Jeanmaire '566 hereinafter) disclose continuous ink jet printing apparatus including a droplet forming mechanism operable in a first state to form droplets having a first volume traveling along a path and in a second state to form droplets having a plurality of other volumes, larger than the first, traveling along the same path. A droplet deflector system applies force to the droplets traveling along the path. The force is applied in a direction such that the droplets having the first volume diverge from the path while the larger droplets having the plurality of other volumes remain traveling substantially along the path or diverge slightly and begin traveling along a gutter path to be collected before reaching a print medium. The droplets having the first volume, print drops, are allowed to strike a receiving print medium whereas the larger droplets having the plurality of other volumes are "non-print" drops and are recycled or disposed of through an ink removal channel formed in the gutter or drop catcher.

In preferred embodiments, the means for variable drop deflection comprises air or other gas flow. The gas flow affects the trajectories of small drops more than it affects the trajectories of large drops. Generally, such type of printing apparatus that causes drops of different sizes to follow different trajectories, can be operated in at least one of two modes, a small drop print mode, as disclosed in Jeanmaire '888 or Jeanmaire '566, and a large drop print mode, as disclosed also in Jeanmaire '566 or in U.S. Pat. No. 6,554,410 entitled "Printhead having gas flow ink droplet separation and method of diverging ink droplets," issued to Jeanmaire, et al. (Jeanmaire '410 hereinafter) depending on whether the large or small drops are the printed drops. The present invention described herein below are methods for implementing small drop printing modes.

Jeanmaire '888 and Jeanmaire '566 disclose the concept of continuous inkjet printing wherein the smallest volume drops are used for forming the image pattern on a receiver medium and large drops are formed and guttered to capture excess jetted liquid or liquid that would otherwise strike the media in non-print areas. However, Jeanmaire '888 and Jeanmaire '566 do not disclose methods for translating input image or pattern data into jet stimulation pulse sequences that break up a jet into sequences of print and non-print drops that will result in an acceptable liquid pattern image at the receiver medium. Implementation of a small drop print mode requires that the sequences of jet break up pulses applied to each jet of a plurality of jets be formed based on the desired optical density or liquid deposition amount at each output image picture element (pixel) as well as the characteristics that the large non-print drops must be given for reliable deflection path discrimination and capture by the gutter.

Further, small drop printing offers a better opportunity to provide more levels of gray scale at each pattern pixel location and to alter the position and shape of the printed ink within a pixel area. However, to take advantage of the print quality opportunities offered by small drop printing, practical and efficient methods of translating input image and pattern data into useful drop forming pulse sequences are needed.

SUMMARY OF THE INVENTION

It is therefore an object of the present invention to provide methods of printing using small volume drops while large volume drops are captured and recycled.

It is further an object of the present invention to provide methods of utilizing small drops for printing gray levels in pixel areas and allowing the positioning of the centroid of optical density and the shape of the printed liquid to be selected to best represent the input image or liquid pattern data.

It is further an object of the preset invention to provide an efficient method of developing drop forming pulse sequences to stimulate one or more jets to form the necessary sequences of small and large drops for printing and non-printing pixel areas respectively.

The foregoing and numerous other features, objects and advantages of the present invention will become readily apparent upon a review of the detailed description, claims and drawings set forth herein. These features, objects and advantages are accomplished by a method of forming a liquid pattern according to liquid pattern data on a receiving medium using a liquid drop emitter that emits a continuous stream of liquid from a nozzle that is broken into drops of predetermined volumes by the application of drop forming energy pulses. The method comprises associating a pixel area of the receiving medium with a nozzle and a lime interval during which a plurality of fluid drops ejected from the nozzle can impinge the pixel area of the receiving medium. The time interval is divided into a plurality of subintervals that are, in turn, grouped into a plurality of blocks. Each block is defined as a printing block or a non-printing block. A drop forming energy pulse is provided between each pair of consecutive blocks and between the subintervals of each printing block. No drop forming energy pulses are provided between the subintervals of the non-printing blocks. The so-formed energy pulse sequence is applied to a stream of liquid causing the formation of small print drops and large non-print drops. The liquid pattern is formed on the receiver of print drops comprised of liquid emitted during subintervals associated with printing blocks. The block configuration is designed to ensure that non-print drops have the proper volume.

Several sets of embodiments of the present invention are described that disclose different methods of configuring and defining blocks of subintervals in ways that easily allow non-print drops to be specified with assurance that the volumes will be properly sized for reliable differentiation from print drops and reliably guttered. These sets of embodiments include methods using fixed blocks of equal numbers of subintervals, fixed blocks having different numbers of subintervals, blocks having variable numbers of subintervals according to liquid pattern data and methods having extra non-printable subintervals that ensure that a maximum number of gray levels may be printed within a pixel area.

In an alternate set of embodiments, individual subintervals rather than blocks of subintervals are individually defined as print or non-print subintervals subject to a non-print drop rule that forces non-print drops to be formed of adequate volume for differentiation from print drops and a maximum drop rule that ensures that non-print drops are not too large to be reliably captured and guttered.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description is directed in particular to elements forming part of, or cooperating more directly with, apparatus in accordance with the invention. Functional elements and features have been given the same numerical labels in the figures if they are the same element or perform the same function for purposes of understanding the present invention. It is to be understood that elements not specifically shown or described may take various forms well known to those skilled in the art.

Figure 1:
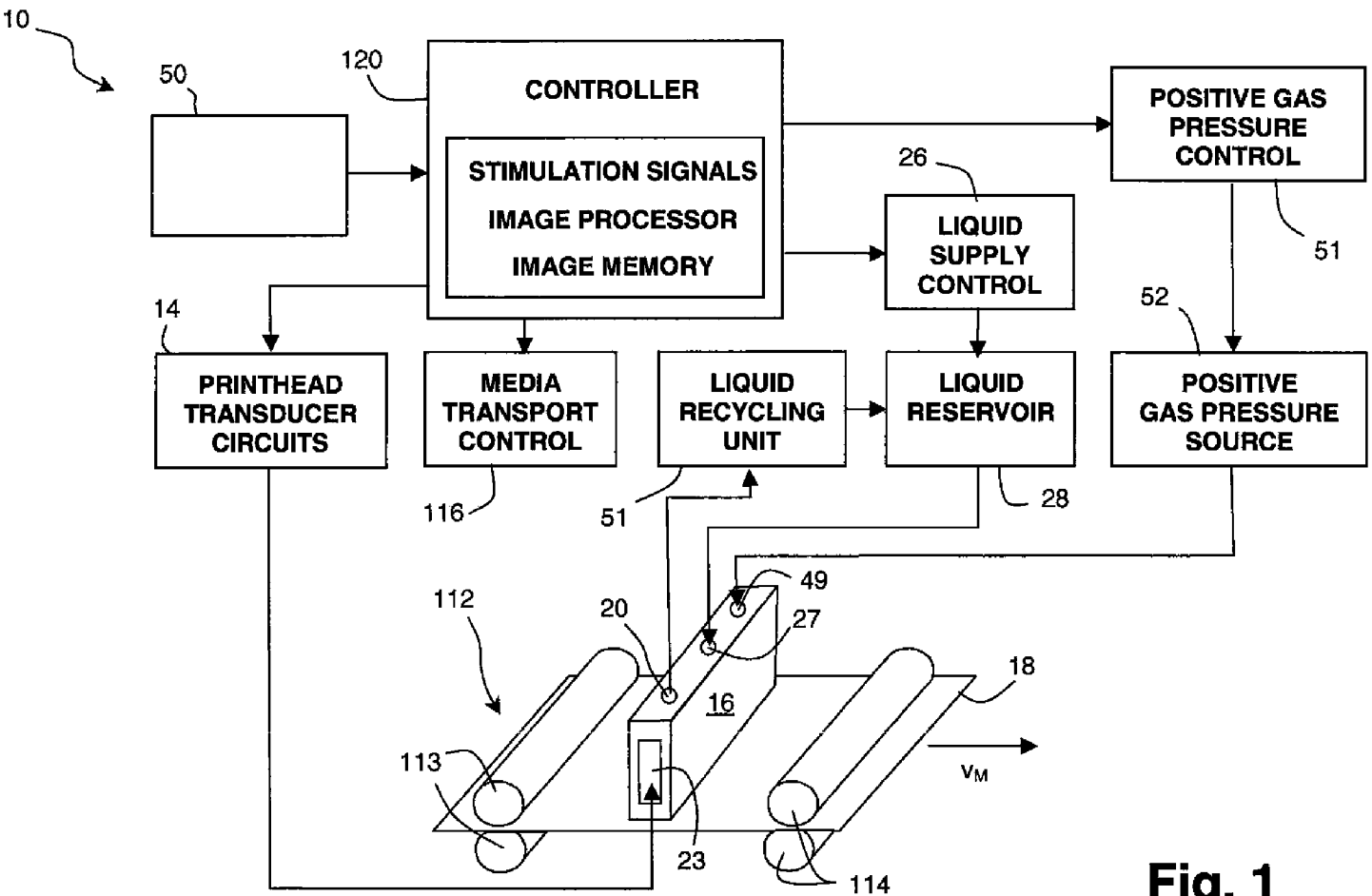
FIG. 1 shows a simplified block schematic diagram of one exemplary liquid pattern deposition apparatus made in accordance with the present invention.

Referring to FIG. 1, a continuous drop emission system 10 for depositing a liquid pattern is illustrated. Typically such systems are ink jet printers and the liquid pattern is an image printed on a receiver sheet or web. However, other liquid patterns may be deposited by the system illustrated including, for example, masking and chemical initiator layers for manufacturing processes. For the purposes of understanding the present invention the terms "liquid" and "ink" will be used interchangeably, recognizing that inks are typically associated with image printing, a subset of the potential applications of the present invention. The liquid pattern deposition system is controlled by a process controller 120 that interfaces with various input and output components, computes necessary translations of data and executes needed programs and algorithms.

The liquid pattern deposition system 10 further includes a source of the image or liquid pattern data 50 which provides raster image data, outline image data in the form of a page description language, or other forms of digital image data. This image data is converted to bitmap image data by controller 120 and stored for transfer to a multi-jet drop emission printhead 16 via a plurality of printhead transducer circuits 14 connected to printhead electrical interface 23. The bit map image data specifies the deposition of individual drops onto the picture elements (pixels) of a two dimensional matrix of positions, equally spaced a pattern raster distance, determined by the desired pattern resolution, i.e. the pattern "dots per inch" or the like. The raster distance or spacing may be equal or may be different in the two dimensions of the pattern.

Controller 120 also creates drop synchronization or formation signals to the printhead transducer circuits 14 that are subsequently applied to printhead 16 to cause the break-up of the plurality of fluid streams emitted into drops of predetermined volume and with a predictable timing. Printhead 16 is illustrated as a "page wide" printhead in that it contains a plurality of jets sufficient to print all scanlines across the medium 18 without need for movement of the printhead 16 itself.

Recording medium 18 is moved relative to printhead 16 by a recording medium transport system 112, which is electronically controlled by a media transport control system 116, and which in turn is controlled by controller 120. The recording medium transport system 112 shown in FIG. 1 is a schematic representation only; many different mechanical configurations are possible. For example, input transfer rollers 113 and output transfer rollers 114 could be used in a recording medium transport system to facilitate transfer of the liquid drops to recording medium 18. Such transfer roller technology is well known in the art. In the case of page width printheads as illustrated in FIG. 1, it is most convenient to move recording medium 18 past a stationary printhead. Recording medium 18 is transported at a velocity, $v_M$. In the case of scanning printhead print systems, it is usually most convenient to move the printhead along one axis (the main scanning direction) and the recording medium along an orthogonal axis (the sub-scanning direction) in a relative raster motion.

The present invention are equally applicable to printing systems having moving or stationary printheads and moving or stationary receiving media, and all combinations thereof. In addition, the description of the methods of the present invention herein below will refer to liquid drop emitters having a plurality of nozzles ejecting a plurality of liquid streams. However, the present invention are also applicable to a liquid pattern forming system utilizing a single jet, or a single jet per liquid type, combined with an appropriate media transport apparatus, for example a high speed rotating drum media support and a slowly translating or stepping printhead carriage.

Pattern liquid is contained in a liquid reservoir 28 under pressure. In the non-printing state, continuous drop streams are unable to reach recording medium 18 due to a liquid gutter (not shown) that captures the stream and which may allow a portion of the liquid to be recycled by a liquid recycling unit 51. The liquid recycling unit 51 receives the un-printed liquid via printhead fluid outlet 20, reconditions the liquid and feeds it back to reservoir 28 or stores it. The liquid recycling unit may also be configured to apply a vacuum pressure to printhead fluid outlet 20 to assist in liquid recovery and to affect the gas flow through printhead 16. Such liquid recycling units are well known in the art. The liquid pressure suitable for optimal operation will depend on a number of factors, including geometry and thermal properties of the nozzles and thermal properties of the liquid. A constant liquid pressure can be achieved by applying pressure to liquid reservoir 28 under the control of liquid supply controller 26 that is managed by controller 120.

The liquid is distributed via a liquid supply line entering printhead 16 at liquid inlet port 27. The liquid preferably flows through slots and/or holes etched through a silicon substrate of printhead 16 to its front surface, where a plurality of nozzles and jet stimulation transducers are situated. In some preferred embodiments of the present invention the jet stimulation transducers are resistive heaters. In other embodiments, more than one transducer per jet may be provided including some combination of resistive heaters, electric field electrodes and microelectromechanical flow valves. When printhead 16 is at least partially fabricated from silicon, it is possible to integrate some portion of the printhead transducer control circuits 14 with the printhead, simplifying printhead electrical connector 23.

A secondary drop deflection apparatus, described in more detail below, maybe configured downstream of the liquid drop emission nozzles. This secondary drop deflection apparatus comprises an airflow plenum that generates air flows that impinge individual drops in the plurality of streams of drops having drop volumes that are predetermined based on input pattern data. A positive pressure source 52, controlled by the controller 120 through a positive pressure control apparatus 51, is connected to printhead 16 via positive pressure source inlet 49.

Figure 2A:
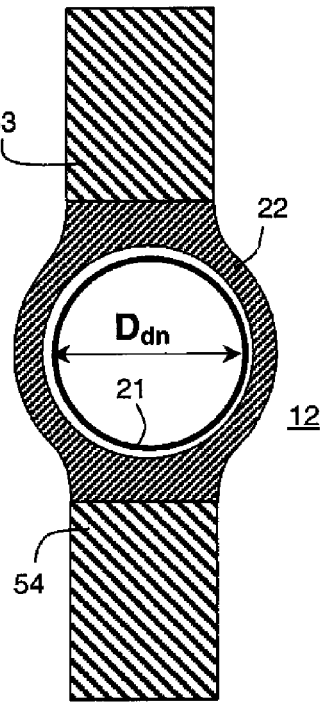
FIGS. 2(*a*) and 2(*b*) show schematic plan views of a single thermal stream break-up transducer and a portion of an array of such transducers, respectively, according to a preferred embodiment of the present invention.
Figure 2B:
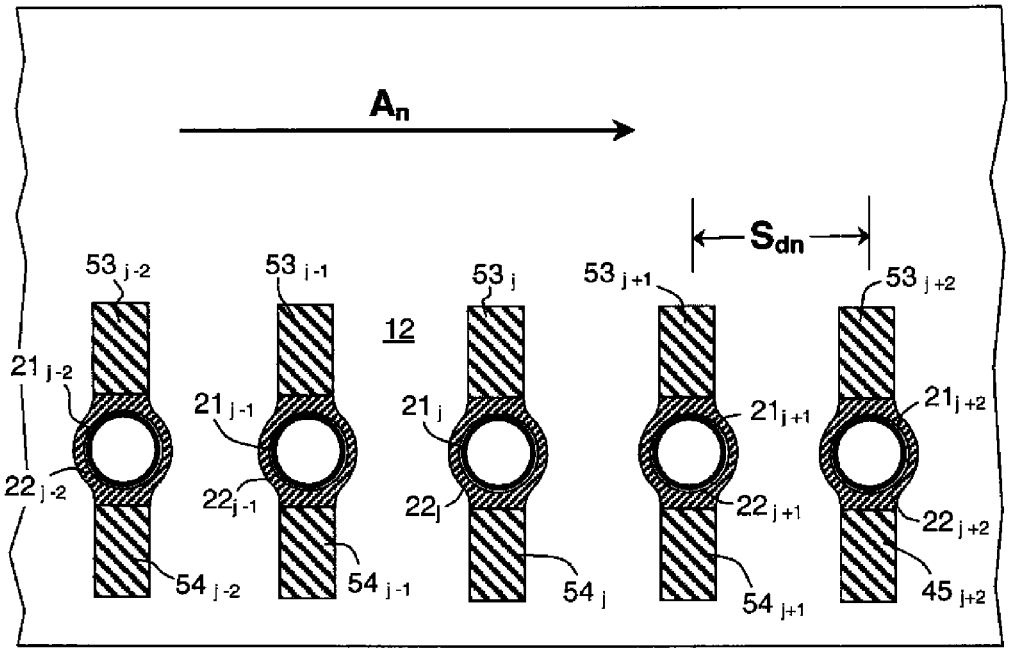

A front face view of a single nozzle 21 of a preferred printhead embodiment is illustrated in FIG. 2(*a*). A portion, five nozzles, of an extended array of such nozzles is illustrated in FIG. 2(*b*). For simplicity of understanding, when multiple jets and component elements are illustrated, suffixes "j", "j+1", et cetera, are used to denote the same functional elements, in order, along a large array of such elements. FIGS. 2(*a*) and 2(*b*) show nozzles 21 of a drop generator portion of printhead 16 having a circular shape with a diameter, $D_{dn}$, equally spaced at a drop nozzle spacing, $S_{dn}$, along a nozzle array direction or axis, $A_n$, and formed in a nozzle front face layer 12. While a circular nozzle is depicted, other shapes for the liquid emission orifice may be used and an effective diameter utilized, i.e. the circular diameter that specifies an equivalent open area. Typically the nozzle diameter will be formed in the range of 6 microns to 35 microns, depending on the size of drops that are appropriate for the liquid pattern being deposited. Typically the drop nozzle spacing, $S_{dn}$, will be in the range 84 to 21 microns corresponding to a pattern raster resolution in the nozzle axis direction of 300 pixels/inch to 1200 pixels/inch.

An encompassing resistive heater 22 is formed on a front face layer surrounding the nozzle bore. Resistive heater 22 is addressed by electrode leads 53 and 54. One of the electrodes, for example electrode 54 may be shared in common with the resistors surrounding other jets. However, at least one resistor electrode lead, for example electrode 53, provides electrical pulses to the jet individually so as to cause the independent stimulation of that jet. Alternatively a matrix addressing arrangement may be employed in which the two address leads 53, 54 are used in conjunction to selectively apply stimulation pulses to a given jet. These same resistive heaters are also utilized to launch a surface wave of the proper wavelength to synchronize the jet of liquid to break-up into drops of substantially uniform diameter, $D_d$, volume, $V_0$, and spacing $\lambda_d$. Resistive heater pulsing may also be devised to cause the break-up of the stream into larger segments of fluid that coalesce into drops having volumes, $V_m$, that are approximately integer multiples of $V_0$, i.e. into drops of volume $\sim mV_0$, where m is an integer greater than 1, i.e., $m \geqq 2$.

For the purposes of understanding the present invention, drops having the smallest predetermined volume, $V_0$, will be called "small" drops or "nominal volume drops" and coalesced drops having volumes approximately $mV_0$ will be called "large" drops. The desired liquid output pattern or image will be formed on the receiving medium from a plurality of small drops of volume $V_0$, whereas the large drops of approximate volume $mV_0$ will be captured (guttered) before striking the receiver medium.

Figure 3A:
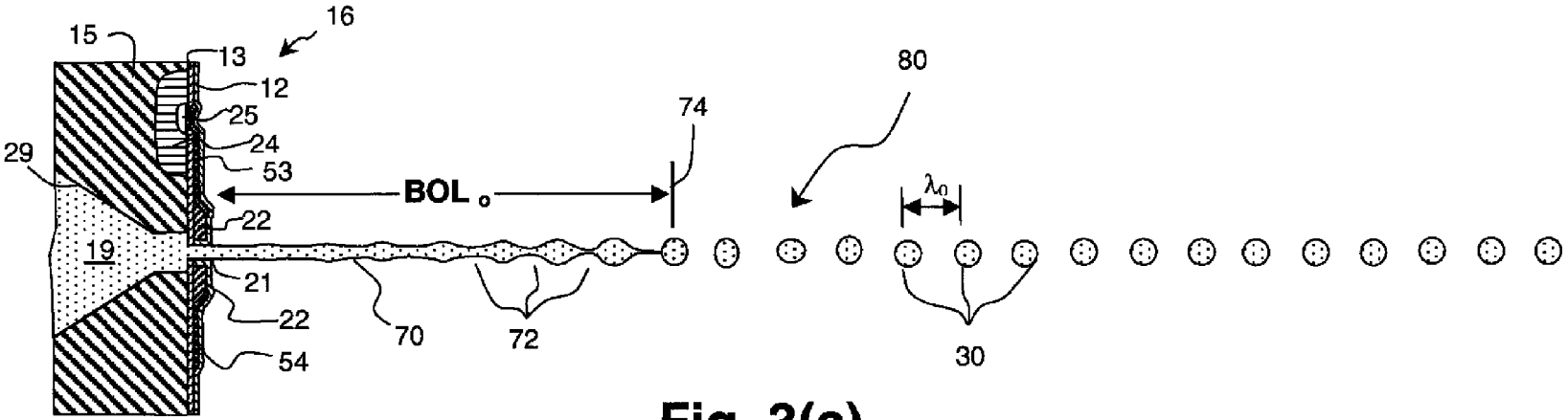
FIGS. 3(*a*) and 3(*b*) show schematic cross-sections illustrating synchronized break-up, respectively, of continuous steams of liquid into mono-sized drops and drops having multiple predetermined volumes, respectively.
Figure 3B:
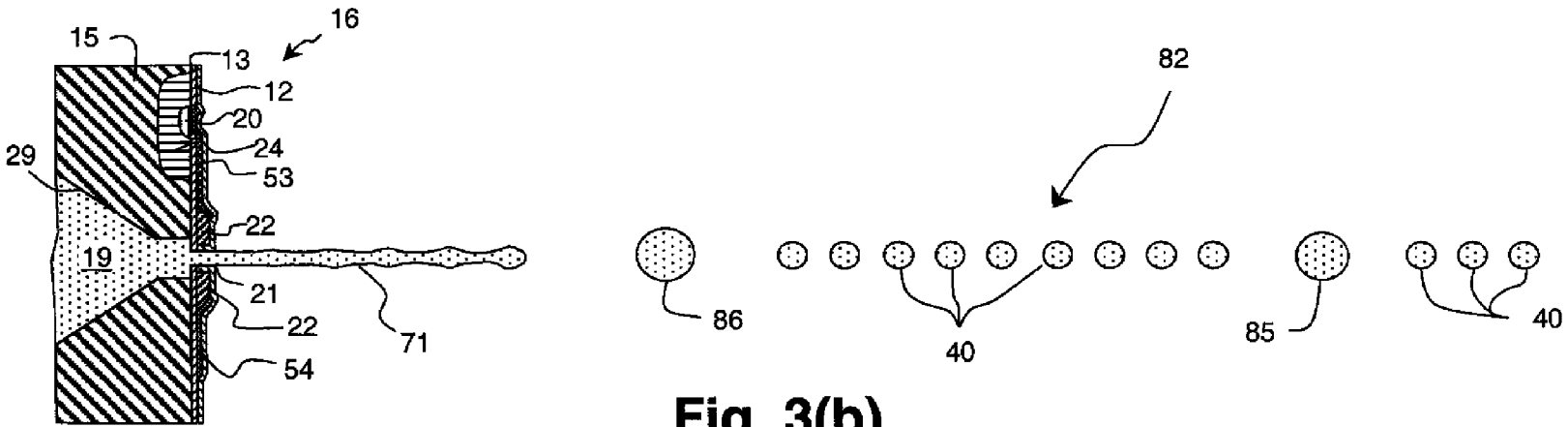

One effect of pulsing jet stimulation heater 22 on a continuous stream of fluid 70 is illustrated in a side view in FIGS. 3(*a*) and 3(*b*). FIGS. 3(*a*) and 3(*b*) illustrate a portion of a drop generator substrate 15 around one nozzle 21 of the plurality of nozzles. Pressurized working liquid 19 is supplied to nozzle 21 via proximate liquid supply chamber 29. Nozzle 21 is formed in drop nozzle front face layer 12, and possibly in thermal and electrical isolation layer 13 and other layers utilized in the fabrication of the ink jet device.

In FIG. 3(*a*) jet stimulation heater 22 is pulsed with energy pulses sufficient to launch a dominant surface wave causing dominate surface sinuate necking 72 on the fluid column 70, leading to the synchronization of break-up into a stream 80 of drops 30 of substantially uniform diameter, $D_d$, and spacing, $\lambda_0$, and at a stable operating break-off point 74 located an operating distance, $BOL_o$, from the nozzle plane. The volume of drops 30, $V_0$, is the volume of fluid emitted from the nozzle in the time of the period of the applied energy pulses as illustrated in FIG. 4(*a*) and is also the nominal or "small" drop volume that will be used for liquid pattern formation.

FIG. 3(*b*) illustrates a continuous stream 71 that is broken into a stream 82 of print drops 40 having the small or nominal volume, $V_0$, and some large volume non-print drops of coalesced fluid, such as large volume non-print drop 86 having a volume $4V_0$ and large non-print drop 85 having a volume of $3V_0$. Thermal pulse stimulation of the break-up of continuous liquid jets is known to provide the capability of generating streams of drops of multiple predetermined volumes. See, for example, Jeanmaire '888 assigned to the assignee of the present invention. The drop stream volume pattern illustrated in FIG. 3(*b*) results from an applied energy pulse pattern such as that illustrated in FIG. 4(*b*).

The fluid streams and individual drops 30, 40, 85 and 860 in FIGS. 3(*a*) and 3(*b*) travel along a nominal flight path at a velocity of $V_d$, based on the working liquid pressurization magnitude, nozzle geometry and properties of the working liquid, especially viscosity.

Figure 4A:
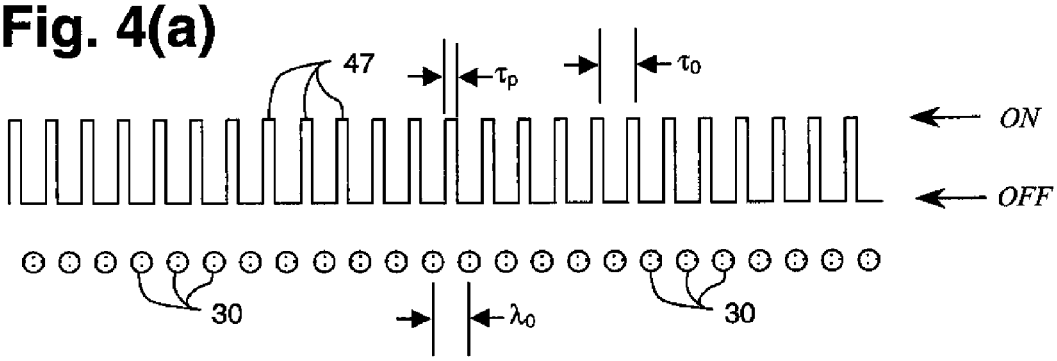
FIGS. 4(*a*), 4(*b*) and 4(*c*) show representations of energy pulse sequences for stimulating synchronous break-up of a fluid jet by stream break-up heater resistors resulting in drops of different predetermined volumes according to a preferred embodiment of the present invention.
Figure 4B:
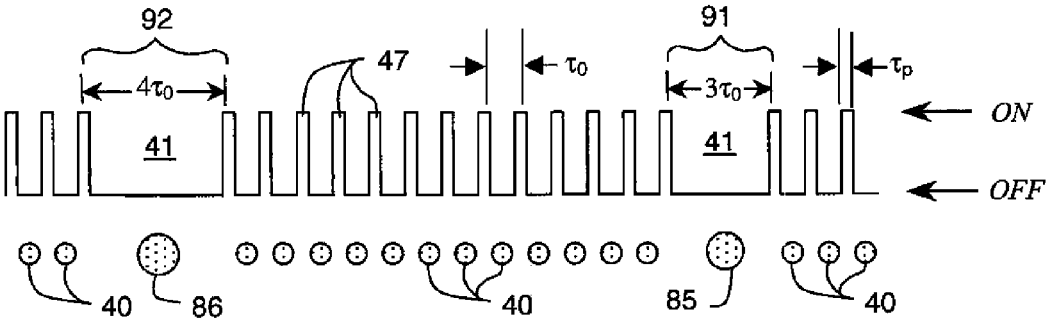
Figure 4C:
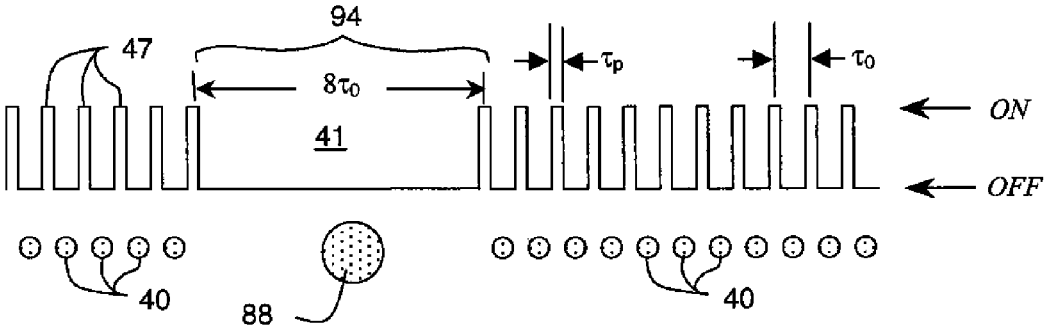

FIGS. 4(*a*)-4(*c*) illustrate thermal stimulation of a continuous stream by several different sequences of drop forming electrical energy pulses 47. The energy pulse sequences are represented schematically as turning a heater resistor "on" and "off" to create a stimulation energy pulse of duration $\tau_p$ during each unit period, $\tau_0$ (FIG. 4(*a*)), or between longer multiples of the unit time period (FIGS. 4(*b*) and 4(*c*)). In practice the duration of the drop forming stimulation pulses may be quite short, that is, typically, $\tau_p \ll \tau_0$.

In FIG. 4(*a*) the stimulation pulse sequence consists of a train of drop forming pulses applied for each unit period. A continuous jet stream stimulated by this pulse train is caused to break up into drops 30 all of volume $V_0$, spaced in time by $\tau_0$ and spaced along their flight path by $\lambda_0 = v_d \tau_0$.

The energy pulse train illustrated in FIG. 4(*b*) consists of drop forming pulses applied during most unit periods, $\tau_o$, however pulses are deleted during some unit periods 41, creating a $4\tau_0$ time period and a $3\tau_0$ time period between drop forming pulses. The unit periods that receive drop forming pulses result in print drops 40 of unit volume, $V_0$. The deletion of drop forming pulses causes the liquid in the jet to collect (coalesce) into drops of larger volumes consistent with these longer than unit time periods. That is, the first pulse-deletion-pulse sequence 92 in FIG. 4(*b*) results in the break-off of a large non-print drop 86 having coalesced volume of approximately $4V_0$ and the second pulse-deletion-pulse sequence 91 results in a large non-print drop 87 of coalesced volume of approximately $3V_0$.

The term "drop forming energy pulse" or "drop forming pulse" will be used in the explanation of the invention herein to denote a stimulation energy pulse of sufficient strength to cause a localized necking and subsequent break-up of the column of liquid emitted under pressure from a nozzle. Both a leading and trailing drop forming pulse are needed to cause the coalescence of the liquid in between into a single drop. Also, it should be apparent that the trailing drop forming pulse associated with a segment of the liquid jet is also the leading drop forming pulse that is associated with the next segment of liquid issuing from the nozzle. The methods of the present invention are carried out by stimulating the emitted column of liquid with drop forming pulses that cause the development of small and large volume drops from the fluid there between. In the discussions herein the same drop forming pulse may be termed a "leading" drop forming pulse if it occurs, in time, when a liquid segment is first emitted and also termed a "trailing" drop forming pulse for the liquid segment that has just previously been emitted.

FIG. 4(*c*) illustrates a pulse train having a pulse-deletion-pulse sequence 94 of period $8\tau_0$ generating a large non-print drop 88 of coalesced volume of approximately $8V_0$. Coalescence of the multiple units of fluid into a single drop requires some travel distance and time from the break-off point. The coalesced drop tends to be located near the center of the space that would have been occupied had the fluid been broken into multiple individual drops of the nominal volume $V_0$.

The formation of a large coalesced drop requires that a drop forming pulse be given to start and stop the liquid sequence and the amount of liquid that may be expected to coalesce into a single drop is not limitless. Practical experience teaches that an upper limit on large drop formation may be $\sim 10V_0$, depending on liquid properties and the length of the drop flight zone that is acceptable to allow the coalescence to occur. In addition, if drops are too large, excessive fluid buildup may occur at the drop capture or guttering point leading to spatter, drop rebound and intermittent clogging or gurgling. Consequently, large non-print drop volumes are preferably formed in the range $\sim 2V_0$ to $6V_0$.

The capability of producing drops in substantially multiple units of the unit volume $V_0$ may be used to advantage in differentiating between print and non-printing drops. Drops may be deflected by entraining them in a cross air (gas) flow field. Larger drops have a smaller drag to mass ratio and so are deflected less than smaller volume drops in an air flow field. Thus a gas deflection zone may be used to disperse drops of different volumes to different flight paths. A liquid pattern deposition system may be configured to print with large volume drops and to gutter small drops, or vice versa. The present printing method invention are applicable to a drop deflection and capturing apparatus configuration that results in forming the liquid pattern using the small drops of volume $\sim V_0$, while guttering large non-print drops of volumes $\sim 2V_0$ to $6\ V_0$.

Figure 5:
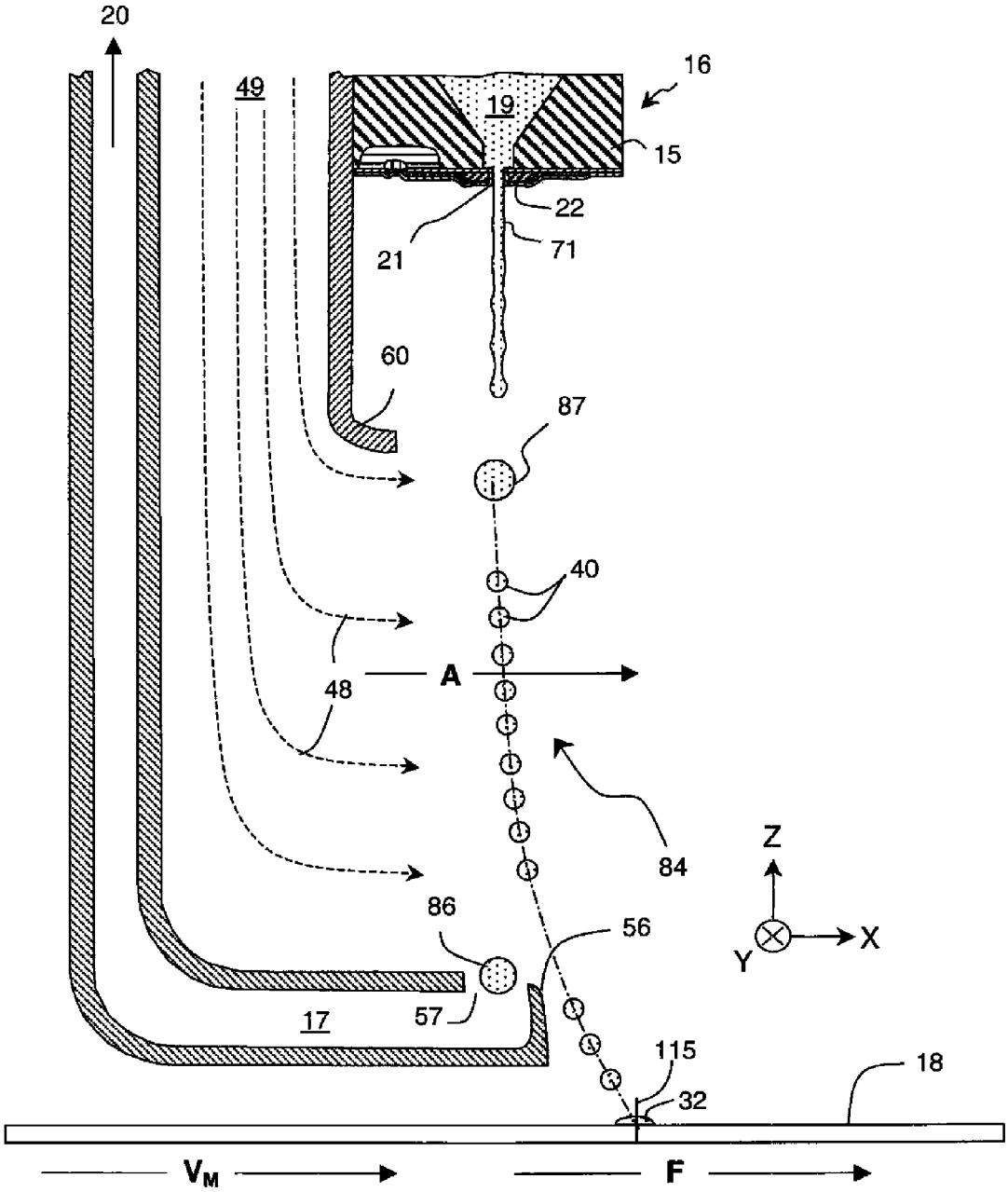
FIG. 5 shows in side cross-sectional view a liquid drop emitter operating with large and small drops according to liquid pattern data wherein large drops are collected by a gutter.

FIG. 5 illustrates in side cross-sectional view a liquid drop pattern deposition system configured to print with a stream of drops 84 including substantially deflected small volume drops 40 and large volume drops 87, 86 that are only slightly deflected by deflection gas flow 48 set up by gas flow plenum 60. The deflection gas flow 48 has a direction indicated by arrow "A" in the X-direction which is also the direction of receiving media transport, F. Positive pressure gas is supplied to gas deflector plenum 60 via positive pressure source inlet 49.

A multiple jet array printhead 16 is comprised of a semiconductor substrate 15 formed with a plurality of jets and jet stimulation transducers attached to a common liquid supply chamber component (not shown). The nozzle array direction of printhead 16 is along the Y-axis of FIG. 5. Pressurized patterning liquid 19 is jetted from nozzle 21 forming fluid stream 71 traveling in the minus Z-direction. Resistive heater 22 is pulsed with drop forming energy pulses to cause the formation of drops of small and large volumes according to input liquid pattern data. Small drops 40 are deflected in the X-direction passing drop capture gutter lip 56 and allowed to impact receiver medium 18 at impact point 115. Printed spots 32 are formed on the receiver medium 18 by the print drops 40 as the medium is transported at velocity $v_M$ in the X-direction.

Large drops are captured by drop capture apparatus 17 which is connected to a liquid recycling unit via recycling outlet 20. A vacuum may also be applied to recycling outlet 20 to assist in the recovery of non-print liquid that accumulates in the drop capture apparatus 17. Non-print drops, such as the large non-print drop 86 illustrated, are finally separated from print drops 40 at a guttering capture location, for example the gutter opening 57 defined in part by drop capture lip 56. The design of the drop capture location and vicinity may result in a preferred upper limit to the volume of non-print drops that may be captured without causing spatter, gutter clogging or other reliability difficulty. The design of the gas flow deflection and drop capture apparatus also may result in a preferred lower limit on the volume of non-print drops. For example, the amount of dispersion in flight path between large and small drops and the reliability of the capture or no-capture event at the gutter capture location may not allow reliable capture of a double volume non-print drop, $2V_0$, instead, requiring that the non-print drops be at least $3V_0$ or $4V_0$ in volume. The minimum and maximum non-print drop volumes that can be reliably captured are important printing system apparatus design parameters that are comprehended in applying the methods of small drop printing of the present invention.

Figure 6:
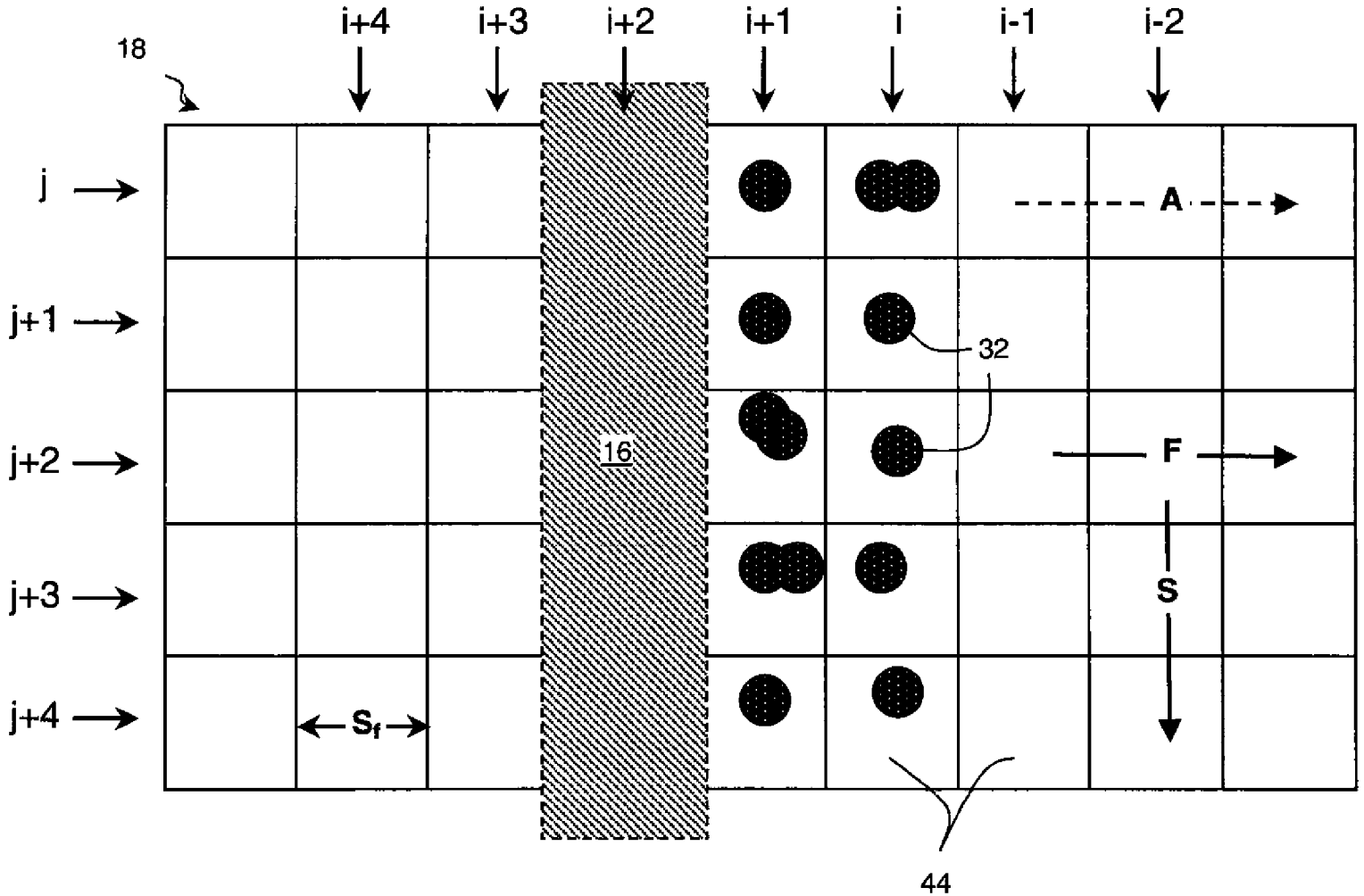
FIG. 6 illustrates a portion of an output image and relevant directions of the printing process.

Some terminology helpful in understanding the present invention may be explained with reference to FIG. 6 that illustrates, in greatly magnified plan view, a portion of a receiving medium 18 having pixel areas 44 which may be printed with liquid spots 32 in the process of forming a desired output liquid pattern. Continuous drop emitting printhead 16 is illustrated as a shaded rectangle. Receiver medium 18 is transported in a left-to-right direction also designated as direction "F", the "fast" scan direction. The fast scan direction is so named as the direction of highest speed relative motion between the printhead and the receiving medium. Pixel locations along the fast scan direction are designated by the index "i" and have an equal spacing, $S_f$. The direction of gas flow "A" of the gas deflection system is also indicated as a dotted arrow, corresponding to the configuration also illustrated in FIG. 5.

The direction labeled "S" is the "slow" scan direction applicable for printing systems wherein the printhead is narrower than a full page width and so must be translated (or the media translated) in a second direction to fully form the output liquid pattern. For a printing system having a page wide printhead as illustrated in FIG. 1, the slow scan direction is the same as printhead array width direction and the slow scan "motion" is zero. Pixel locations along the slow scan direction are designated by the index "j" and are usually referred to as scan lines. The scanlines "j" may be written by a single nozzle of printhead 16 in the case of a "single-pass" printing mode, or may be written by multiple nozzles at different times and passes of the printhead relative to the receiving medium.

One or more liquid dots 32 are illustrated as having been deposited on some pixel areas 44 on receiver medium 18. The position of these "printed" drops arises from the timing of when print drops are formed in a liquid stream of printhead 16 that is opposite receiver medium 18, by the time of flight of drops to the receiver medium, initial liquid emission trajectories from the nozzle, relative motion between the nozzles and the receiver medium, characteristics of the gas flow deflection and drop capture apparatus, inter-drop aerodynamic interactions, and other effects such as mechanical vibrations, liquid supply pressure variations and air currents. The positions of printed spots 32 within pixel areas 44 illustrated in FIG. 6 are intended to show the variability of printed drop position that may occur. It is an object of the methods of the present invention to affect the positions of printed drops along the fast scan direction by selecting the timing of print and non-print drop formation relative to the anticipated locations of pixel areas on the receiver medium. The locations of pixels on the receiver medium may be anticipated from knowledge of the factors just mentioned, by sensing media movement and positions, or by some combination of known stable parameter settings and sensor assisted feedback.

It is also important to recognize that there is a close relationship between the signals provided to each jet stimulation heater 22 of the printhead 16, for example signals in the form of voltage pulses carried on one or more wires connecting an image data source to the printhead or signals in the form of optical pulses carried by a fiber optic cable connecting the image data source to the printhead, and the timing of drop formation and release at print head 16. The drop forming signals are typically represented as energy pulses in a timing diagram, for example as illustrated in FIGS. 4(*a*)-4(*c*). The timing diagram for energy pulses applied to a particular nozzle stimulator is closely related to the spatial pattern of drops ejected from the nozzle and thus to the positional placement of the drops on the recording medium, differing only by a time delay factor accounting for net drop travel times and a spacing factor related to the net relative speed of the nozzle with respect to the receiver medium.

Figure 7:
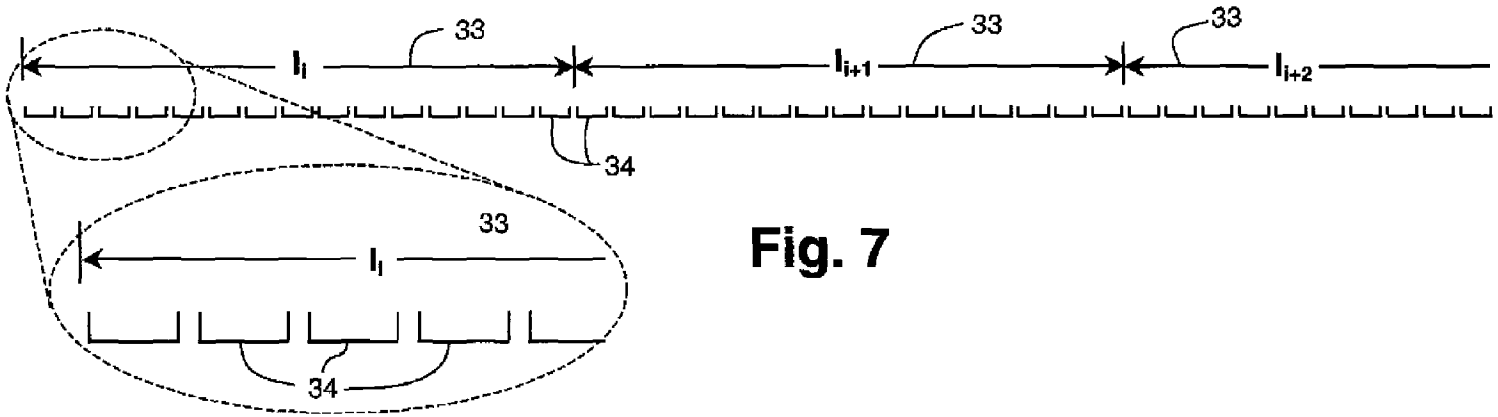
FIG. 7 illustrates various time intervals important in understanding the present invention.

Referring now to FIG. 7, there is shown a timing diagram corresponding to time intervals $I_i$, $I_{i+1}$ and $I_{i+2}$, labeled 33, which have been divided into a plurality of subintervals 34 having equal duration in FIG. 7. The concept of a time interval $I_i$ is introduced to help understand relationships between the fluid that is emitted by a nozzle during the time a pixel area 44 in the output image traverses the print drop impact location 115 along the fast scan direction (see FIGS. 5 and 6). For example, if the receiver medium is moving in the fast scan direction relative to the emitting nozzle at a constant speed of 2 m/sec, $v_M$=2 m/sec, and the pixel spacing along the fast scan direction, $S_f$, is 84 μm (i.e., 300 dots/per inch), then the appropriate time interval, $I_i$, would be: $I_i=S_f/v_M$=42 μsec. In some printing systems, printing may occur while the relative motion between the printhead and receiver medium are changing. In this case, the appropriate time interval $I_i$ may be adjusted for each pixel area "i" to follow the changing relative motion magnitude.

The enlargement of FIG. 7 is shown for clarity in depicting the subintervals 34. The concept of a "subinterval" 34 is introduced herein to keep track of a portion of the liquid that is emitted by a nozzle during the time interval, $I_i$, allocated to printing a pixel area 44 along the fast scan direction. During a particular time interval $I_i$, drop forming pulses 42 can be provided between adjacent subintervals 34. Such drop forming pulses 42 are represented schematically in FIG. 8, which illustrates the case of drop forming pulses placed between all adjacent subintervals and wherein all time subintervals 34 are equal in length.

Usually the subinterval time will be chosen as the shortest drop generation time period that reliable operation of the printhead and drop deflection system will support. That is, the physics of fluid column break-up, satellite drop formation, drop-to-drop aerodynamic interactions and other considerations will lead to system choice of a highest fundamental drop generation frequency, $f_0$, i.e. a smallest drop generation period, $\tau_0$, and associated smallest drop volume, $V_0$. For purposes of understanding the present invention, subinterval times will be illustrated and discussed as nominally equal to the smallest drop generation period, $\tau_0$. However, it is not necessary for the practice of the present invention that time subintervals are of equal and constant value. There may be applications wherein it is advantageous to adjust the subinterval time to follow or adjust for changing system parameters such as liquid viscosity, temperature, printing speed and so on.

Further, for the purposes of understanding the present invention the subintervals are illustrated as not including the drop forming pulses 42. The drop forming pulses are conceptually viewed and illustrated as very narrow, delta-function-like energy pulses that may be inserted at times "between" subintervals to either initiate or to conclude the formation of a drop consisting of all the fluid emitted between adjacent drop forming pulses, i.e., during all the intervening time subintervals. In an actual continuous drop emitter to be used in conjunction with the methods of the present invention, the drop forming energy pulses will have a finite time duration, $\tau_p$, and there will be a finite amount of liquid emitted during the drop forming pulse time duration that joins the drop formed from the liquid emitted during the time subinterval before or after the drop forming energy pulse. Which time subinterval drop receives the fluid emitted during the application of drop forming energy pulses is not important to understanding the present invention. For simplicity, it will be assumed that half the fluid emitted during each energy forming pulse joins the fluid in the previous time subinterval, and half joins the fluid in the next time subinterval.

In the explanations of the present invention hereinbelow, some drop forming pulses 42 will be labeled with other number labels in order to more clearly illustrate the origin of the method feature that directs the insertion of that particular drop forming pulse. However, all of the drop forming pulses, regardless of the number label, or associated method reason for application to the liquid jet, are envisioned to be essentially the same in terms of energy and pulse width. That is, for the purposes of understanding the present invention, drop forming pulses are all intended to perform the same function on a liquid jet, that is, to cause a necking off to either begin or end a liquid sequence that will collect together into a drop of liquid.

The formed drops 30 that are associated with the fluid emitted during a subinterval 34 are illustrated by placing a filled circle beneath each subinterval 34. The representation of subintervals and formed drops in FIG. 8, and similar representations in FIGS. 9, 11, 13, 14, 15, 16, 17, 19 and 21, are schematic, especially in that any drops that are formed by a particular drop forming pulse sequence occur, in time, somewhat later than the applied pulses themselves and, further, arrive at the receiving or gutter location an additional significant time later.

Figure 8:
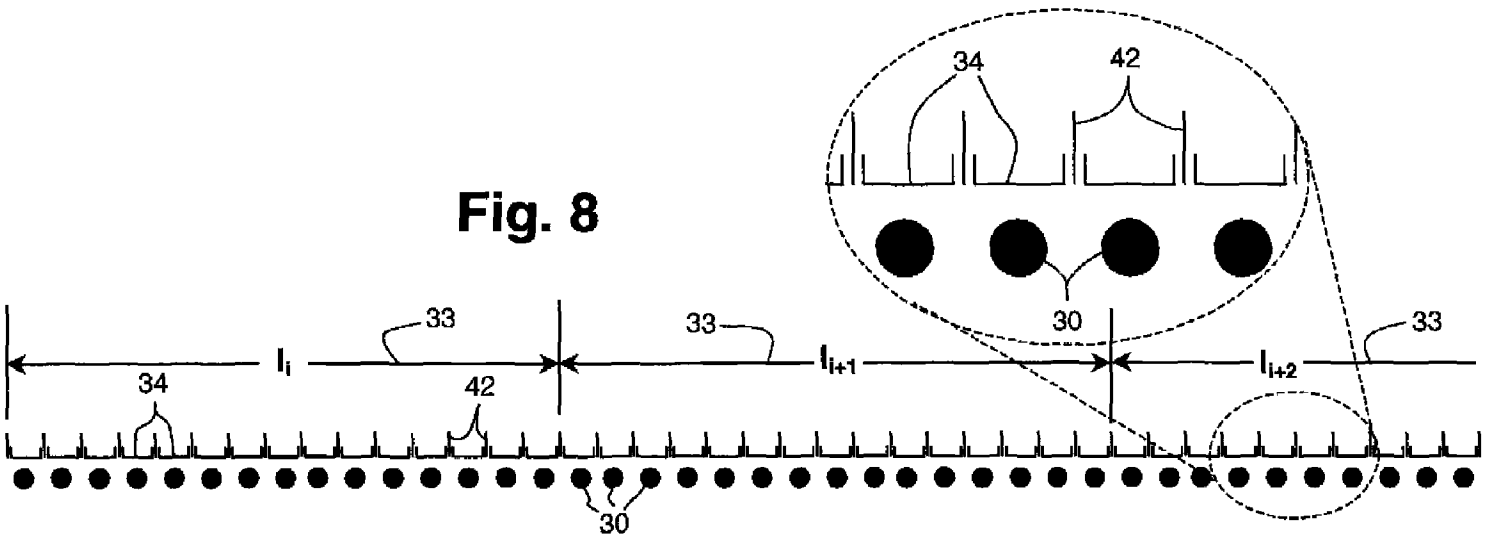
FIG. 8 illustrates time intervals, time subintervals and associated liquid drop formation opportunities important in understanding the present invention.
Figure 9A:
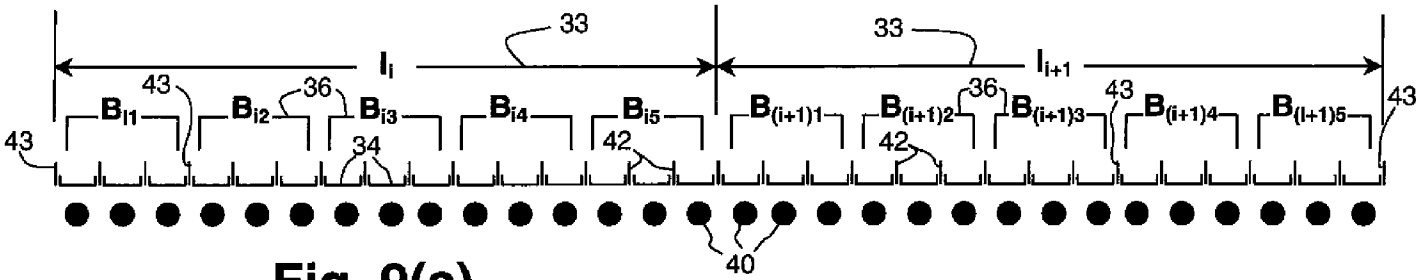
FIGS. 9(*a*), 9(*b*), 9(*c*), 9(*d*), 9(*e*), and 9(*f*) illustrate the use of blocks of time subintervals to control the formation of print and non-print drop patterns resulting in different print optical densities and positions of printed drops within a pixel location according to the present invention.
Figure 9B:
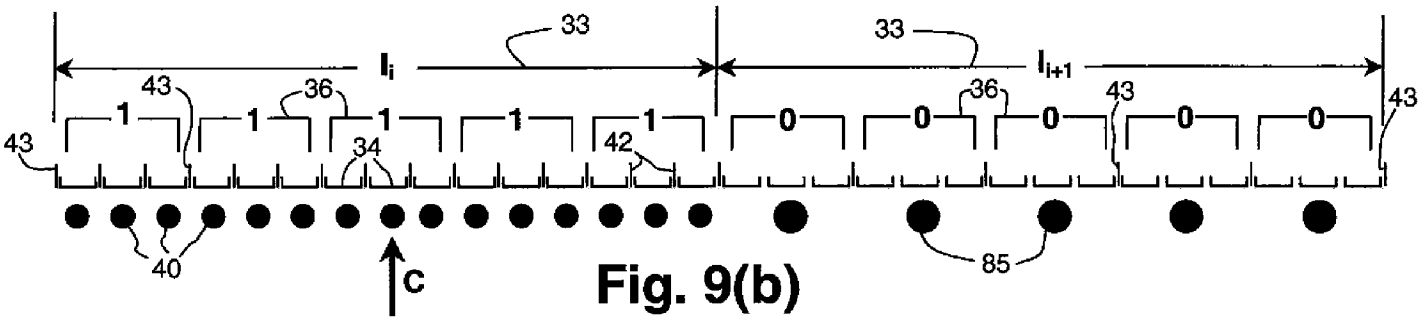
Figure 9C:
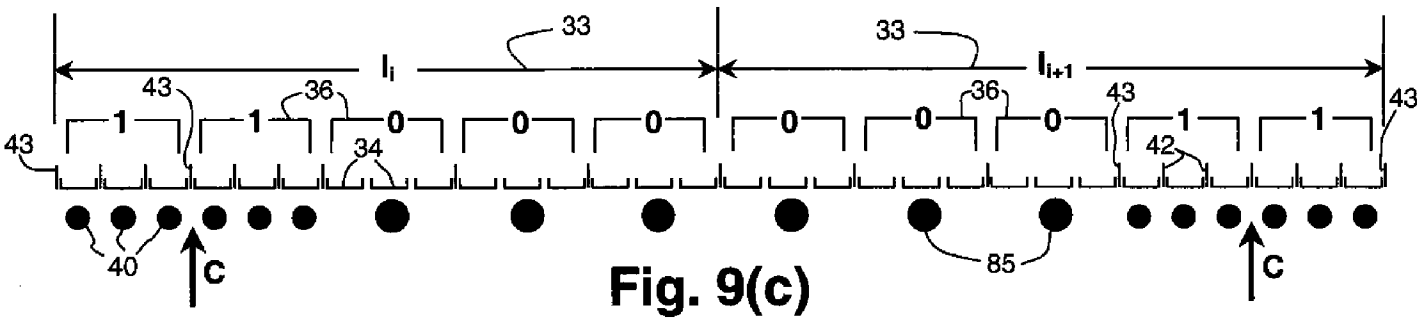
Figure 9D:
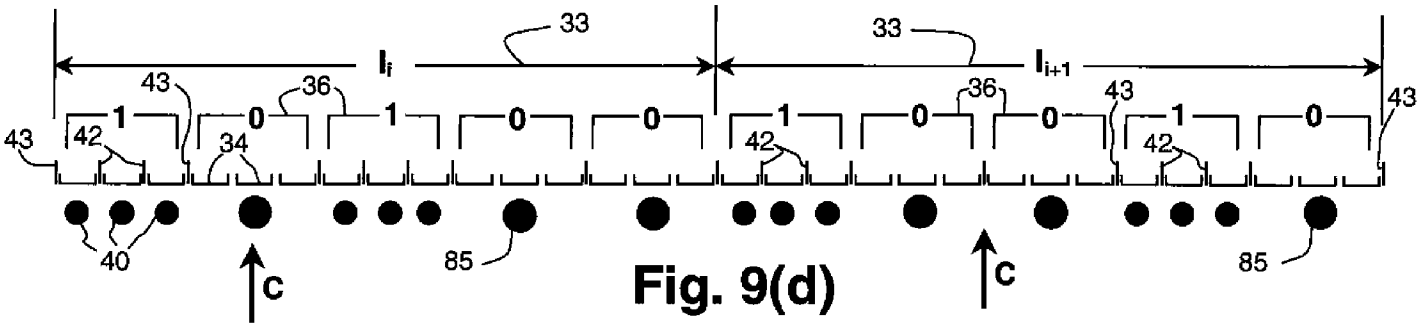
Figure 9E:
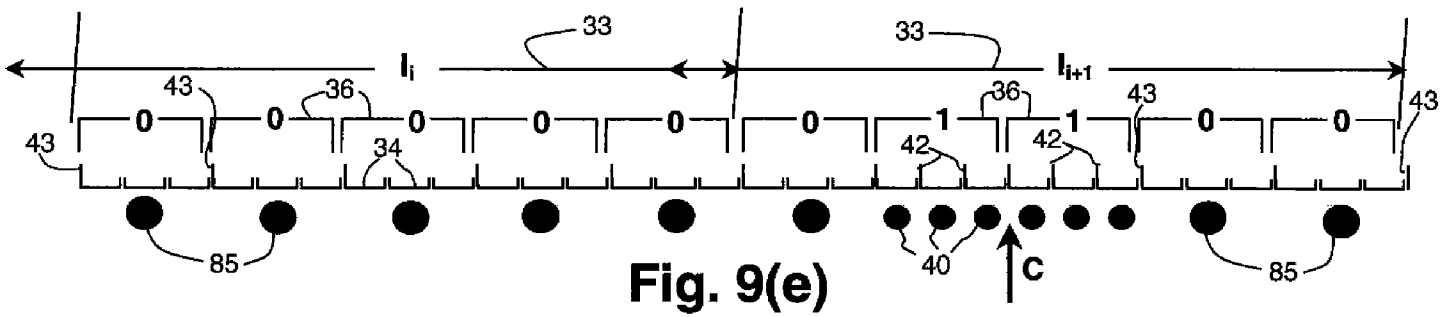
Figure 9F:
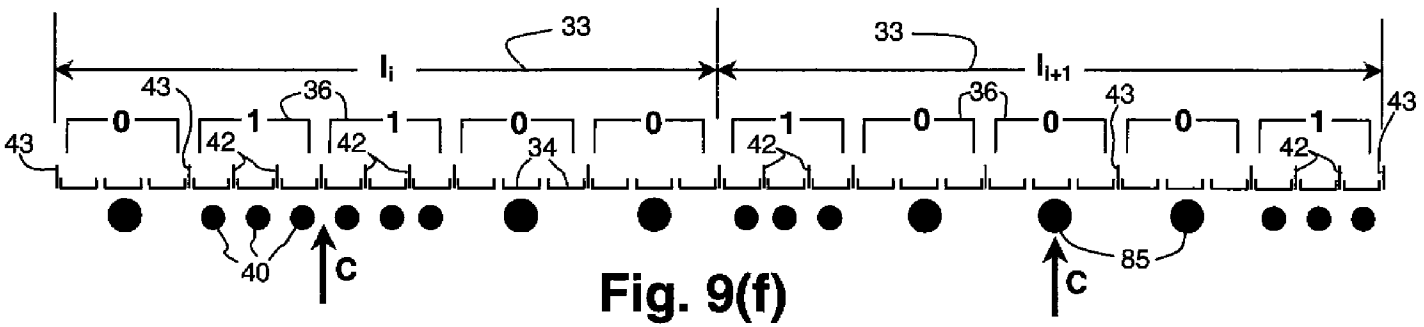

Time intervals 33 $I_i$, $I_{i+1}$ and $I_{i+2}$ in FIGS. 7 and 8 are divided into fifteen subintervals 34, providing the opportunity to allocate the fluid emitted during a time interval 33 between print and non-print drops in a large variety of ways. Grey scale levels may be provided by causing varying numbers of the fifteen subintervals to be formed as print drops. The position of printed drops within the pixel areas associated with the $i^{th}$ time interval may be changed by the order of which subintervals are used to form print drops. However, the system design requirement of a minimum non-print drop volume (and a maximum non-print drop volume as well) that may be reliably guttered introduces a complexity in the allocation of subintervals between print and non-print drop formations that is not present in prior art continuous inkjet systems that do not rely on drop volume differences to differentiate between print and non-print drops.

A first set of embodiments of the present invention utilizes a further organization of the time intervals $I_i$ associated with the $i^{th}$ pixel area on the output receiver medium by grouping the subintervals 34 into a plurality of blocks, $B_{ik}$, labeled 36 in FIGS. 9(*a*) through 9(*f*). For the examples illustrated in FIGS. 9(*a*)-9(*f*), the fifteen subintervals 34 in time intervals $I_i$ and $I_{i+1}$ are grouped into five blocks of three subintervals, i.e. into blocks $B_{ik}$, k=1 to 5. The number of subintervals 34 chosen to form a block 36 is advantageously one that, if formed into a single large drop, is an appropriate size for non-print drop deflection differentiation versus print drops, and for reliable guttering. For the example approach illustrated in FIGS. 9(*a*)-9(*f*), the total emitted fluid associated with each block 36 of subintervals 34 would form a drop of volume ~$3V_0$. Such a subinterval block arrangement is appropriate for use with a printing system apparatus that can reliably gutter drops of volume $3V_0$ while forming the output liquid pattern using drops of volume $V_0$.

FIG. 9(*a*) illustrates the organization of the fifteen subintervals 34 of time intervals $I_i$ and $I_{i+1}$ into five blocks $B_{ik}$ and $B_{(i+1)k}$, k=1 to 5 respectively. FIGS. 9(*b*) through 9(*f*) then illustrate several output print patterns that may be specified by labeling each block with either a print label, "1", or a non-print label "0". As the solid fill circles indicate, blocks that are designated or labeled "1" are caused to generate three print drops 40 of volume $V_0$ and blocks labeled "0" are caused to generate one large non-print drop 85 of volume $3V_0$. Drop forming pulses 43 are provided between every adjacent block 36 of subintervals 34. In addition, for blocks that are designated to print, labeled "1", drop forming pulses 42 are also provided between each of the subintervals 34 within a "1" block. For non-print blocks labeled "0", the interior block drop forming pulses 42 are not provided. Consequently, for blocks labeled "0" all of the fluid emitted for the three subintervals of that block coalesce into a single non-print drop 85.

I. Fixed Equal Subinterval Block Methods

This first set of embodiments of the present invention may be termed fixed equal subinterval block methods. Using firmware or software executed image processing algorithms, input image or pattern data is examined for each output pixel and a decision is made as to whether each subinterval block of the time interval $I_i$ should be labeled "1" or "0", for print or non-print. For the example shown in FIG. 9(*b*), all five blocks, all fifteen subintervals of time interval, $I_i$, are labeled "1", i.e. given the block sequence [11111] which will result in the pattern of drop forming pulses indicated and in the printing of the maximum amount of liquid, $15V_0$, being applied to the associated pixel area on the receiver medium. Such a pixel, when clustered with other similarly printed pixel areas, will exhibit the maximum output image optical density, $OD_{max}$, or liquid pattern layer thickness, provided by this method. The very next pixel area, $I_{i+1}$, will receive no liquid as the non-print drop block sequence [00000] has been selected.

FIGS. 9(*c*) through 9(*f*) illustrate several alternative print drop patterns that print six of fifteen drops in a pixel area. To first order these pixel areas will exhibit an output pixel optical density of ~$6/15\ OD_{max}$. However, because the exact sequencing and impact times of the several six-print drop patterns is different, small intentional density variations about the nominal $6/15\ OD_{max}$ level may be created. The centroid of the liquid pattern to be printed during the time intervals illustrated is indicated by the arrow designated "C". It may be appreciated from FIG. 9(*c*) that the six drop pattern to be printed during time interval $I_i$ as compared to the six drop pattern to be printed during the next time interval $I_{i+1}$ places the centroid of liquid at opposite ends of the corresponding pixel areas.

Figure 10:
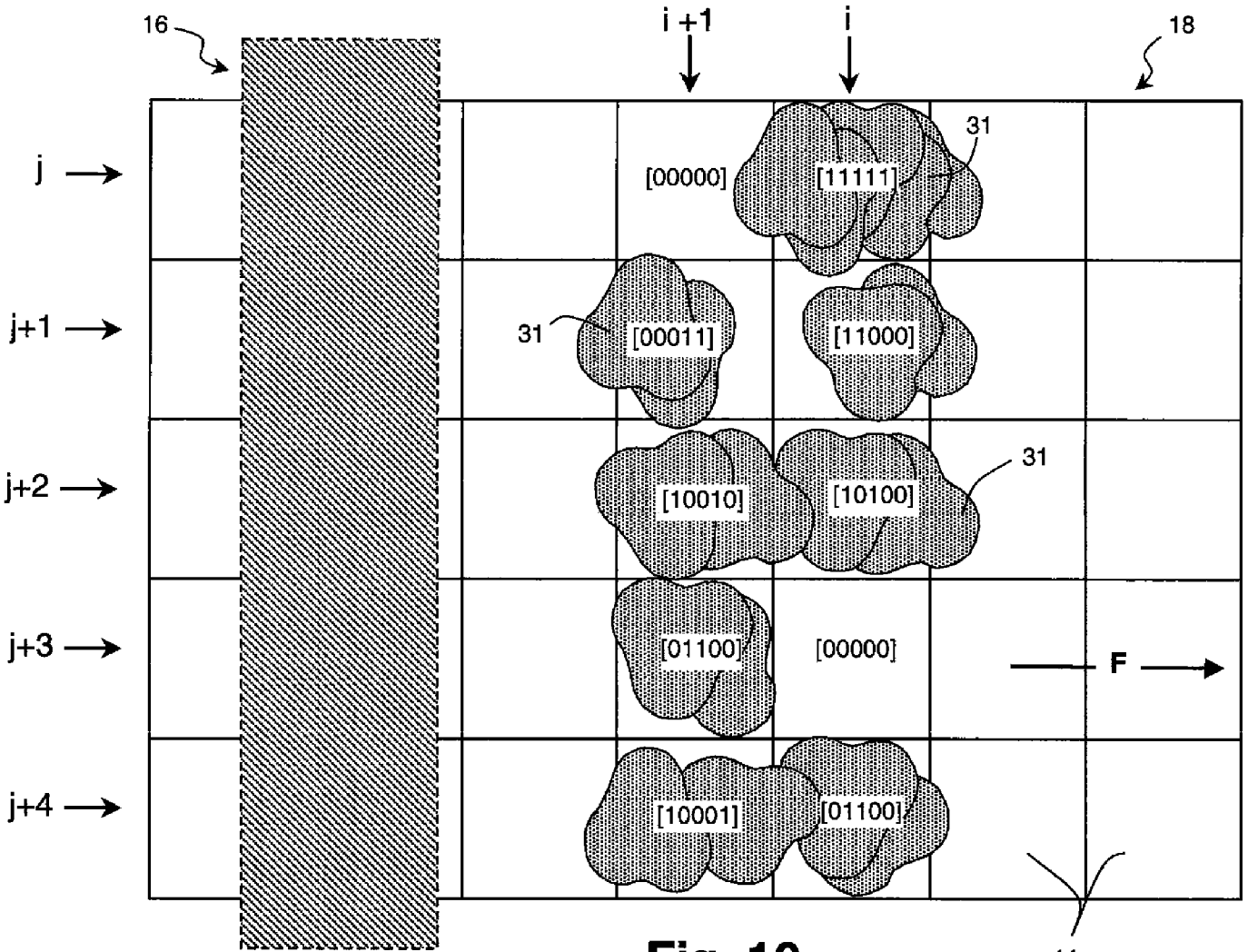
FIG. 10 illustrates the printed drop patterns that would result from the print and non-print drop formations directed by the time and pulse patterns illustrated in FIGS. 9(*b*)-9(*f*)

FIG. 10 illustrates the different within-pixel-area print patterns that are expected from the block print and non-print labeling illustrated in FIGS. 9(*b*) through 9(*f*). The three-drop print drop blocks are illustrated as three-lobed print spots for clarity. In practice, the printed spots will most likely form more circular shapes, or oval shapes in the fast scan direction, upon impact with the receiver media. The printed spots associated with time intervals $I_i$ and $I_{i+1}$ in FIGS. 9(*b*), 9(*c*), 9(*d*), 9(*e*) and 9(*f*) are illustrated in FIG. 10 in scanlines j, j+1, j+2, j+3 and j+4 respectively. The block designation sequences of 1's and 0's that are given in FIGS. 9(*b*) through 9(*f*) are indicated as bracketed labels on the associated pixel areas of FIG. 10. Note also that because the media is transported in the fast scan direction F, the $i^{th}$ pixel areas are printed before and to the right of the $(i+1)^{th}$ pixel areas in FIG. 10. The time sequences depicted in the Figures herein show time increasing from left-to-right. Therefore the printed pixel sequences have a reverse right-to-left order in FIG. 10 as compared to the left-to-right time sequences in FIGS. 9(*b*) through 9(*f*).

The several different arrangements of a six drop printed drop pattern that are shown in FIG. 10 illustrate that many different minor density levels, as well as variations in the centroid or shape of the printed liquid within a pixel area, are possible when using the printing methods of the present invention. If the input liquid pattern data includes higher resolution information than simply an average density level at each pixel area, this additional information may be used to choose the "best" pattern of print drops from among the several different print drop patterns that are possible. Alternatively the input image data may be examined to detect special features, for example sharp image edges, font character curves or potential areas of periodic artifacts (moire'), and the output print drop pattern chosen to improve the image rendition accordingly. For example, if an input pixel area is part of a font character curved edge, shifting the print drop pattern within the pixel area may be done to produce a smoother character edge.

The translation of input image information to output drop forming pulse sequences may be easily implemented by a look-up table method or other image processing rule algorithm procedure. A first step is to select the pattern(s) of print, non-print block labels that most closely replicates the input optical density at each image pixel area. In a second step, if the centroid or shape or both of the input optical density within a pixel area is known, a best pattern from among the same print-drop-number block patterns may be selected to best replicate the input pixel in totality. In a third step, the subinterval block labels are used form the sequence of drop forming pulses to be applied for each subinterval 34 of the time interval $I_i$ associated with the $i^{th}$ pixel area. That is, drop forming pulses are applied between every block of subintervals and between every subinterval within blocks labeled "1" or "print". Finally, this time sequence of drop forming pulses is applied to the drop forming resistive heater (or other jet stimulation means) to cause the desired sequence of small print drops and large non-print drops.

The fixed equal subinterval block method illustrated by FIGS. 9(*a*) through 9(*f*) has two useful advantages: all non-print drops have the same volume and the coding required to specify any of the possible drop forming pulse sequences for all subintervals is a binary number having only as many digits as there are blocks of subintervals. If all non-print drops have the same nominal volume, the deflection and drop capturing apparatus may be optimized to differentiate between that volume and the print drop volume. Simple coding of the output pulse sequences saves memory space and promotes rapid execution and data transfer rates.

A disadvantage of the fixed equal subinterval block method is that several gray levels that are potentially realizable using each of the multiple drops in a time interval as a density step cannot be accessed. In the example configuration discussed above, there are fifteen print drops that can be generated for printing on each output image pixel area. To first order, the fifteen printable drops could provide sixteen (with zero drops as the sixteenth possibility) levels of gray or liquid volume per output pixel area. However, because of the fixed subinterval block organization, in the example five blocks of three printable drops, only drop pattern levels 0, 3, 6, 9, 12 and 15 are selectable to replicate an input pixel optical density. Thus, if the input liquid pattern data specifies a quantized optical density level of "7" at a pixel location, the example fixed equal subinterval block method can only approximate this density level by printing a level "6" drop pattern, producing an "error" in the output image, in this case a lighter optical density than the desired optical density.

Quantized optical density levels will be used in the explanation of the present invention for convenience. For example, optical density for typical opaque images ranges from zero to a maximum value, $OD_{max}$, above the optical density of the receiver medium and is the inverse logarithm (base 10) of the reflected light intensity normalized by the incident light intensity. This range may be quantized into a set of equally spaced levels, for example 16, 32, 64, 128 or 256, and the optical density then expressed as the value of the nearest level. Quantized values for input and output image optical densities will be used hereinbelow for simplicity of understanding. The present invention are applicable to any use of liquid pattern writing, including the forming of opaque images, transparent images, liquid precursor layers for a manufacturing process, liquid pattern layers for a manufacturing process and so on. The quantized optical density levels used in the explanations herein may be conceptually related to similarly quantized liquid levels that are appropriate to any of the applications that may be served by the use of the present invention.

The inventors of the present invention have recognized that errors in output pixel rendition, introduced when fewer output density levels are available compared to input image information, may be ameliorated by use of error diffusing techniques that are often practiced in digital imaging. The difference between input and output pixel optical density is divided up and added to adjacent or nearby input pixel density before selecting the output pixel value for the adjacent pixel areas in an iterative procedure. If the output density level is low ("lighter") then the excess input pixel density amount, the extra "darkness", is "diffused" or transferred to adjacent pixels. If the output pixel density is too high, then the excess output image darkness is subtracted from adjacent pixel areas.

Figure 11:
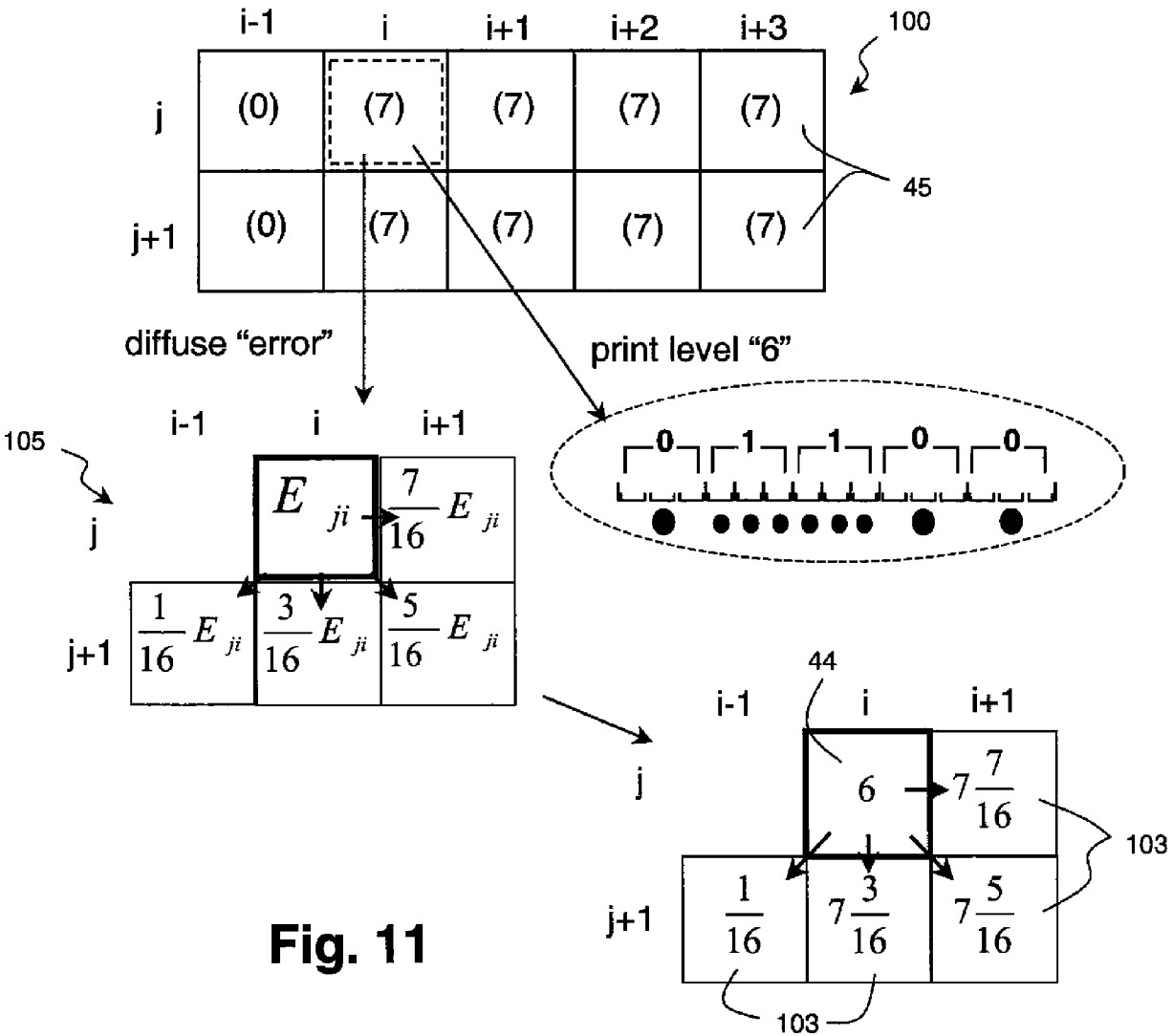
FIG. 11 illustrates an error diffusion procedure according to the present invention.
Figure 12:
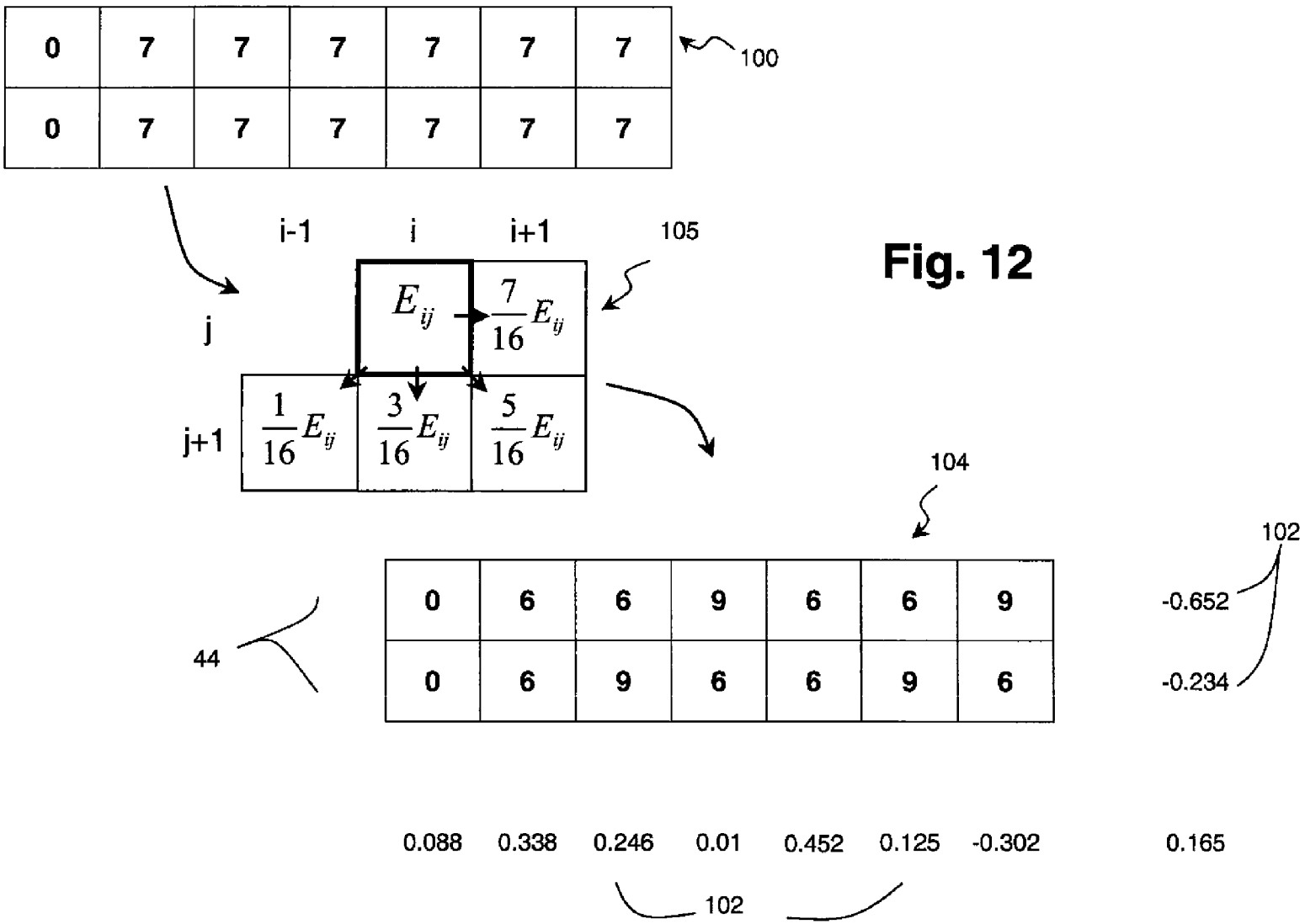
FIG. 12 illustrates the results of an error diffusion procedure for a portion of an input image according to the present invention.

There are many error diffusion methods and proscriptions known in the digital imaging art. Any or all of the known error diffusion methods may be useful in conjunction with the application of the fixed equal subinterval block method of small drop printing disclosed herein. An example error diffusion method useful in conjunction with a fixed equal subinterval block method is illustrated in FIGS. 11 and 12. The example of a fixed equal subinterval block method illustrated in FIG. 9(*a*) is continued in FIGS. 11 and 12 by adding a Floyd-Steinberg error diffusion process to supplement the procedure of selecting the number of print blocks to best replicate an input image. A Floyd-Steinberg error diffusion method is implemented by first calculating the error, $E_{ji}$, at the $ji^{th}$ pixel in the output image, $Om_{ji}$, as compared to the input image $Im_{ji}$, $E_{ji}=Im_{ji}-Om_{ji}$. The error, $E_{ji}$, is divided into portions of $7/16\ E_{ji}$, $5/16\ E_{ji}$, $3/16\ E_{ji}$ and $1/16\ E_{ji}$ and then added to the adjacent pixels as indicated in error diffusion mask design diagram 105 in FIG. 11.

One skilled in the art will realize that the values of $7/16$, $5/16$, $3/16$, and $1/16$ are just one way of dividing the up the error, $E_{ji}$, and distributing it to adjacent pixels, and that there are many such ways that could be applied equally well to the present invention. Collectively, the set of fractions used to divide up the error are known as the "error diffusion mask", "error diffusion weights", "error diffusion filter", or "error weights". The process of multiplying the error $E_{ji}$, by the error weights is referred to as "weighting" the error.

A portion of an input image 100 is illustrated in FIG. 11 as a 2 by 5 set of input image pixel areas 45. The portion of input image area depicted has a transition from a quantized optical density level of 0 (of 16 levels, 0 to 15) in the $(i-1)^{th}$ pixel column to a quantized optical density level of 7 for pixel columns i through i+3. Output image pixel processing is assumed to proceed across image row j from left-to-right increasing the index i, then down to the beginning of the next row (j+1), then left-to-right in index i again, and so on throughout the entire input image and corresponding output image. For the example system (see FIG. 9(*a*)) being discussed wherein only liquid or density levels 0, 3, 6, 9, 12 and 15 are possible because of the 3-drop block organization, the output image consists of instructions to print only these number drop patterns. The fixed equal subinterval block method of this example therefore provides six printable levels of the sixteen levels that might be otherwise provided given an ability to apply any number of drops between zero and fifteen.

Focusing on the $ji^{th}$ pixel of the input image 100, the gray level is given as $Im_{ji}=7$. The $ji^{th}$ pixel in the output image pixel area 44 is assigned the closest permitted output level, $Om_{ji}=6$, causing an error at the $ji^{th}$ pixel of $E_{ji}=7-6=1$. The $ji^{th}$ pixel error is then diffused to the adjacent pixels according to the Floyd-Steinberg mask 105, yielding new, adjusted input pixels labeled 103 in FIG. 11. The output image level choice and error diffusion processes are then carried out for the $j(i+1)^{th}$ pixel, then the next pixel in the $j^{th}$ row from left-to-right across the image. The (j+1) row is processed in similar fashion and then the process is continued on through the entire image in a sequence of across a row, down to a next row, then across again. The example fixed equal subinterval block processing method together with a Floyd-Steinberg error diffusion mask 105 has been applied to the 2 by 7 portion of an input image 100 illustrated in FIG. 12, resulting in the output image 102 and associated errors 103 to be diffused to adjacent pixels. It maybe appreciated by studying output image 102 in FIG. 12 that the input image grey level of "7" in many pixel areas 45 has been replicated in the output image by printing some pixel areas 44 with a six-drop pattern and some with a nine-drop pattern, resulting in an average density of "7" over the 12 non-zero output image pixels in FIG. 12.

As discussed above, there is some density variation about a nominal level that may be achieved by using different sequences of a given number drop pattern. For example a range of density levels from 5.5 to 6.5 may be achievable by using the several six-drop patterns illustrated in FIGS. 9(*b*) through 9(*f*). If such additional gray levels are invoked in the choice of drop forming sequences, the amount of error that needs to be diffused can be reduced and the output image will more closely replicate the input image, pixel by pixel.

Other sequences of processing may be adopted, for example the reverse order of what has been just stated. The inventors of the present invention envision that any effective error diffusion process may be utilized in conjunction with choosing output drop formation and printing sequences according to a fixed equal subinterval block method as described herein.

II. Fixed Unequal Subinterval Block Methods

A second set of embodiments of the present invention for small drop printing may be realized by relaxing the requirement that the blocks of time subintervals be of equal numbers of subintervals. These methods may be termed fixed unequal subinterval block methods. Blocks of subintervals in this alternate approach are allowed to contain a number of subintervals that are greater than the minimum number that combine to form the minimum size non-print drop that can be reliably differentiated from print drops and guttered. For example, if the minimum non-print drop volume is $MV_0$, where M is an integer greater than or equal to 2, then fixed blocks having M, M+1, M+2, and so on may be considered in establishing a set of fixed block sizes to make up a time interval $I_i$. The total number of subintervals, N, contained in the total number of blocks is constrained, however, to be the same for all time intervals, $I_i$.

It may be preferred, from the perspective of designing a reliable gas flow deflection and drop capturing apparatus, to use the narrowest range of large drop sizes that will provide the most flexibility in reproducing gray levels. It will be appreciated from the discussion herein below that all possible grey levels that can be provided by the fixed unequal subinterval block method are realized by choosing blocks to have M, M+1, M+2, . . . , (2M−1) subintervals. Choosing larger blocks of subintervals will not provide additional gray scale opportunities and may result in non-print drops that are too large for reliable guttering. If the minimum reliable non-print drop volume that could be differentiated and guttered was $3V_0$, then the preferred choices of numbers of subintervals in a block are 3, 4 or 5. If the minimum volume non-print drop could be $2V_0$, then subinterval blocks of 2 and 3 subintervals would be preferred.

Figure 13A:
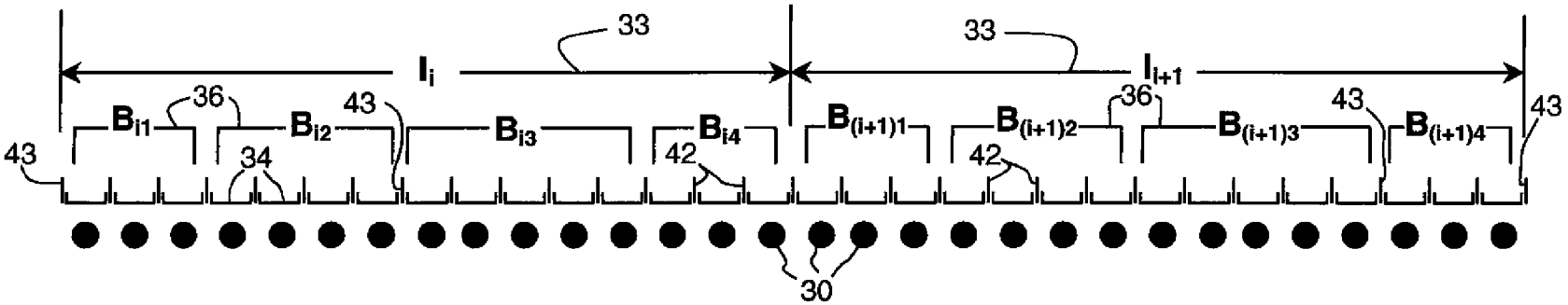
FIGS. 13(*a* and 13(*b*) illustrates alternative block arrangements of time subintervals of use in directing the formation of print and non-print drops according to the present invention.
Figure 13B:
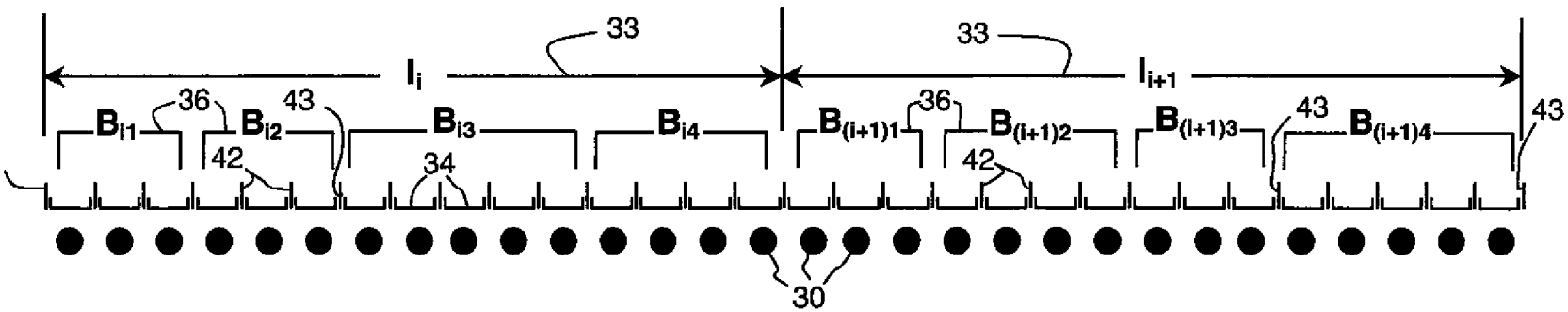
Figure 14A:
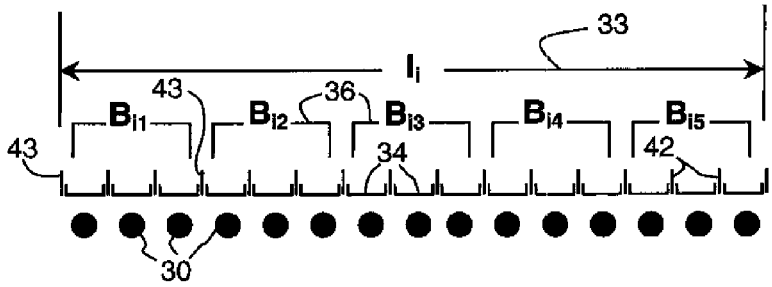
FIGS. 14(*a*), 14(*b*), 14(*c*), 14(*d*) and 14(*e*) illustrate alternative block arrangements of time subintervals of use in directing the formation of print and non-print drops and some resulting drop patterns according to the present invention.
Figure 14B:
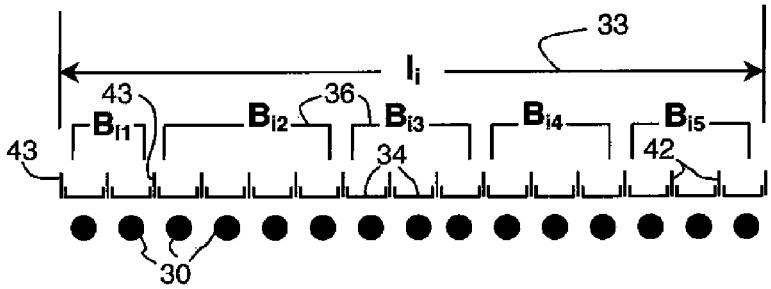
Figure 14C:
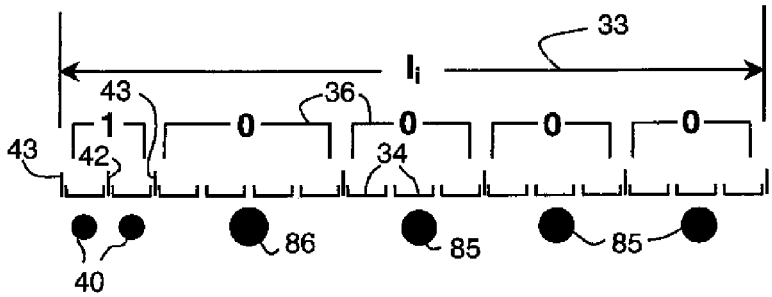
Figure 14D:
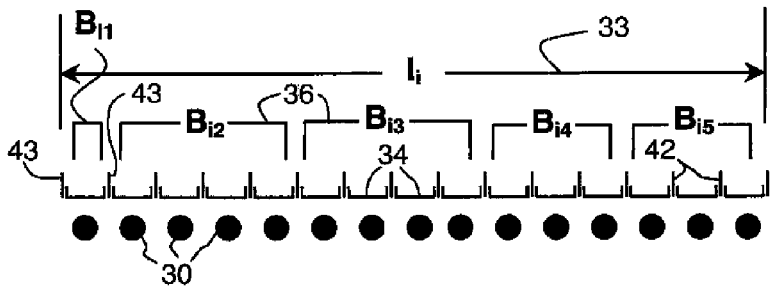
Figure 14E:
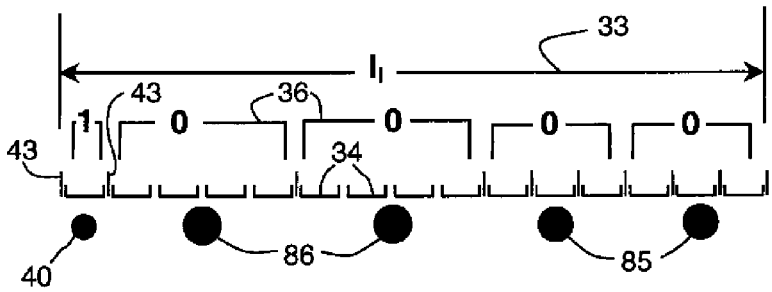
Figure 15A:
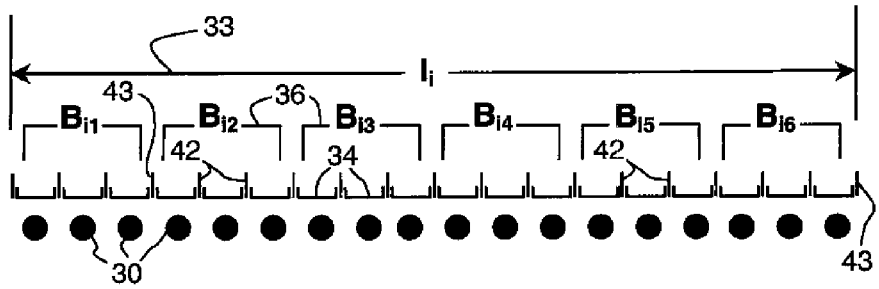
FIGS. 15(*a*), 15(*b*), 15(*c*), 15(*d*) and 15(*e*) illustrate alternative block arrangements of time subintervals of use in directing the formation of print and non-print drops and some resulting drop patterns according to the present invention.
Figure 15B:
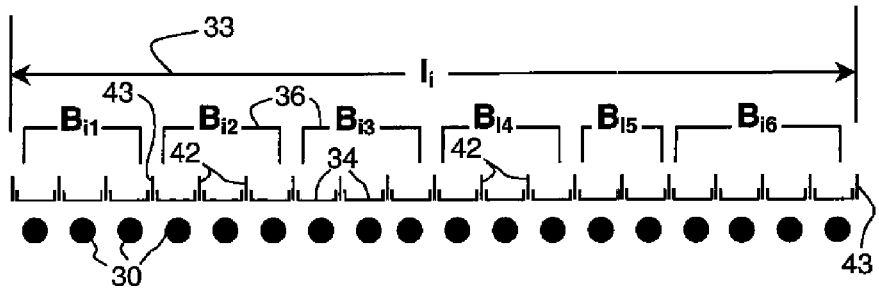
Figure 15C:
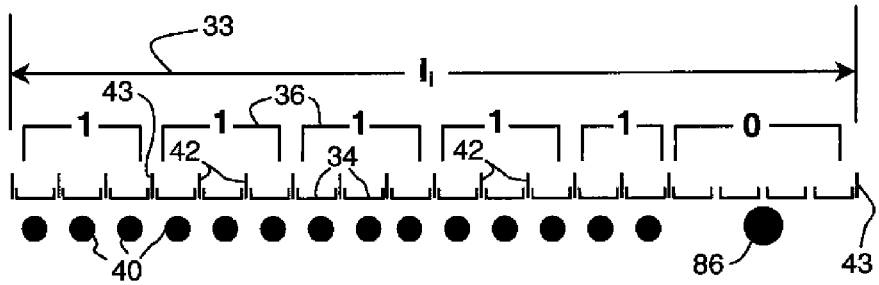
Figure 15D:
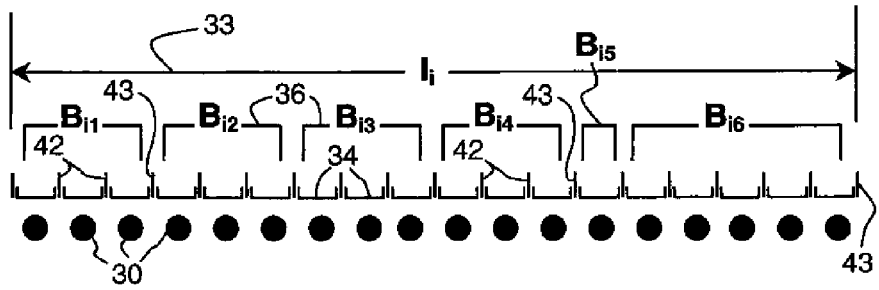
Figure 15E:
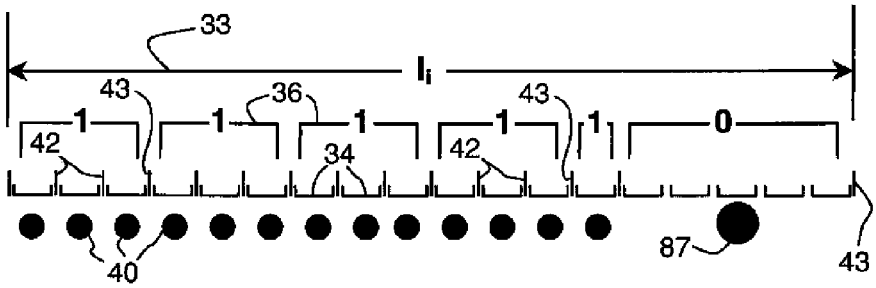

FIGS. 13(*a*) and 13(*b*) illustrate an example of a fixed unequal subinterval block arrangement for the case of fifteen subintervals 34 per time interval 33. As before, the time intervals are associated with the time that an image or liquid pattern output pixel area 44 is passing by the print point, i.e. position 115 in FIG. 5. Providing fifteen subintervals during each time interval could yield sixteen levels of optical density (0 up to 15 print drops) or liquid volume per output pixel area, except for the limitations imposed by the subinterval block organization utilized. Time intervals $I_i$ and $I_{(i+1)}$ are divided into four blocks of subintervals having 3, 3, 4 or 5 subintervals each. It is assumed that the continuous liquid drop printing system is able to differentiate and gutter properly large non-print drops formed from any of these block sizes.

Different orders of the blocks of different sizes are illustrated in FIG. 13. It is anticipated by the inventors of the present invention that fixed unequal subinterval block methods may be implemented wherein the order of blocks of different sizes is always the same, varies in a predetermined way in time or along different scanlines or both, or is changed for each output image pixel in a fashion that provides the best replication of the input pixel image information. The latter method could be implemented, for example, using look up tables in choosing the block size order. For the example illustrated in FIGS. 13(*a*) and 13(*b*) there are twelve unique ways to order the four blocks. The different approaches to choosing block order lead to different image memory and processing time requirements. Allowing the block order to be any of those possible for each pixel area provides the most flexibility in reproducing the detailed optical density within each input image pixel, at a cost of carrying the most information necessary to specify the pattern of drop forming pulses that is to be applied.

It may be appreciated by organizing the fifteen subintervals of each time interval into four blocks of 3, 3, 4 and 5 subintervals each, it becomes possible to provide average liquid volumes of 0, 3, 4, 5, 6, 7, 8, 9, 10, 11, 12 and 15 times $V_0$ at each output pixel. The twelve out of fifteen levels accessible using the fixed unequal subinterval block method compares favorably to the previously discussed fixed equal subinterval block method, providing access to twice as many levels of liquid application per output pixel area. However levels 1, 2, 13 and 14 are still not accessible. In general, if M is the minimum subinterval block size that can be formed into a non-print drop and N is the total number of subintervals in each time interval, $I_i$, then levels M−1, M−2, . . . 1 and N−1, N−2, . . . N−M+1 cannot be provided because of the minimum block size constraint.

The fixed unequal subinterval block methods may be operated in analogous fashion to the previously discussed fixed equal subinterval block methods. Blocks are assigned a label "1" for print or "0" for non-print. Drop forming pulses are inserted between every block of subintervals and between every subinterval within blocks labeled "1" for print. Drop forming pulses are not inserted between subintervals within blocks labeled "0", causing the formation of large non-print drops from these blocks of subintervals. The large volume non-print drops will have different volumes depending on which of the unequal subinterval blocks are labeled "0". However, it is assumed that the drop deflection and gutting apparatus can reliably operate with non-print drop volumes of any of the volumes produced by a block labeled "0".

In similar fashion to the previous methods, the fixed unequal subinterval methods allow the printing of some levels of printed liquid to be applied in different time orders, hence amounts of overlap and position within an output pixel area, by shifting the order of blocks. Also, in similar fashion, an error diffusion procedure may be combined with the fixed unequal block method to ameliorate the errors that are generated, especially because some levels of liquid application are still not accessible.

The print, non-print designation may be captured, as for the previous methods by a binary word having a digit for each block. For the examples in FIGS. 13(*a*) and 13(*b*), a four-bit word can be used to specify which blocks are to have drop forming pulses between interior subintervals and which do not. For an embodiment wherein the unequal blocks are always arranged in the same order or a predetermined, recurring order, for every time interval $I_i$, the order and block sizes may be simply provided as non-image dependent information that is combined with a four-bit word associated with each pixel that does carry the input image information. The drop forming pulse sequence for the time interval is then formed from the image dependent and non-image dependent information.

For embodiments of the present methods wherein the time order of the unequal blocks is selected also based on image input information, then a word specifying the block order may also be needed in association with the print, non-print word. For the example illustrated in FIGS. 13(*a*) and 13(*b*), there are twelve unique arrangements of blocks having 3, 3, 4, 5 subintervals. These twelve possibilities could be represented, for example, by a second four bit word, so that an eight bit word is associated with each time interval, four bits specifying the order of the blocks of each size and another four bits specifying the print, non-print labels for the blocks. It will be apparent to those skilled in the art that there are a number of schemes that could be used to represent the block size order and print, non-print information. A final algorithm or look-up table may be used to translate this information into the proper sequence of drop forming pulses that will cause the desired pattern of print and non-print drops for every image output pixel area.

III. Variable Unequal Subinterval Block Methods

A third set of embodiments of the present invention relaxes the requirement that the numbers of subintervals per block be a set of fixed numbers totaling the number N of subintervals. These methods may be termed variable unequal subinterval block methods. At total number N of subintervals is associated with each time interval so that there is the potential to supply N+1 liquid levels to each output pixel area, if every possible number of subintervals could be coded to print. The requirement that every block of subintervals that is coded as non-print, "0", must have at least M subintervals cannot be relaxed or the printing system would be unable to reliably differentiate and capture all non-print drops. The variable unequal subinterval block method does, however, relax the requirement that the unequal blocks be a same fixed set for every time interval. The number of subintervals that form a block may be adjusted based on image input data. In this method, larger blocks may be formed from some blocks, leaving remainder blocks that are too small to be formed as non-print drops, but may be coded as print drops.

Some examples of the application of the variable unequal subinterval block methods are illustrated in FIGS. 14(*a*) through 14(*b*). In FIG. 14(*a*), a time interval $I_i$ having fifteen subintervals has been organized into five blocks, $B_{ik}$, k=1 to 5, of three subintervals, in similar fashion to the fixed equal block method example in FIG. 9(*a*). For this example, it is assumed that the minimum number of subintervals in a block that can be formed into a non-print drop is M=3. Coding these blocks as "1" or "0" allows the printing of liquid levels 0, 3, 6, 9, 12 and $15V_0$ as previously discussed. If one subinterval is shifted out of one block to another, then new levels may be created. In FIG. 14(*b*), a subinterval has been shifted from block $B_{i1}$ to block $B_{i2}$. With this arrangement, liquid level $2V_0$ may be printed as illustrated by the coding [10000] illustrated in FIG. 14(*c*). The shifted block arrangement illustrated in FIG. 14(*b*) allows levels 2, 5, 6, 8, 9, 11, 12, and 15 $V_0$ to be printed. Note that once a block of two subintervals is created, then it must always be coded "1" to print since it cannot be formed into a drop large enough to differentiate and gutter reliably.

In FIG. 14(*d*), two subintervals from a block have been shifted to other blocks. In the example, two subintervals from block $B_{i1}$ have been shifted to enlarge blocks $B_{i2}$ and $B_{i3}$. It may be appreciated that the subintervals shifted from block $B_{i1}$ could have been shifted to the same block, enlarging it to have five subintervals instead of forming two blocks with four subintervals. FIG. 14(*e*) illustrates that with this block configuration, liquid level $1V_0$ may be printed by specifying the coding [10000]. The shifted block arrangement in FIG. 14(*d*) allows liquid levels 1, 4, 5, 7, 8, 9, 11, 12 and 15 $V_0$. Level 10 $V_0$ may be provided if a block of five subintervals is formed instead of two, four-subinterval blocks as illustrated. Block $B_{i1}$ having a single subinterval, must always be coded "1" to print since a non-print drop could not be formed from this small block.

Allowing the variable formation of subinterval blocks according to the input image data as illustrated allows most of the liquid levels that are associated with N subintervals to be printed. However, because of the minimum size requirement for non-print drops, M, levels N−1, N−2, . . . , N−M+1, still cannot be formed.

Different orders of the variable-sized blocks illustrated in FIGS. 14(*b*) and 14(*d*) can be imagined. Different arrangements of these blocks may produce intermediate density levels and may be useful in shaping the liquid printed with an output pixel area as discussed previously. It is anticipated by the inventors of the present invention that variable unequal subinterval block methods may be implemented wherein the shifting of subintervals among blocks is always performed in the same manner, independent of image data, varies in a predetermined way in time or along different scanlines or both, or is changed for each output image pixel in a fashion that provides the best replication of the input pixel image information.

The first variation, for example, could be implemented by always shifting zero, one or two subintervals from block $B_{i1}$ to block $B_{i2}$. The block arrangement could then be specified by a two bit word, and the blocks themselves coded as a five bit word labeling the five blocks as print "1" or non-print "0". The second variation could be implemented, for example, by cyclically moving the pair of changeable blocks along the set of five blocks in a predetermined fashion and then using a two bit code to keep track of how many subintervals are shifted. The third variation could be implemented, for example, using look up tables in choosing the block shifting pair choices based on input image data. Any block from which a subinterval was shifted would be automatically coded as a print block.

The example of a variable unequal subinterval block method depicted in FIGS. 14(*a*) through 14(*e*) started with a set of blocks having equal subintervals. The inventors of the present invention also contemplate that the starting point block arrangement may alternatively be a set of unequal blocks such as the four block arrangement illustrated in FIGS. 13(*a*) and 13(*b*). Subintervals may then be shifted out of blocks to create smaller blocks that allow the printing of the previously inaccessible levels that are less than M, i.e., 1, 2, . . . , M−1. As discussed previously, additional coding may be required to specify block size and order and shifting of subintervals, and to assure that any subinterval blocks having less than M subintervals are always coded "1" to print.

In similar fashion to the previous methods, the variable unequal subinterval methods allow the printing of some levels of printed liquid to be applied in different time orders, hence amounts of overlap and position within an output pixel area, by shifting the order of blocks. Also, in similar fashion, an error diffusion procedure may be combined with the fixed unequal block method to ameliorate the errors that are generated, especially because some levels of liquid application are still not accessible.

The drop forming pulse sequence for each time interval $I_i$ is finally composed in similar fashion for all of the subinterval block methods discussed above, namely, drop forming pulses are provided between all blocks and within all blocks coded "1" to print.

IV. Added Variable Subinterval Block Methods

A fourth set of embodiments of the methods of the present invention may be termed added variable subinterval block methods. These embodiments are similar to the variable unequal subinterval block methods discussed above except that an additional block having at least M subintervals is added to the N subintervals associated with each time interval $I_i$ or output pixel area. All of the N+M subintervals are not intended to be available for printing. The maximum optical density or liquid amount printed at an output pixel area is still intended to be $NV_0$. The additional block of M subintervals is added to provide drop pattern opportunities than can provide the levels N−1, N−2, . . . , N−M+1 that are not accessible using the previously discussed embodiments.

An example of an added variable subinterval block method is illustrated in FIGS. 15(*a*) through 15(*e*). In FIG. 15(*a*), time interval $I_i$ 33, is allocated eighteen subintervals 34 organized into six blocks $B_{ik}$, k=1 to 6, of three subintervals 34. It is intended that at least one block will always be coded "0" for non-print. Thus the arrangement of blocks in FIG. 15(*a*) would provide for the printing of liquid levels 0, 3, 6, 9, 12, and 15 $V_0$ in similar fashion to the fixed equal block methods previously discussed, by always coding at least one block as "0", non-print. However, subinterval shifting from one block to another is allowed in the added variable subinterval block methods in similar fashion to the previously discussed variable unequal subinterval block methods, illustrated in FIGS. 14(*a*) through 14(*e*).

In FIG. 15(*b*), one subinterval has been shifted from block $B_{i5}$ to block $B_{i6}$. Block $B_{i5}$ must now always be coded "1" to print since it does not include enough subintervals to form a non-print drop. FIG. 15(*c*) illustrates printing liquid level 14 $V_0$ by coding the six blocks [111110]. FIG. 15(*d*) illustrates the shifting of two subintervals from block $B_{i5}$ to block $B_{i6}$. FIG. 15(*e*) illustrates printing liquid level 13 $V_0$ using the resulting block arrangement coded as [111110].

The added variable subinterval block methods illustrated in FIGS. 15(*a*) through 15(*e*) allow printing all sixteen liquid levels (0 through 15 $V_0$) by shifting one or two subintervals from one block to another block, always coding at least one block as a non-print block and always coding blocks from which subintervals have been shifted as print blocks. In analogous fashion to the variable unequal subinterval block methods, variations on how the subinterval shifting is done and coded are envisioned by the inventors of the present invention. The same opportunities to shift the centroid and shape of the liquid applied to each pixel area are also available. Because, however, the added variable subinterval block methods can provide a full set of liquid levels between 0 and $NV_0$, the additional application of error diffusion procedures may not be needed. However, error diffusion techniques may still be useful in achieving an additional fineness of grayscale by guiding the selection of alternate choices of same-number print drop patterns in midtone image areas by varying the amount and character of print drop overlap within a pixel area.

The added variable subinterval block methods have one disadvantage with respect to the previously discussed small drop printing methods in that they result in lower net printing duty cycles. That is, at least N+M subintervals of liquid emission are allocated to each time interval, however only N subintervals are ever printed. Therefore, the maximum "duty cycle" of printing is N/(N+M) in terms of the movement of the working liquid through the printhead. For N=15 and M=3, the maximum duty cycle is 83%. However, the opportunity to avoid using error diffusion processing, over and above the small drop printing method processing itself, may be enough of a simplification of the overall printing system to justify this reduction in peak efficiency.

V. Individual Subinterval Methods

A fifth set of embodiments of the present invention may be termed individual subinterval methods. Individual subinterval methods collapse the previously discussed concept of blocks of subintervals within the time interval, $I_i$, associated with an output pixel area, into one. A number of subintervals are associated with each time interval, $I_i$, thereby providing the opportunity to vary the amount of liquid printed at each pixel area by manipulating which individual subintervals are given leading and trailing drop forming pulses and which are not. Typically it is expected that a small number of subintervals, preferably on the order of M subintervals, the minimum that may be formed as a non-print drop, will be associated with each time interval. An overriding rule is that subintervals that are coded to form non-print drops must be clustered into consecutive sequences of at least M subintervals in order that the non-print liquid may be differentiated from print drops by the gas flow deflection apparatus and captured by the guttering apparatus. Methods of ensuring that non-print subintervals are so clustered will be termed "applying" or "using" a "non-print drop rule". It will be explained hereinbelow that a non-print drop rule may be applied in a variety of fashions.

Figure 16:
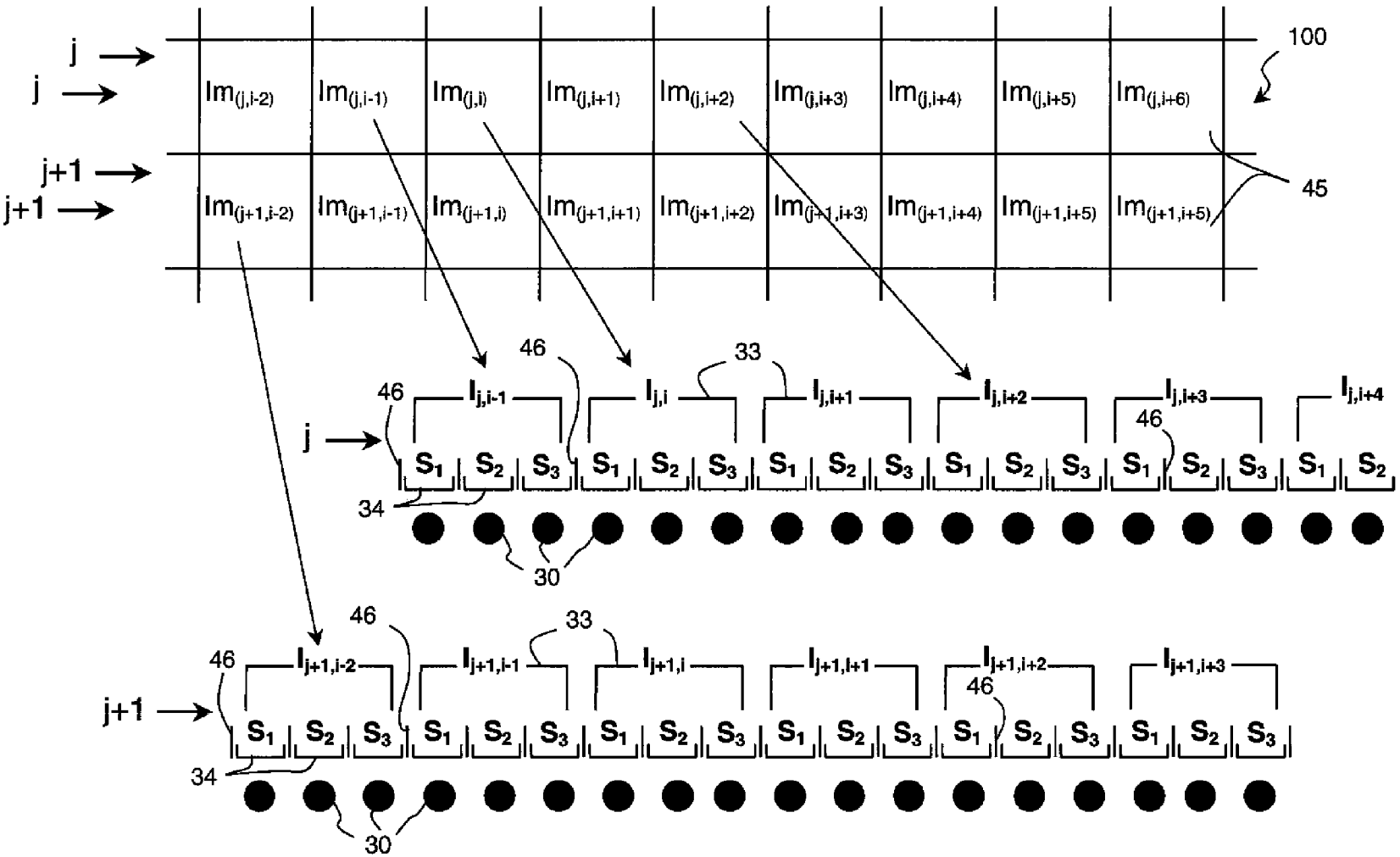
FIG. 16 illustrates an alternative embodiment of relating time subintervals to image input pixel data of use in directing the formation of print and non-print drops according to the present invention.
Figure 17:
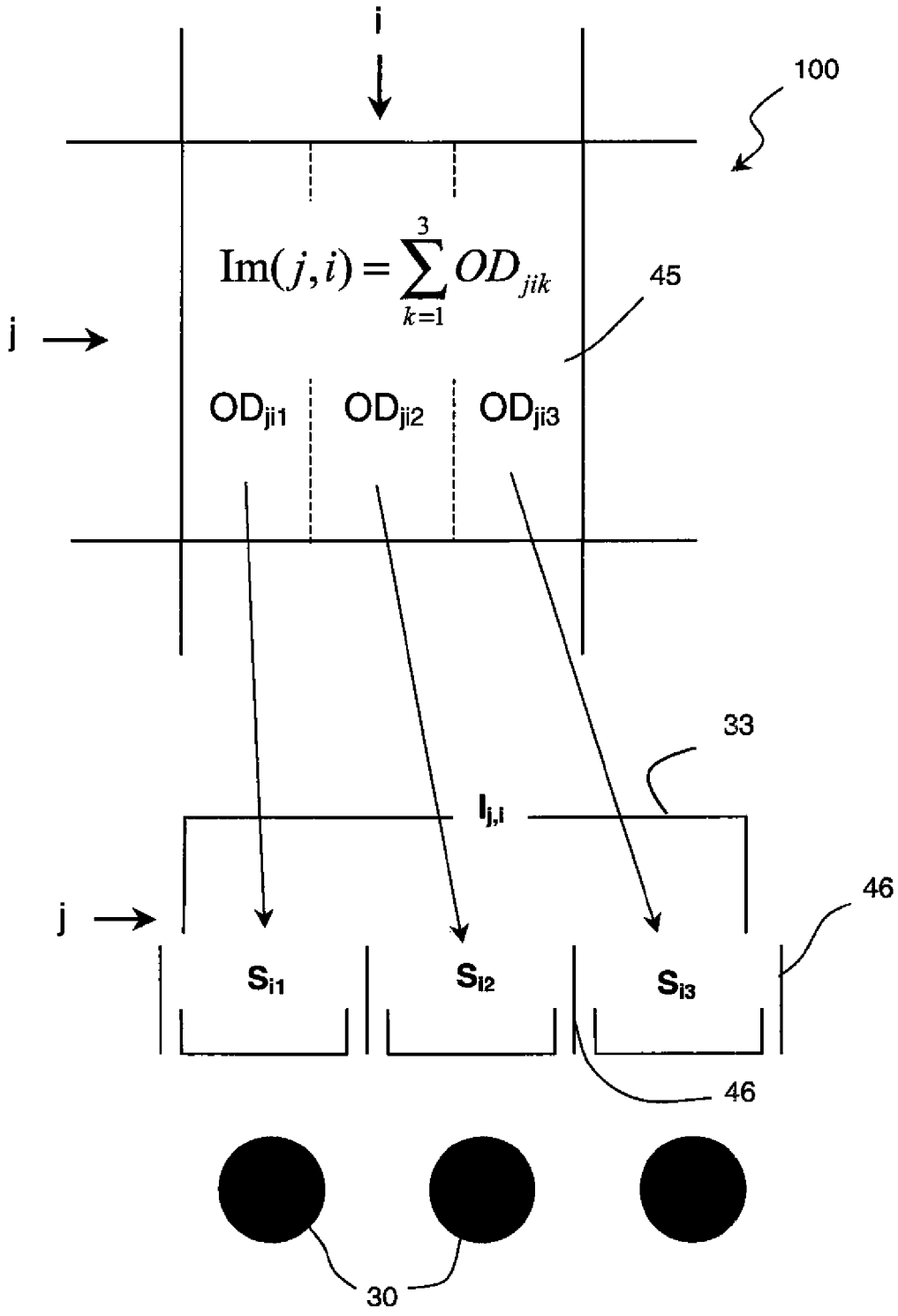
FIG. 17 illustrates certain features of the embodiment illustrated in FIG. 16 in more detail.

Examples of individual subinterval methods will be explained with reference to FIGS. 16 through 28. FIGS. 16 and 17 illustrate the relationships among image input pixel information 45 and the time intervals $I_i$ 33, and time subintervals 34, $S_{ik}$, associated with each time interval 33. As for the previously discussed small drop printing methods, the ultimate outputs of individual subinterval methods are drop forming pulse sequences that are applied to the "j" drop stimulation transducers to cause the formation of small print drops of volume $V_0$ or large non-print drops having volumes at least $MV_0$. In the example of FIG. 16, each input image pixel area $Im_{ji}$ is associated with a time interval "i" for applying stimulation energy to the fluid of a given jet "j". In the example given in FIG. 16, there are three subintervals 34 ($S_1$, $S_2$ and $S_3$) associated with each time interval 33. The fluid that is emitted during each subinterval 34 is illustrated as filled circle 30 and represents the volume, $V_0$, of a small print drop 40 that might be formed during any appropriate subinterval.

Drop forming pulses 46 are indicated between every subinterval in FIGS. 16 and 17. For the purposes of understanding the individual subinterval methods, the distinction between drop forming pulses applied between blocks and those applied within blocks is not illuminating and will not be used. Individual subinterval methods will result in ultimate drop forming pulse sequences that do not conform to either a block structure or to the time interval template. Individual subinterval methods are implemented by initially coding every subinterval as a binary "1" for a "print" or "0" for a non-print subinterval based on the image or liquid pattern input data. After the initial image-based coding, two other printing rules are applied that ensure that non-print drops are formed having volumes that are not too small for the deflection system to differentiate nor too large as to be unreliable during drop capture and guttering. An error diffusion process may be applied at different stages to ameliorate errors caused by the binary image coding and the application of the non-print drop rule or printing constraint rule.

FIG. 17 illustrates one input image pixel, Im(j,i), that is associated with one time interval, $I_{ji}$, for which it is desired to construct a drop forming pulse sequence that causes the best drop formation to occur to print the corresponding output image pixel Om(j,i) (not shown). The time interval $I_{ji}$ is the $i^{th}$ time interval for the $j^{th}$ jet, and consists of three subintervals, $S_{ik}$, k=1 to 3, in this example. The individual subinterval method requires that image input data be assigned to every time subinterval, $S_{jik}$, for use in making the print, non-print coding decision. This is illustrated in FIG. 17 by dividing image pixel Im(j,i) into three regions each having an optical density $OD_{jik}$, k=1 to 3.

Depending on the pixel density (resolution) of the input and output images, the input image data may have to be "expanded" to provide input image data that can be associated with every subinterval time. For example, individual time intervals 33 may be associated with output pixels corresponding to 1200 pixels/inch (dpi). The three subintervals 34 associated with each time interval 33 illustrated in FIG. 17 are then provided in order to allow the output image to be printed at one of four gray or liquid levels (0, $V_0$, $2V_0$ or $3V_0$) at the 1200 dpi resolution, potentially yielding very high image quality. However the input image data may be available only as a single gray level or optical density value, $OD_{ji}$, at 1200 pixels/inch. A straightforward procedure to "expand" this data into three values, one for each subinterval $S_{jik}$, is to simply divide the single value by three so that $OD_{jik}=OD_{ji}/3$ for k=1 to 3. Alternatively, more sophisticated image processing methods may be employed to expand the image input data that recognize edges, font curves, periodic image artifacts and the like, if needed.

The individual subinterval methods are carried out by forming input image data, Im(j, i, k) to associate with every time subinterval of every jet, i.e. every $S_{jik}$. Then a comparison will be made between the input image value for that subinterval and the expected optical density or liquid deposition result of printing fluid in that subinterval. A representative comparative value is assigned to the consequence of printing or non-printing the fluid emitted during each subinterval. For example, if three subintervals per time interval allow printing three print drops on every output image pixel location, $Om_{ji}$, resulting in the maximum optical density, $OD_{max}$, or the maximum liquid layer thickness, $h_{max}$, then the printing of one print drop associated with one subinterval can be assigned an output value, $Om_{jik}=OD_{max}/3$ or $h_{max}/3$. Further, expressing optical density in terms of some typical scheme of quantized levels, for example an eight bit word, or 0 to 255 levels in base 10, the quantized image value of a single print drop could be expresses as $Om_{jik}=85$ (of 255) for print, and $Om_{jik}=0$ for non-print.

The input image data is organized so that the data for the $j^{th}$ output image scanline is associated with the $j^{th}$ jet. To form a preferred sequence of drop forming pulses to apply to each jet, the input/output image comparison is made by stepping along the subintervals in time (earliest to latest) and comparing to the appropriate expanded input pixel data for each time interval. That is, the method steps to a time interval, "$I_i$", and first subinterval, $S_{i1}$, up to the $k^{th}$ subinterval, $S_{ik}$, and then to the $(i+1)^{th}$ time interval and so on. Alternatively, the time interval index "i" and the subinterval index "k" may be replaced with a single index "s" that advances through all of the subintervals of time that fluid is emitted by a jet "j", i.e. $S_{jik}=S_{js}$, $Im_{jik}=Im_{js}$, and $Om_{jik}=Om_{js}$, where $s=N(i-1)+k$ and N equals the number of subintervals associated with a time interval, 3 in the examples of FIGS. 16-28. In this formulation, "i" ranges from 1 to $N_x$, the number of image pixels in the x-direction (the process or fast scan direction in FIG. 5) and "s" ranges from 1 to $NN_x$, the total number of time subintervals during the image print time.

The index "j" ranges from 1 to $N_y$, the total number of pixels in the y-direction (the nozzle array or slow scan direction in FIG. 5). Because the example illustrated in FIG. 1, and being discussed herein, is for a pagewide printhead and a single pass imaging system, the output image scanlines correspond to a particular jet and to a particular input image scanline. Therefore the index "j" applies in the same manner to all three ensembles. However, the methods of the present invention may also be used in conjunction with a multi-pass imaging system wherein the output image is formed by overlaying the printing of a printhead during multiple passes. In this situation the index "j" is associated with each jet during each of the multiple passes. The input image data, therefore, must be organized so as to provide an appropriate input image value to use for the print/non-print decision for each subinterval. For multi-pass imaging modes wherein the output image is built up from several low duty cycle print passes, this may mean that the input image data used for each pass has many "zeros" inserted. The methods of the present invention are directly applicable to multi-pass printing systems as explained herein by preparing an image input data file Im(j,i) for each pass of the printhead that includes the portion of the final image that is to be printed on that pass together with "zeros" for portions that are not to be printed on that pass.

The individual subinterval methods operate at the subinterval level in a similar, though not identical, fashion to a binary printing process. As will be explained herein below, the necessary provision that non-print drops be formed from a minimum number of subintervals, M, will introduce unique differences in the image processing procedures of the present invention that are not found in prior art binary printing process algorithms. Nonetheless, in the first instance, each subinterval must be coded or labeled "1" to print or "0" to non-print. Thus all grayscale renditions must be provided by the manner in which groups of neighboring pixels are coded. The many digital halftoning techniques that are well known in the digital imaging art are therefore useful and applicable in making an initial print/non-print decision for each subinterval. A quantized input image value $Im_{js}$ is associated with each time subinterval $S_{js}$. The quantized binary output image result of causing the fluid in that subinterval to be printed or not printed is $Om_{js}$=[1 or 0] wherein "1" is assigned some representative comparative value based on the input image data format.

Well known digital image processing methods may be invoked to choose whether coding a subinterval "1" or "0" will best represent the input image. For the example of three subintervals per time interval discussed above, the comparative values of printing or non-printing a subinterval of liquid may be assigned the values of level 85, or 0, respectively; $Om_{js}$[1, 0]=[85, 0], wherein the output optical density is quantized into 256 levels such that $OD_{max}$=255 and $OD_{min}$=0. Then, a simple threshold decision to print or non-print may be logically carried out as expressed in Equation 1:

$$\text{if } Im_{js} \geqq 85/2 = 42.5, \text{ then } Om_{js} = 85, \text{ else, } Om_{js} = 0. \quad (1)$$

Here the "threshold" value was chosen as 42.5, the "average" density space value of a printed and non-printed subinterval of liquid. Other methods of making the "print/non-print" decision that utilize periodic or pseudo-random screens may also be followed. These methods essentially change the threshold value used for the comparison in a periodic or other non-image dependent fashion that is known to produce pleasing output image results when applied to a binary pixel marking process.

Figure 18:
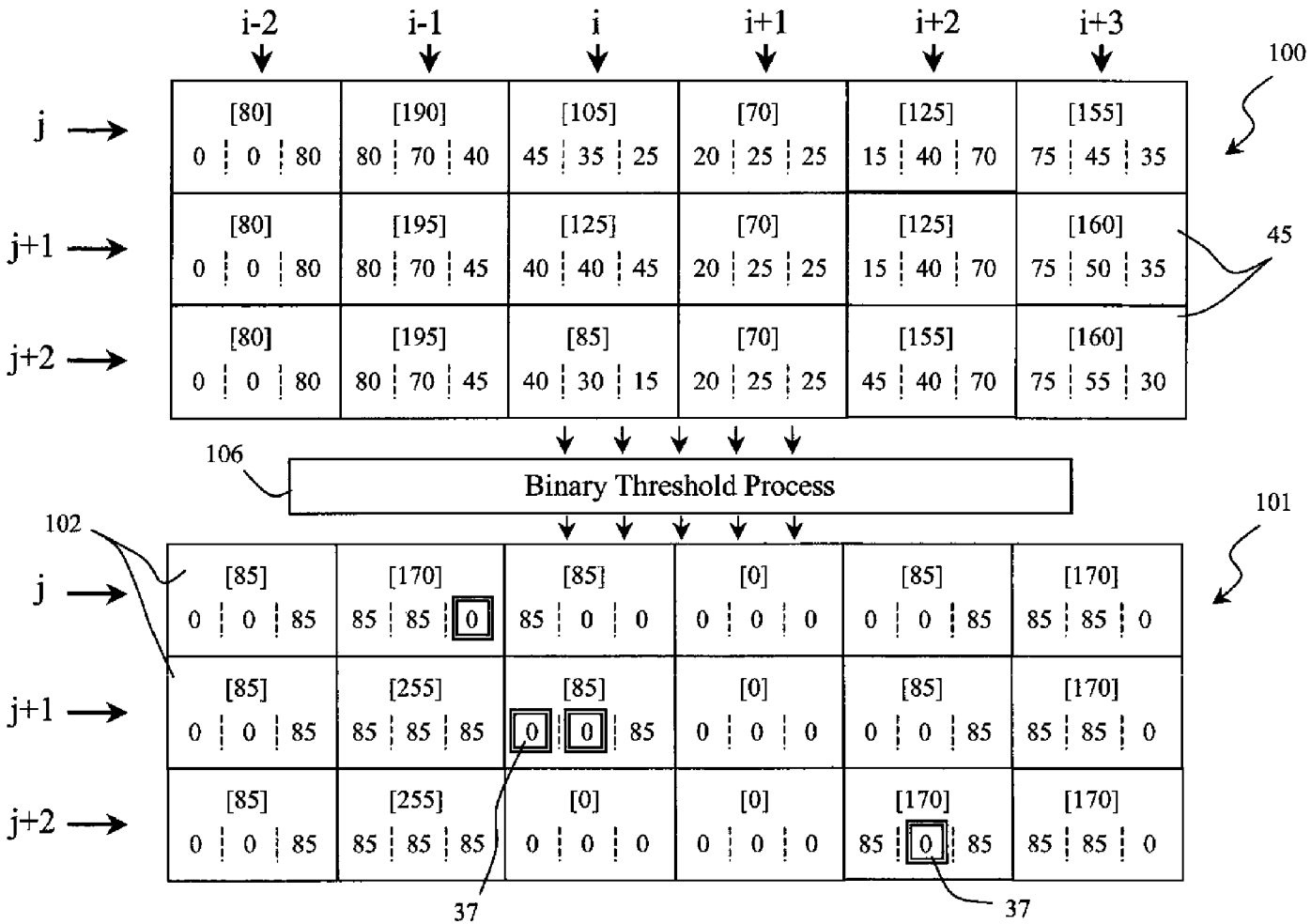
FIG. 18 illustrates the partial application of the embodiment of the present invention illustrated in FIGS. 16 and 17 including a binary threshold image processing procedure.

In FIG. 18, a 3 by 6 array of image input pixels 45, a portion of an input image 100, is schematically illustrated. The input image is specified in quantized density number space wherein $D_{max}$=255 and $D_{min}$=0. The number in square brackets in each input pixel area 45 is the total density value for that input image pixel. For example the quantized optical density of the $ji_{th}$ image input pixel is $Im_{ji}$=105. The total input pixel image density has been "expanded" to provide three values, $Im_{jik}$, k=1 to 3, to associate with three subintervals, $S_{jik}$, k=1 to 3. These expanded input pixel density values are displayed as a row of three values separated by a dashed vertical line. The expanded input pixel optical density values sum to the square bracketed quantized optical density of the input pixel area. For this example image, the image input data was rich enough to generate three individual input image values for each subinterval within each pixel, rather than using an average value for all three subintervals. For the $ji_{th}$ pixel of the input image 100, the subinterval values are as follows: $Im_{ji1}$=45, $Im_{ji2}$=35 and $Im_{ji3}$=25.

An intermediate output pixel image 101 is generated by following a constant value threshold decision as expressed above in Equation 1. The term "intermediate" is used here because, as will be described herein below, the output image produced by traditional binary image processing has not been subjected to a non-print drop rule and so is not a "final" output image. The constant threshold value used was 42.5, the average value of a printed and non-printed subinterval of liquid, wherein it is assumed that quantized $OD_{max}$=255 and is provided by three printed subintervals of liquid per intermediate output pixel area 102, and quantized $OD_{min}$=0 and results when no subintervals of fluid are printed in an intermediate output pixel area 102. The output image is schematically illustrated using the same conventions as was described for the input image 100. The total optical density for each intermediate output image pixel 102 is shown in brackets and the optical density associated with each subinterval is shown as a lower row of values separated by doffed vertical lines. The output image subinterval values are all either quantized density levels 85 or 0, $Om_{jik}$=[85 or 0], illustrating the binary nature of the output image data file.

The output pixel area 102 values illustrated in the lower half of FIG. 18 are termed "intermediate" because the application of a standard thresholding and error diffusion method does not account for the non-print drop volume rule requiring that non-print drops must be at least some minimum multiple, M, of the small drop volume, in our example M=3. Certain "results" of the thresholding yield isolated or "orphan" subintervals 37 coded as "0" or non-print liquid subintervals. These orphan subintervals 37 are indicated in FIG. 18 with double line boxes. In the present discussion, "orphan subintervals" or "orphan sequences" of subintervals are single isolated non-print subintervals, or a succession of less than the minimum number, M, of non-print subintervals.

Figure 19:
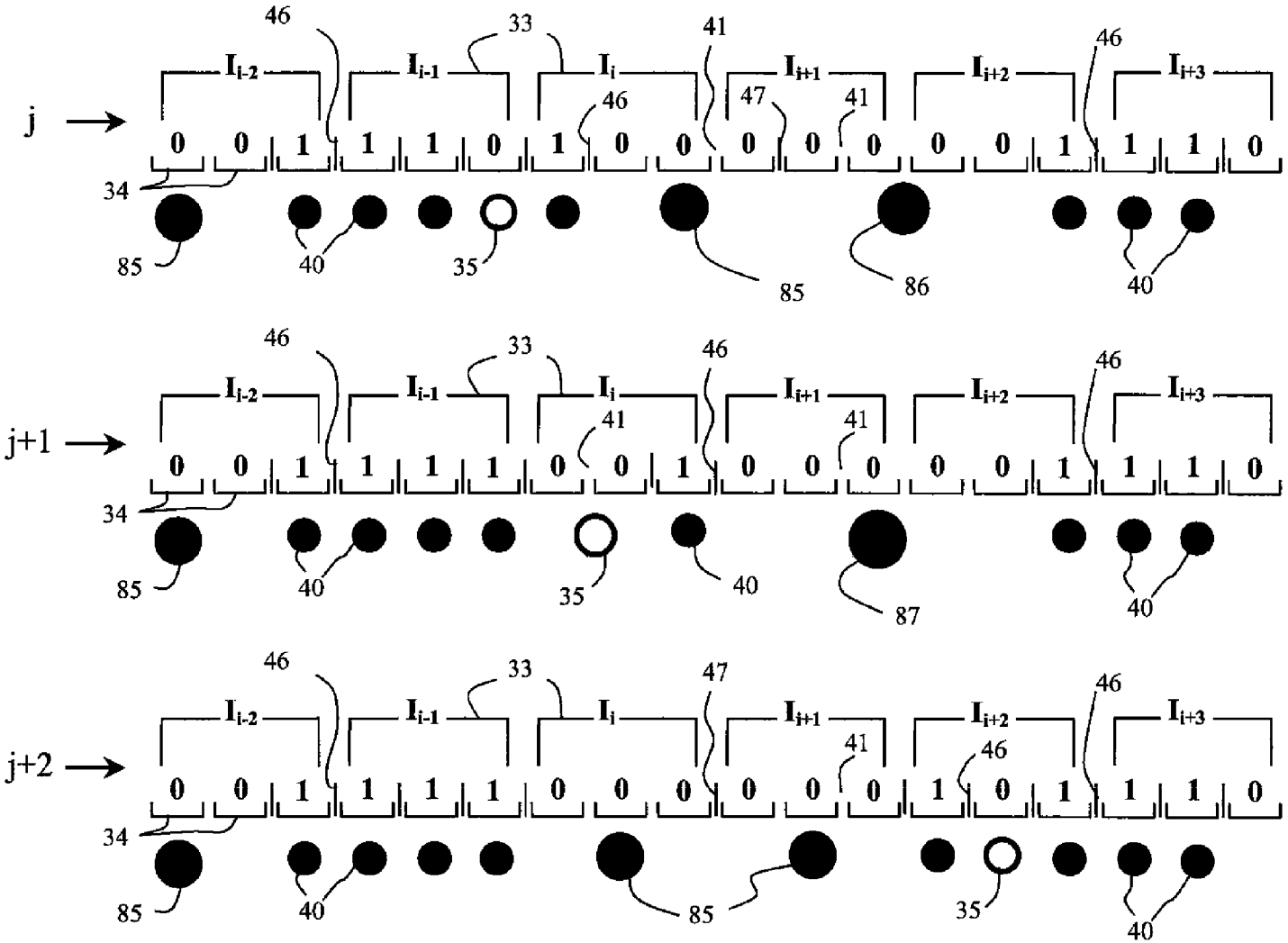
FIG. 19 illustrates the formation of print, non-print and undersized non-print drops that would result from the procedure illustrated in FIG. 18.

FIG. 19 illustrates schematically the same intermediate output pixel print/non-print decision information in the form of a time interval diagram for the $j^{th}$, $(j+1)^{th}$ and $(j+2)^{th}$ jets. This illustration assumes that the subinterval immediately preceding those shown was coded "0" for all three jets. Print and non-print drops are formed by causing drop forming pulses at the lead and trail ends of every subinterval coded "1" and by omitting drop forming pulses 41 between subintervals coded "0" unless the sequence of "0" coded subintervals would combine to form too large a non-print drop for guttering reliability. The addition of a rule for maximum numbers of consecutive "0" subintervals, without inserting an intervening drop forming pulse, will be discussed hereinbelow. Drop forming pulses 47 illustrated in FIG. 19 were added according to such a "maximum non-print drop rule".

The "0" subintervals highlighted with double line boxes in FIG. 18 are illustrated as hollow circles in FIG. 19. The halftone thresholding procedure resulted in some single non-print subintervals sandwiched among print subintervals, some orphan non-print subintervals. The portions of fluid emitted during these subintervals cannot be properly differentiated from the print drops and captured in the gutter apparatus. If the jet stimulation heaters for jets j, j+1 and j+2 were pulsed in the sequence illustrated in FIG. 19, the open circle fluid portions 35 would print as extra, undesirable print drops.

The problem of extraneous print drops illustrated by FIGS. 18 and 19 may be rectified by applying a "non-print drop rule", or "constraint rule", before the print/non-print labeling is finalized. In other words orphan subintervals and orphan subinterval sequences may be avoided or corrected by applying a constraint rule either after the application of the binary threshold algorithm to the entire image (to all subintervals) or by sequentially applying the constraint rule to groups of subintervals to which the binary threshold algorithm has been applied. Essentially the non-print drop rule introduces a new logical test that may override the binary image process threshold test. As was stated before in the discussion of Equation 1, the binary image process may be a simple comparison to a fixed threshold gray scale value, comparison to a periodically changing set of thresholds (a screen), or a more sophisticated binary image processing algorithm. Whatever binary process is chosen, its application results in the decision to code a subinterval either print or non-print, "1" or "0".

To generalize, the binary image processing logical test may be expressed as Equation 2:

$$\text{if } Im_{js} \geqq (\text{test threshold}), \text{ then } Om_{js}' = 1, \text{ else } Om_{js}' = 0. \quad (2)$$

The output image subinterval values $Om_{js}'$ are given a prime symbol to denote that these are not yet final output image values. As was explained previously, some of the $Om_{js}'=0$ values cannot be supported by the non-print drop differentiation and guttering apparatus. Therefore, a non-print drop rule (logical test) is applied to the $Om_{js}'$ values to arrive at "final" $Om_{js}$ values. The purpose of this test is to disallow some of the $Om_{js}'$ results that lead to "orphan" non-print subintervals, i.e. to extraneous print drops. For the remaining discussion the index "s"=N(i−1)+k will be used for convenience. N is the number of subintervals, k, allocated for each pixel area, i.

There may be many approaches to forming a non-print drop rule or procedure (constraint rule) that accomplishes the purposes stated. The inventors of the present invention envision that, in processing an image, a non-print drop rule or constraint rule may be applied in several distinct ways, categorized as (1) post process, (2) iterative, and (3) "on-the-fly". In particular, for the case of application of a constraint rule after binarization of the input image data, the inventors envision that the constraint rule may be applied: (1) as a post-process to binarization of the entire image, meaning that a constraint rule is applied after all subintervals have been processed by a binary processing algorithm; (2) iteratively after binarization of portions of the image, meaning that the constraint rule is applied after each member of groups of consecutive subintervals has been processed by a binary threshold processing algorithm; or (3) "on-the-fly" in conjunction with binarization, meaning that the constraint rule is applied consecutively to each output image subinterval in turn, as a supplemental test to a binary imaging threshold test. The first part, binarization, of this process has been described in association with FIGS. 18 and 19. Application of a constraint rule after binarization in accordance with the several distinct ways above is discussed in association with FIGS. 20 through 26.

In order to utilize a non-print drop rule or to apply its constraint, one must be able to identify an "orphan" subinterval in the intermediate, binarized image data. One calculation method that will identify orphan non-print subintervals used by the inventors of the present invention is to calculate an orphan sub-interval matrix, $Or_{js}$, which identifies every orphan subinterval in the intermediate output image data $Om_{js}'$ by a logic value "1" and all other subintervals by logic value "0". For example, $Or_{js}$ may be constructed as described by Equations 3 and 4:

$$\text{If } Om_{js}' = 1, \text{ then } Or_{js} = 0. \quad (3)$$

$$\text{If } Om_{js}' = 0, \text{ and, then } Or_{js} = 0, \text{ else } Or_{js} = 1. \quad (4)$$

The complex expression in Equation 4 is merely a product of the sums of all the $Om_{js}'$ values in sequences of subintervals that are M subintervals in length that include the subinterval $S_{js}$. If any sequence of M subintervals including subinterval $S_{js}$ contains only $Om_{js}'$ values of zero (non-print), then the $js^{th}$ subinterval is not an orphan non-print subinterval, rather it is a proper non-print subinterval. For the example case of M=3, Equation 4 simplifies to the following Equation 5:

$$\text{If } Om_{js}' = 0, \text{ and, then } Or_{js} = 0, \text{ else } Or_{js} = 1. \quad (5)$$

Application of Equations 3 and 4 or 5 result in an orphan subinterval matrix, $Or_{js}$, which has a value of 1 (one) for orphan subintervals and 0 (zero) for all other subintervals.

Alternatively to forming an orphan subinterval matrix, $Or_{js}$, Equations 3-5 may be used to simply determine for any subinterval in the intermediate image $Om_{js}'$, whether or not it is an orphan subinterval. Used in this fashion, Equations 3-5 may be used to support an "on-the-fly" or sequential application of a non-print drop rule by testing each subinterval image value, $Om_{js}'$, as it is generated in sequence, for example by the threshold process of Equation 1 or 2, and then immediately altering the output image values for detected orphan subintervals before proceeding to process the next output image value.

Figure 20:
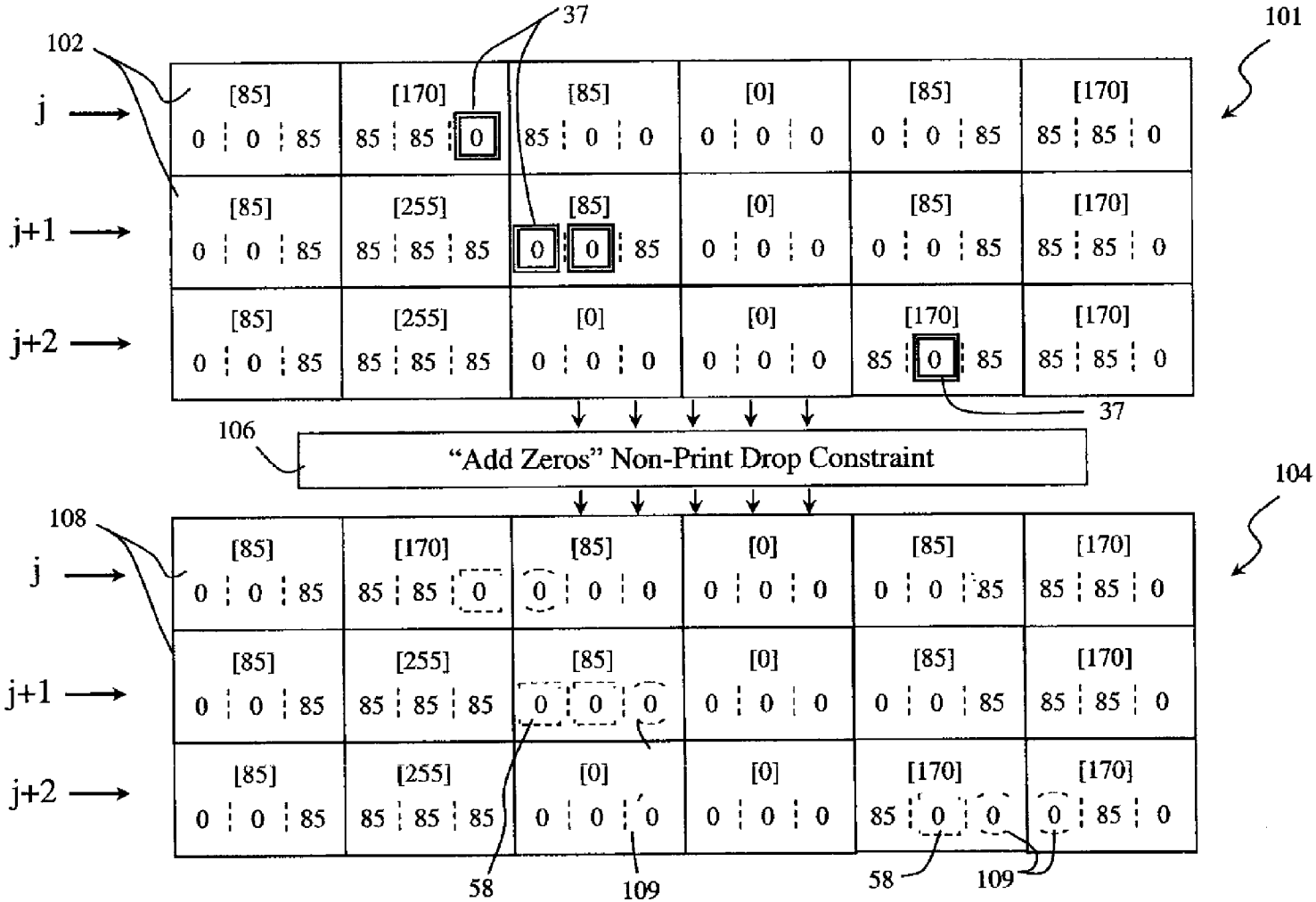
FIG. 20 illustrates the use of an "add zeros" non-print drop rule to eliminate undersized non-print drops that have resulted from the procedure illustrated in FIG. 18.

A first example application of a non-print drop rule after binarization of the image data is illustrated in FIG. 20. In this example, the constraint rule is very simple and is termed an "add zeros" constraint rule. In FIG. 20, the intermediate output image values 101 $Om_{js}'$ for the $j^{th}$ jet or image scanline illustrated in FIG. 18 have been redrawn. Index s=3(i−1)+k in the examples of FIGS. 16-33, since N=3. An "add zeros" constraint rule is then used to construct final output image values 108 $Om_{js}$ recorded in the lower matrix 104 of FIG. 20.

The illustrated example "add zeros" constraint acts sequentially on all isolated orphan drops or on the first orphan drop of an orphan subinterval series by requiring the next M−1 subinterval output data values to be zeros after an orphan subinterval is found. An orphan subinterval series comprises a consecutive series of orphan drops of less than M subintervals in length. In the final image data matrix 104 illustrated in FIG. 20, the changed subintervals 109 are indicated by dashed circles. The "repaired" orphan subintervals 58 are indicated by dashed squares. This constraint rule, while reducing the printed ink density or volume somewhat, prevents the production of non-printing drops of incorrect size that are too small to reliably not print. A maximum non-print drop size is considered hereinbelow in conjunction with all individual subinterval methods envisioned by the present invention.

The example "add zeros" algorithm can be applied rapidly "on-the-fly" subinterval by subinterval, without knowledge of the result of its application to subintervals not yet processed. The result of the application of the "add zeros" rule after binarization is easily seen to be invariant to selection of the above several distinct ways (post-process, interval, or "on-the-fly") of applying the algorithm, meaning the same output image is obtained in all cases. However, this invariance is not a necessary requirement for constraint algorithms according to the present invention.

Figure 21:
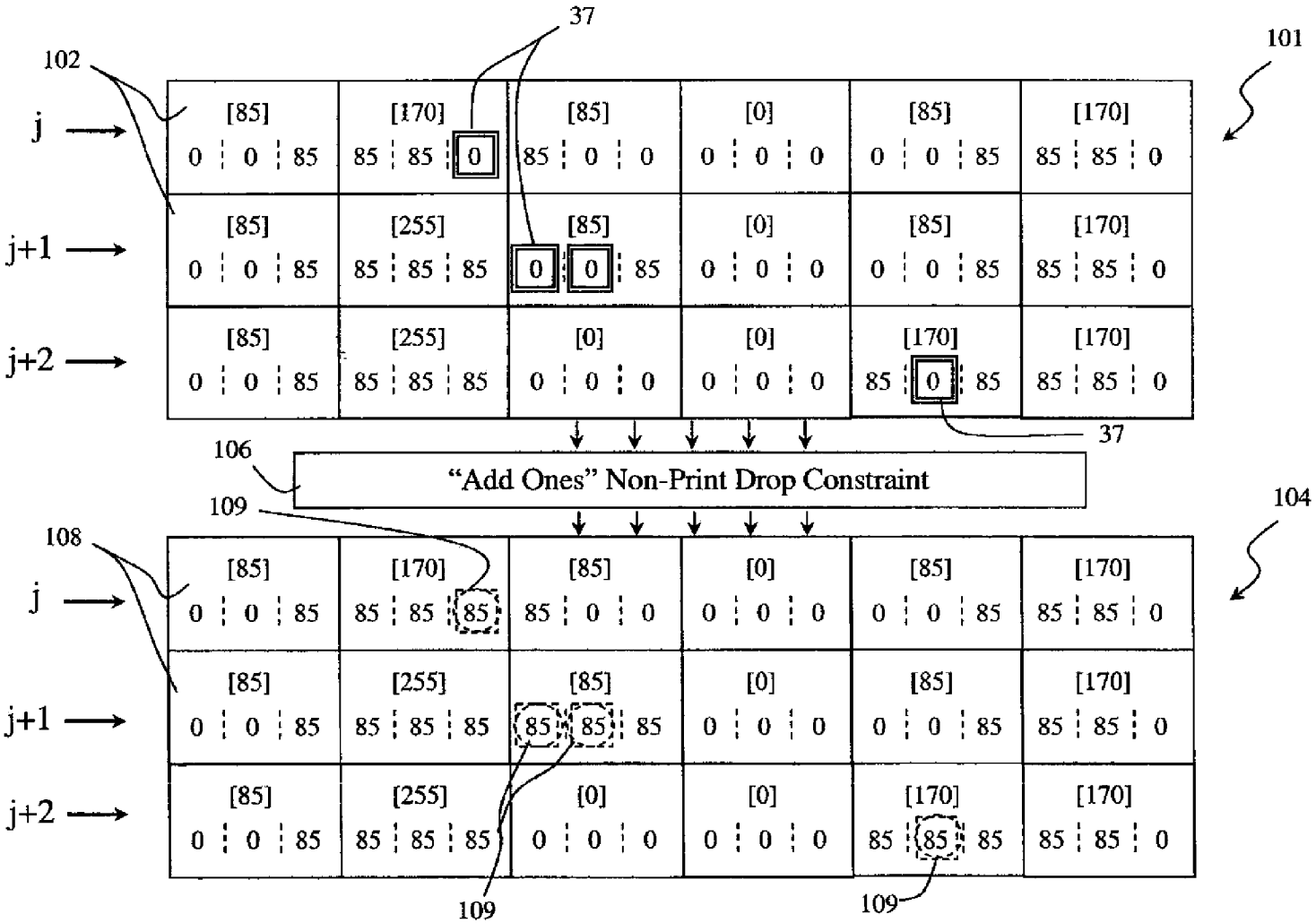
FIG. 21 illustrates the use of an "add ones" non-print drop rule to eliminate undersized non-print drops that have resulted from the procedure illustrated in FIG. 18.

A second example application of a non-print drop rule after binarization of the image data is illustrated in FIG. 21. In this example, the constraint rule is also very simple and is termed an "add ones" constraint rule. In FIG. 21, the intermediate output image values 101 $Om_{js}'$ for the $j^{th}$ jet or image scanline illustrated in FIG. 18 have been redrawn. An "add ones" constraint rule is then used to construct final output image values 108 $Om_{js}$ recorded in the lower matrix 104 of FIG. 21. The illustrated example "add ones" constraint algorithm acts by changing any orphan subinterval into a "1", or print, subinterval. In the final image data matrix 104 illustrated in FIG. 21, the changed subintervals 109 are indicated by dashed circles. The "repaired" orphan subintervals 58 are indicated by dashed squares.

This constraint rule, while increasing the printed ink density or volume, prevents the production of non-printing drops of incorrect size that are too small to reliably not print. The example "add ones" algorithm can be applied rapidly "on-the-fly" subinterval by subinterval, without knowledge of the result of its application to subintervals not yet processed.

Figure 22:
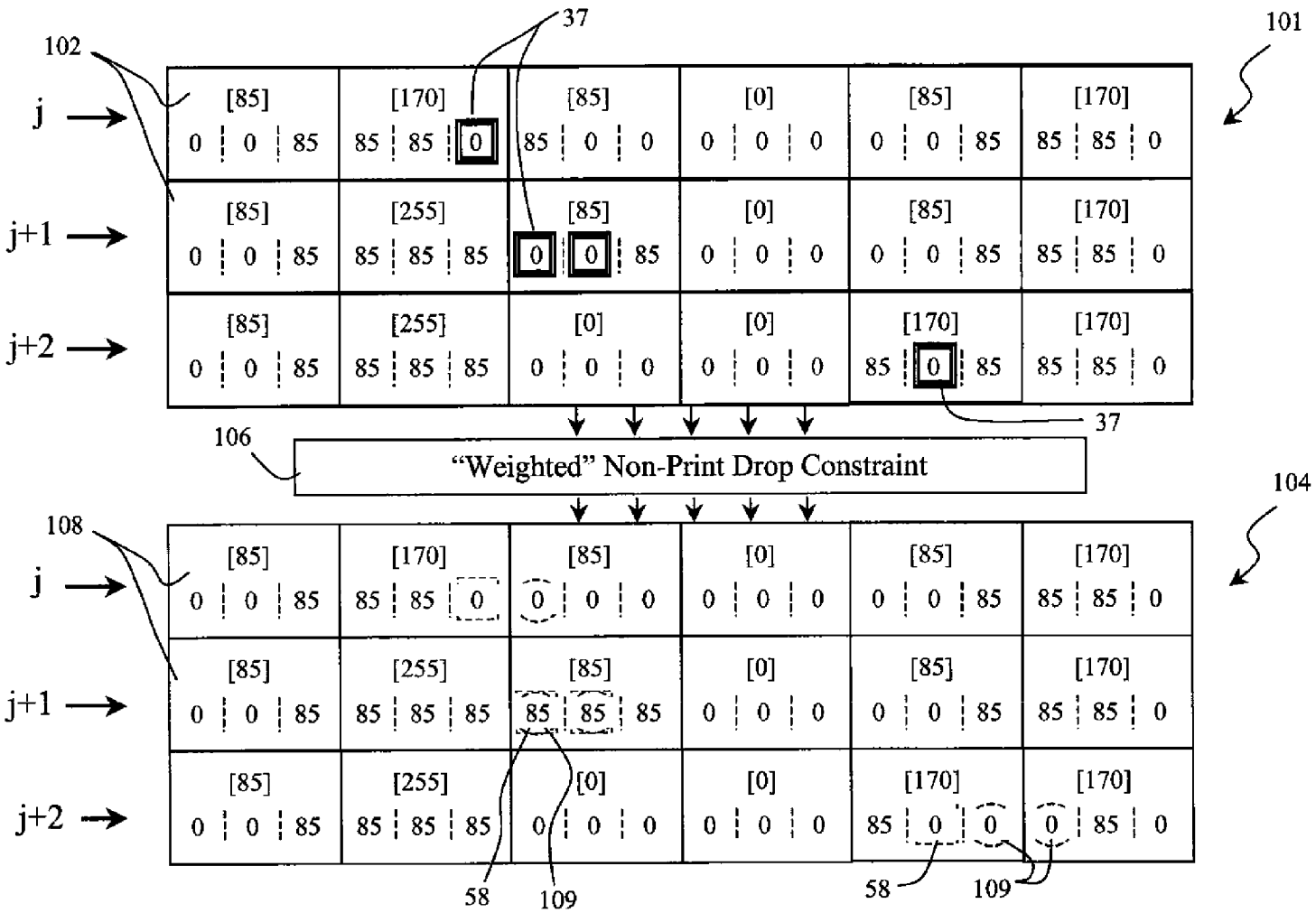
FIG. 22 illustrates the use of a "weighted" non-print drop rule to eliminate undersized non-print drops that have resulted from the procedure illustrated in FIG. 18.
Figure 23:
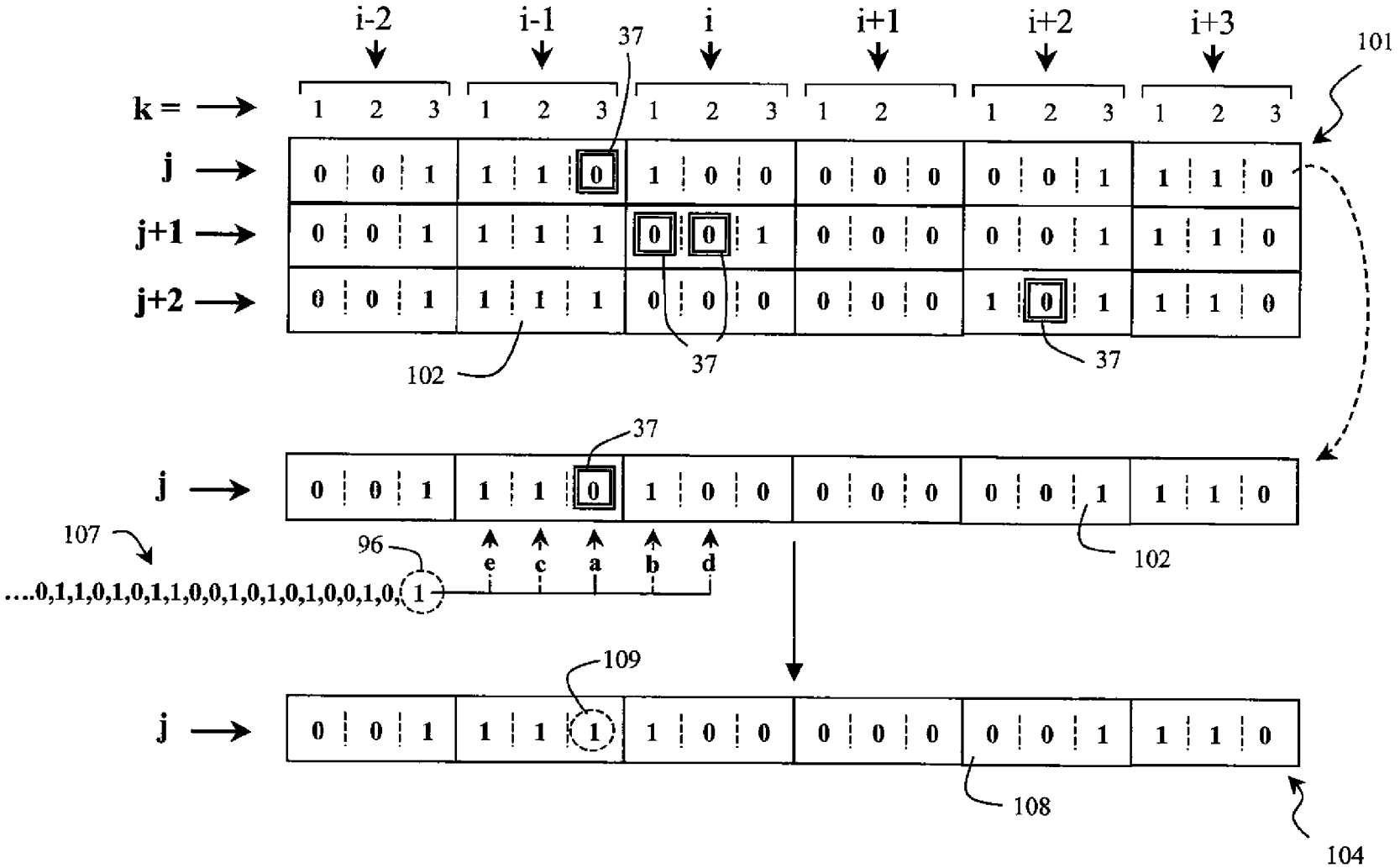
FIG. 23 illustrates the use of a "random change number" non-print drop rule to eliminate undersized non-print drops that have resulted from the procedure illustrated in FIG. 18.

A third example application of a no-print drop rule is illustrated in FIG. 22. In FIG. 22, the intermediate output image values 101 $Om_{js}'$ for the $j^{th}$ jet or image scanline illustrated in FIG. 18 have been redrawn. Index s=3(i−1)+k in the examples of FIGS. 16-33, since N=3. A "weighted" non-print constraint rule is then used to construct final output image values 108 $Om_{js}$ recorded in the lower matrix 104 of FIG. 22. The example weighted constraint rule is designed to reduce image artifacts caused by an under-abundance (or overabundance) of printed ink density or volume, such as the under-abundance caused by the "added zeros" rule of the prior example, which is a non-weighted constraint rule.

In the example of FIG. 22, the weighted constraint rule used to construct the image output data from the intermediate output data of FIG. 18 begins similarly to the "add zeros" rule discussed above, acting upon the first isolated orphan subinterval detected or the first orphan subinterval in an orphan subinterval series detected. However, the example weighted constraint rule keeps track of the number of zeros added and the locations where they are added and then weights a probability of the "add zeros" constraint rule being applied upon detection of the next orphan subinterval or first member of an orphan subinterval series. This probability is set to be low, if the number of added zeros is high within proximity of the location of the zeros added. For example, the probability might be only 10% if more than two zeros were added staffing a location "j, s" and the next lead orphan were within M (3 in FIG. 18) subintervals in j or s. A test value between 0 and 1 is randomly generated and a threshold comparison made to compare to this probability. If the "add zeros" rule is not selected, than an "add ones" rule is selected. After addition of at least one "one" value, the weighted constraint algorithm reverts to the use of the "add-zeros" rule for the next orphan detected, and the procedure is repeated until the entire image is processed. The example of FIG. 22, the weighted constraint rule has been applied iteratively after the initial binarization of the image, but a weighted constraint rule could equally well have been applied as a "post-process" algorithm or as an "on-the-fly" algorithm.

A fourth example application of a non-print drop rule is illustrated in FIGS. 23-26. This "random change number" constraint rule is applied iteratively or as a post-process algorithm. The 3 by 6 matrix of intermediate output image 101 subinterval values $Om_{js}'$ is reproduced from FIG. 18 at the upper portion of FIG. 23. Orphan non-print subintervals 37 are highlighted by double line boxes. Orphans may be identified algorithmically by calculations that determine, for each subinterval coded non-print ("0") whether that subinterval is part of a sequence of non-print sub-intervals at least M long. For example, the calculation previously described with respect to Equations 3-5 may be used.

Once orphan subintervals in the intermediate output image $Om_{js}'$ have been identified, a non-print drop rule procedure is invoked to change either the orphan subinterval value or a nearby subinterval value so as to remove the orphan status of the subinterval. An example "random change number" non-print drop rule procedure is illustrated in FIGS. 23-26. A random set of 1 (one) and 0 (zero) values is generated by any well know random number generator forming a random number sequence 107 such as that illustrated in FIG. 23. The intermediate output image values $Om_{js}'$ for the $j^{th}$ jet or image scanline have been redrawn below the 3 by 6 matrix. For this scanline, an orphan subinterval 37 occurs in the $i-1^{th}$ pixel at the k=3 subinterval (i.e at s=(3((i−1)−1)+3=3i−1). The next value, the change value 96, highlighted by a dotted line circle, in the random number sequence 107 is selected to use to change either the value in the orphan cell or one of the nearby subintervals, in order to remove the orphan status of the orphan subinterval.

For this example non-print drop rule procedure, wherein M=3, the intermediate image values, $Om_{js}'$, are changed in the following order: (a) the current orphan subinterval, (b) the next higher subinterval, (c) the next lower subinterval, (d) the next-to-next higher subinterval, or (e) the next-to-next lower subinterval. That is, the change value 96 is used to change the intermediate image value, $Om_{js}'$, and the result tested using Equations 3-5, to determine if the orphan subinterval has been removed. In general, the change value is applied in an alternating manner to ever more distant higher and lower neighbors as far away as (M−1) neighbors.

Since coding a subinterval as a "1" or print subinterval never produces an orphan subinterval (Equation 3), whenever a "1" occurs in the random sequence of change values, it will be used to change an orphan "0" to a "1" directly, that is without needing to test making the change at neighboring pixels. This occurs in the illustration of FIG. 23. The orphan subinterval 37 is changed by change value 96 to a "1" resulting in a final output image 104 for the $j^{th}$ scanline having no orphan subintervals. The changed subinterval 109 in the final output image data 104 for the $j^{th}$ scanline that has been changed by the application of the example non-print drop rule is highlighted with a dotted circle.

Figure 24:
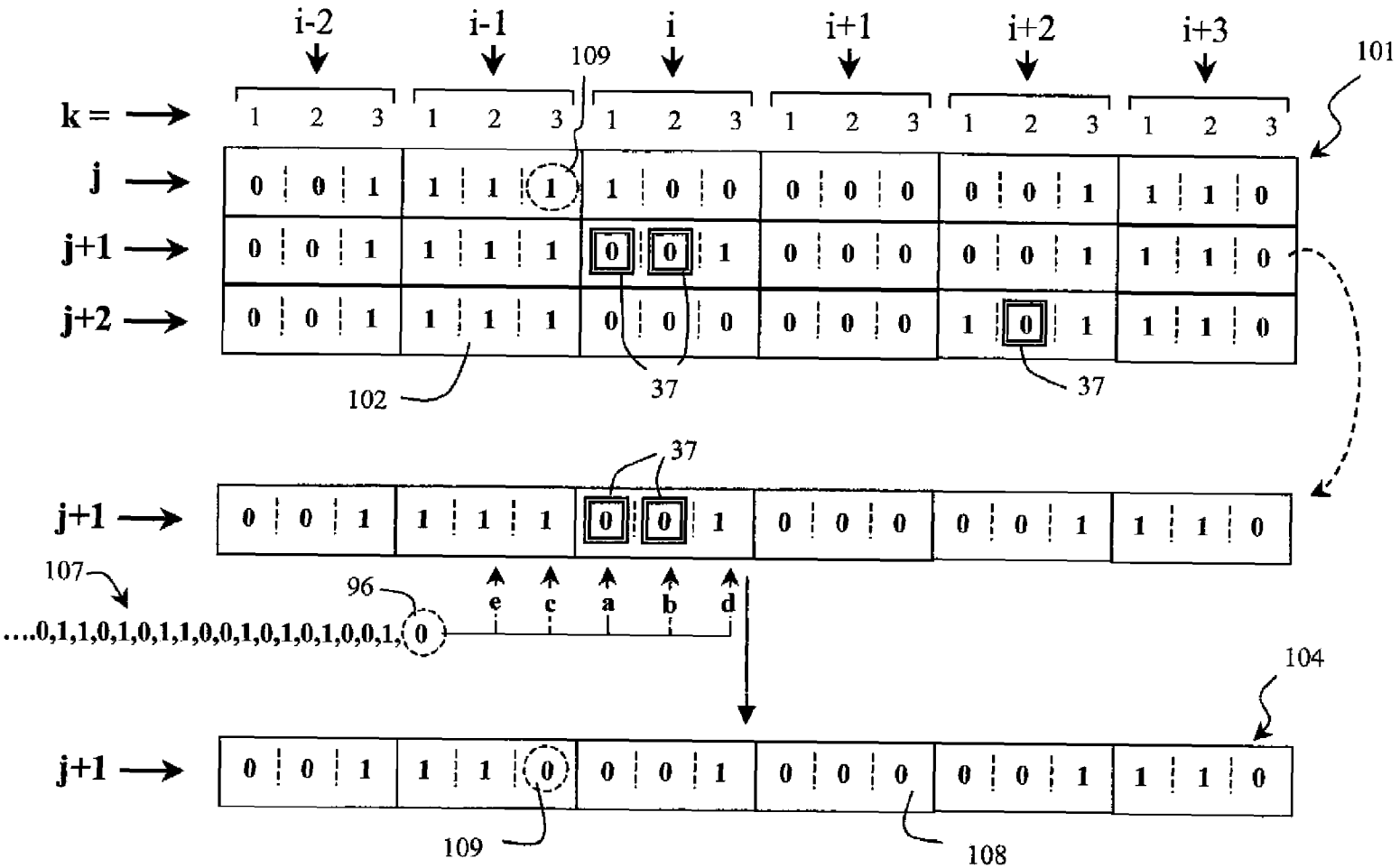
FIG. 24 further illustrates the use of a "random change number" non-print drop rule to eliminate undersized non-print drops that have resulted from the procedure illustrated in FIG. 18.

However, if the change value 96 is a "0", then applying it directly to the orphan $S_{js}$ subinterval will not correct the orphan status of that subinterval. This occurrence is illustrated in FIG. 24. The 3 by 6 portion of the intermediate output image 104 from FIG. 18 is reproduced in the upper portion of FIG. 24, except that the orphan subinterval in the $j^{th}$ scanline has been changed by application of the example non-print drop rule as just explained. The $j+1^{th}$ scanline is reproduced below the 3 by 6 matrix. Two orphan subintervals 37 are located in this scanline in the $i^{th}$ pixel at k=1 and 2. The next change value 96 in the random binary number sequence 107 is a "0" (zero). Using this change value to change the value of $Om_{(j+1)i1}'$ will not cure the orphan status of this subinterval (path a). Therefore the change value is tried at the next higher subinterval (path b). Here, also, the "0" change value will not cure the orphan status of the $S_{(j+1)i1}$ subinterval coding. Next the change value is tried at the next lower subinterval (path c), i.e. at the subinterval, $S_{(j+1)(i-1)3}$. This change does cure the orphan status of the target subinterval, as may be determined by recalculating $Or_{(j+1)i1}$ via Equation 5. Note that this change also cures the orphan status of both orphan subintervals illustrated in the $j+1^{th}$ scanline of the intermediate output image $Om_{(j+1)s}'$. The changed subinterval 109 in the final output image data 104 for scanline j+1 is highlighted with a dotted circle.

Had the next lower subinterval change (path c) not cured the orphan status, then changing the next-next higher subinterval value (path d) and then next-next lower (path e) would be tried. If none of these potential changes will cure the orphan subinterval when a "0" value is generated as the change value, then the orphan pixel must be a single, isolated non-print subinterval. Therefore, as a default, this orphan subinterval is changed to a "1", i.e. the method defaults to a "add ones" rule.

Because the curing of one orphan subinterval may cure others nearby, after making a change of a subinterval according to a non-print drop rule, the orphan status of subintervals within M subintervals of the changed subinterval may be re-determined by re-applying Equations 3-5. Alternately, if Equations 3-5 are being used in an on-the fly or sequential application of the non-print drop rule, the process may be re-started at the changed subinterval.

Figure 25:
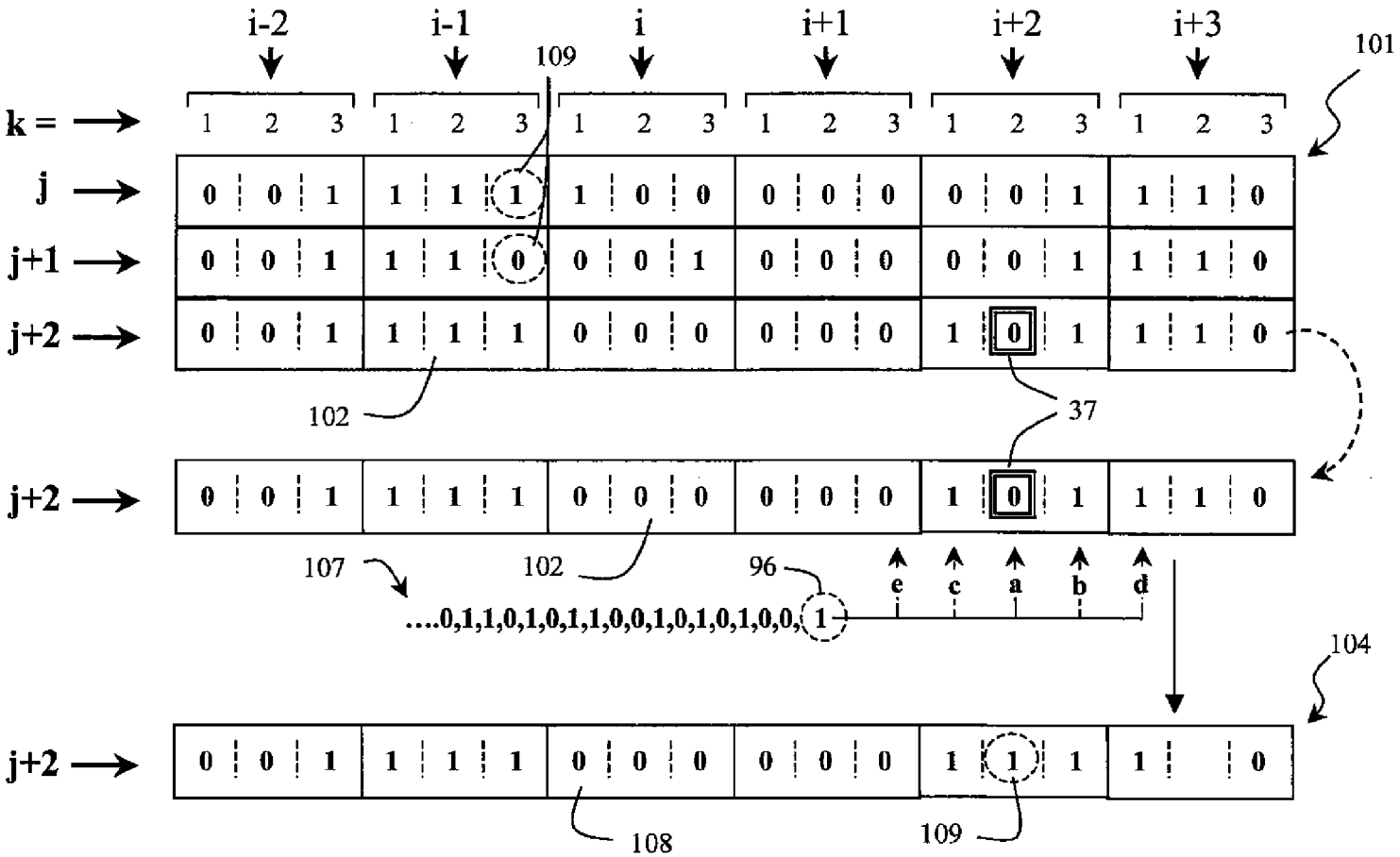
FIG. 25 yet further illustrates the use of a "random change number" non-print drop rule to eliminate undersized non-print drops that have resulted from the procedure illustrated in FIG. 18.

FIG. 25 illustrates the completion of the example application of the random change number non-print drop rule to the $j+2^{th}$ scanline of the intermediate image data matrix from FIG. 18. The $j^{th}$ and $j+1^{th}$ scanlines show the intermediate output image data (now final for these two scanlines) after having been processed according to the example non-print drop rule described above with respect to FIGS. 23 and 24. The intermediate output image values $Om_{(j+2)s}'$ for the $j+2^{th}$ jet or image scanline have been redrawn below the 3 by 6 matrix. For this scanline, an orphan subinterval 37 occurs in the $i+2^{th}$ pixel at the k=2 subinterval. The next value, the change value 96, highlighted by a dotted line circle, in the random number sequence 107 is selected to use to change either the value in the orphan cell or one of the nearby subintervals, in order to remove the orphan status of the orphan subinterval. Since this value is a "1", it may be used to change the intermediate output image value at the orphan pixel location from a "0" to a "1" (path a). The changed subinterval 109 in the final output image data 104 for scanline j+2 is highlighted with a dotted circle.

Figure 26:
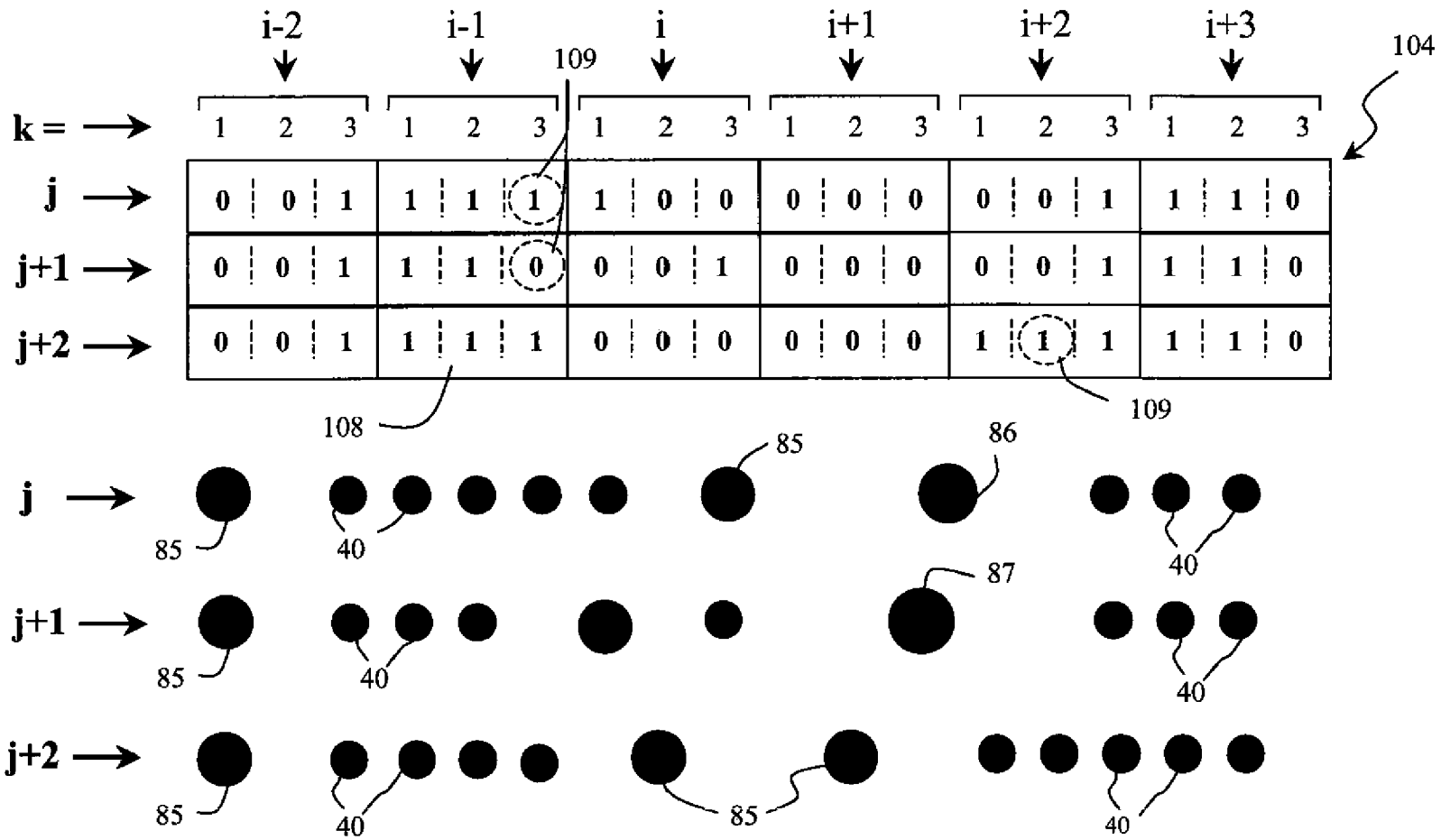
FIG. 26 illustrates the complete application of the embodiment of the present invention illustrated in FIGS. 23 through 25 including a binary threshold image processing procedure and a "random change number" non-print drop rule.

The final output image data $Om_{js}$ 104 derived from the example 3 by 6 matrix of input image data 100 in FIG. 18 is illustrated in FIG. 26. This final output image data set was constructed by applying a binary threshold test followed by a random change number non-print drop rule as explained with respect to Equations 1-5 and FIGS. 23-25. The subinterval values that were changed 109 as a result of the non-print drop rule are highlighted by dotted circles.

An illustration of the drop patterns that will be generated as a result of this output image data is also shown in FIG. 26 for the corresponding j, j+1 and j+2 jets. This illustration assumes that the subintervals before and after the 3 by 6 matrix of output image data are 0's. Print and non-print drops are formed by causing drop forming pulses at the lead and trail ends of every subinterval coded "1" and by omitting drop forming pulses 41 between subintervals coded "0" unless the sequence of "0" coded subintervals would combine to form too large a non-print drop for guttering reliability. Two such occurrences of the insertion of a drop forming pulse to prevent formation of too large a non-print drop are illustrated. In scanline j, a sequence of seven (7) non-print subintervals is broken into non-print drops having three and four subintervals of volume, and in scanline j+2 a sequence of six (6) non-print subintervals is broken into two non-print drops having three subintervals of liquid volume. The addition of a maximum non-print drop rule will be discussed below.

FIG. 26 illustrates schematically the same output pixel print/non-print decision information in the form of a time interval diagram for the $j^{th}$ and $(j+1)^{th}$ jets. This illustration assumes that the subinterval immediately preceding those shown was coded "0" for both jets. Print and non-print drops are formed by causing drop forming pulses at the lead and trail ends of every subinterval coded "1" and by omitting drop forming pulses 41 between subintervals coded "0" unless the sequence of "0" coded subintervals would combine to form too large a non-print drop for guttering reliability. One such occurrence of the insertion of a drop forming pulse to prevent formation of too large a non-print drop is illustrated by drop forming pulse 47. The addition of a maximum non-print drop rule will be discussed below.

The random change number method described above may also be adapted to include weighting towards the replacement of orphans by either "zeros" or "ones" by adjusting the percentage of these values that are supplied in the random change number sequence 107. Also, the percentage of "zeros" and "ones" may be adjusted to have a local weighting by adjusting the random number sequence to provide a desired average value over a certain number of entries in the sequence. For example the sum of every group of six entries may be made to be a value between 0 and 6, thereby biasing the method between an "add zeros" method to an "add ones" method, and various balance points in between.

It will be appreciated by those skilled in the digital printing art that the simple application of a threshold value test, whether a constant threshold value or one that changes in a prescribed, non-image dependent fashion, will produce a variety of "errors" in the output optical density of some areas of pixels. Such errors may result in an over abundance or an under abundance of printed density in local areas of the output image or over the entire output image. It will also be appreciated that the application of a constraint rule, for example, the "add zeros" constraint rule, can likewise produce a variety of "errors" in the output optical density, resulting an over abundance or an under abundance of printed density in local areas of the output image or over the entire output image, even if no such errors existed after application of a threshold value test. For example, in the case of the "add zeros" constraint rule, the resulting output image suffers an under abundance of printed density in the vicinity of pixels where the constraint rule was applied. In similar fashion to the various versions of block subinterval printing methods discussed above, the inventors of the present invention likewise contemplate applying error diffusion techniques to further improve image quality after a constraint rule has been applied.

Figure 27:
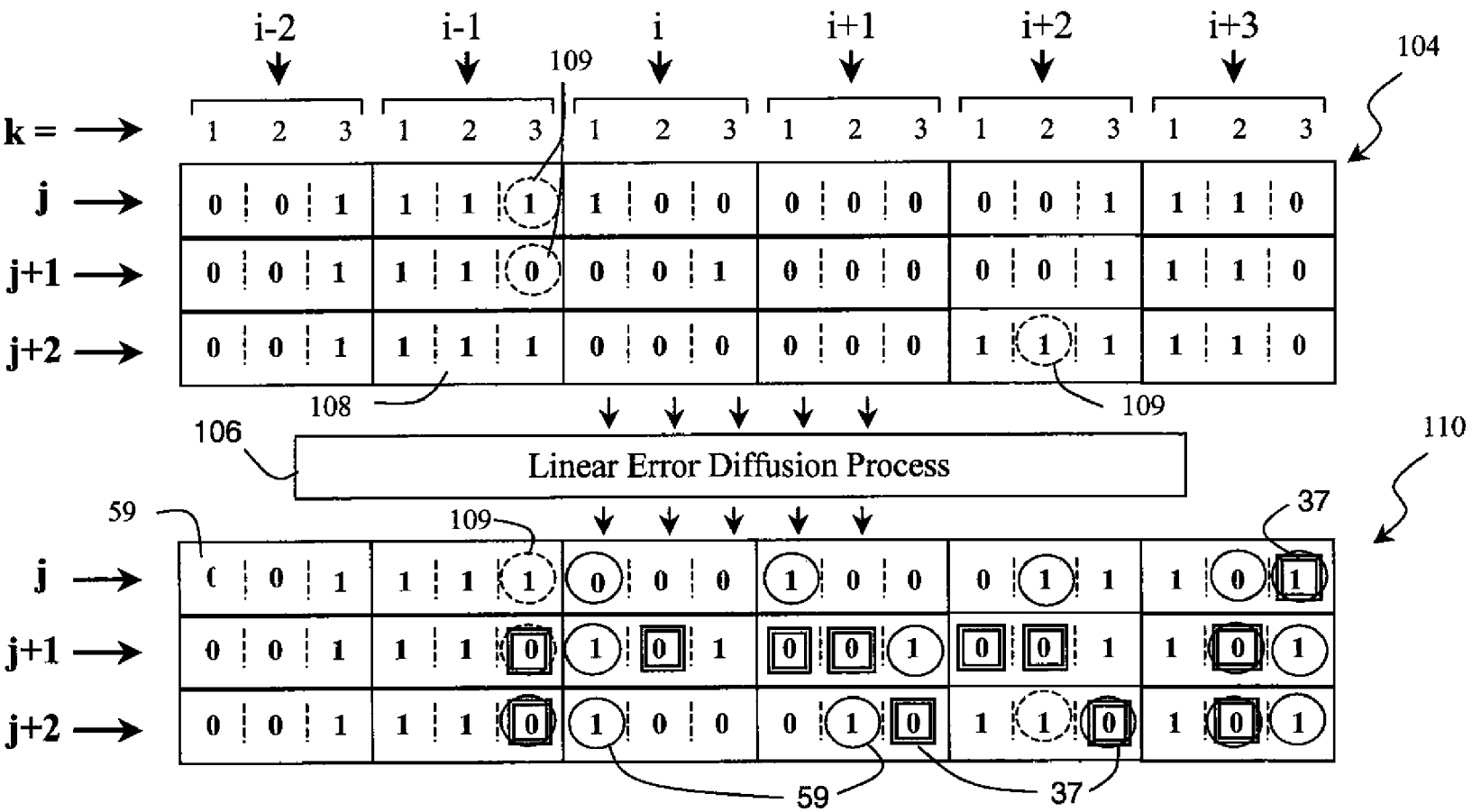
FIG. 27 illustrates the further processing of the image illustrated in FIG. 26 using a linear error diffusion algorithm.

Application of a variation of standard error diffusion techniques after a constraint rule has been applied is illustrated in FIG. 27. A variation of a simple linear error diffusion technique has been applied to the output data image data of FIG. 26. Since the out put image data 104 in FIG. 26 has been first binarized, and then subjected to the example random change number method of applying a non-print drop rule constraint, the process of applying error diffusion preferably uses the original image input data 100, FIG. 18. Note that the binarized intermediate image data 101 of FIG. 18 are shown in an expanded density scale ("0" or "85) while the same data in FIGS. 23-26 are shown equivalently as ("0" or "1"), corresponding to a print and non-print condition. The same threshold values have been used as were used in the threshold test leading to the intermediate image data 101 of FIG. 18.

The error diffusion mask used in construction of FIG. 27 is a very simple one: the entire error is diffused to the next subinterval within the jet scanline, that is the error from subinterval (j, s) is diffused into subinterval (j, s+1). There is, however, one exception: in applying the threshold test for subintervals whose values were changed as a result of the non-print drop constraint rule previously applied, no further change by the threshold test is allowed. In this manner, orphan subintervals which were corrected in the previous application of the constraint rule, remain corrected. Therefore the entire error, including any new error due to the constraint not to alter the repaired orphan subinterval value, is diffused to the next subinterval. Although this simple mask does not correct artifacts as efficiently as the more complicated Floyd-Steinberg mask discussed in association with FIGS. 11-12, it illustrates the use of error diffusion to compensate artifacts caused by application of a constraint algorithm, as can be appreciated by one skilled in the art of image processing.

The modified final image 110 resulting from applying this constrained linear error diffusion procedure to the output image data 104 of FIG. 26, is shown in FIG. 27. The subintervals 109 highlighted by dashed circles are those that were changed by the application of the random change number non-print drop rule procedure described with respect to FIGS. 23-26. The subintervals 59 highlighted by solid circles are ones whose values have been changed by the linear error diffusion process. The application of the linear error diffusion process, however has created many new orphan subintervals 37 which are highlighted by double line boxes.

It is recognized by the inventors that the use of standard error diffusion techniques, such as those discussed in association with FIG. 27, can produce violations of the non-print drop constraint in the form of new orphan subintervals, even if a constraint had previously been applied to eliminate such violations in all subintervals. In such cases, it is further contemplated that re-application of a constraint rule can be used to eliminate non-print rule violations. As can be appreciated by one skilled in the art of image processing, iteratively applying a constraint rule followed by a standard error diffusion algorithm will eventually result in an output image free from orphan drops and unchanged under re-application of the error diffusion algorithm, provided that the error diffusion algorithm and the constraint rule applied to the (j, s) subinterval operates only on subintervals of higher values of j and s, as can be appreciated by one skilled in the art of digital image processing. The processes described in association with FIG. 27 can be of the post-process, iterative, or "on-the-fly" type.

Figure 28:
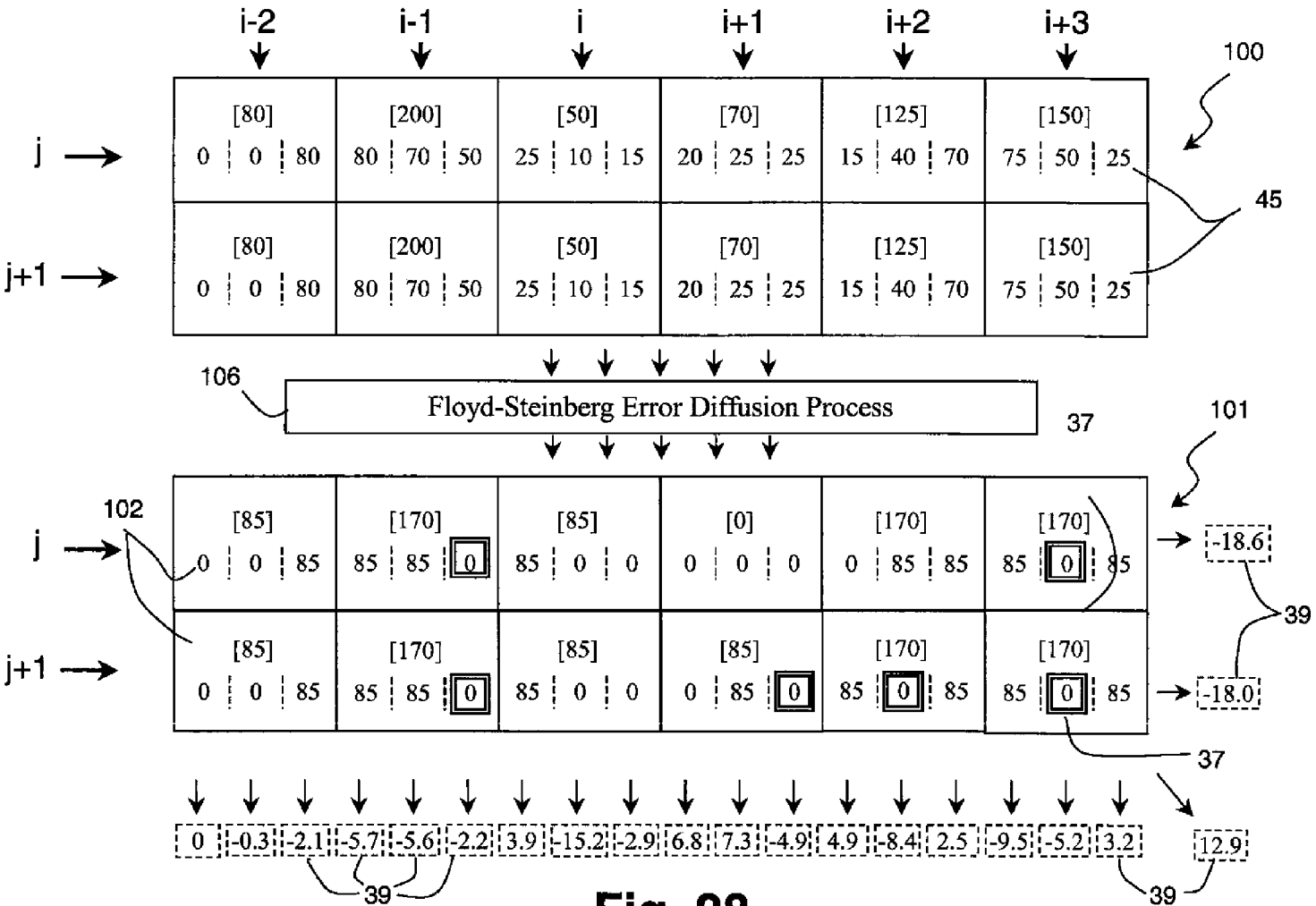
FIG. 28 illustrates the partial application of the embodiment of the present invention illustrated in FIGS. 16 and 17 including an error diffusion procedure.
Figure 29:
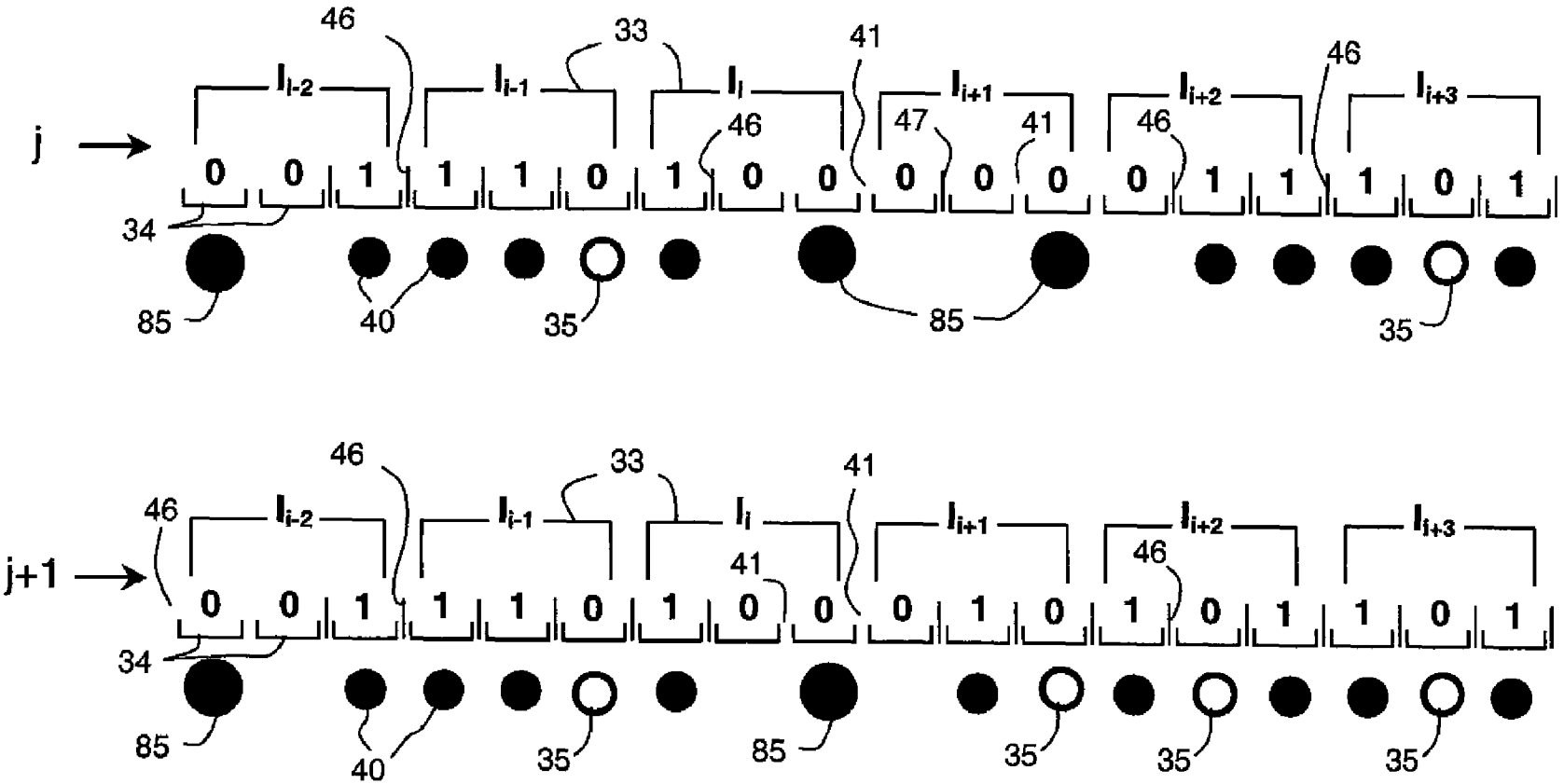
FIG. 29 illustrates the formation of print, non-print and undersized non-print drops that would result from the procedure illustrated in FIG. 28.

The inventors also contemplate cases in which error diffusion methods are applied to image input data prior to application of constraint rules. For purposes of understanding this aspect of the present invention, an image processing method utilizing a constant threshold value, 42.5, followed by a Floyd-Steinberg error diffusion process is carried out on an example input image. This example process and results are illustrated in FIGS. 28 and 29. The example process of FIG. 28 is not yet a complete expression of the individual subinterval methods of the present invention because the "rule" that non-print drops must have a minimum volume, $MV_0$, has not yet been introduced. Further full examples of individual subinterval methods of small drop printing will be discussed with respect to FIGS. 30-32.

In FIG. 28, a 2 by 6 array of image input pixels 45, a portion of an input image 100, is schematically illustrated. The input image is specified in quantized optical density number space wherein $D_{max}$=255 and $D_{min}$=0. The number in square brackets in each input pixel area 45 is the total density value for that input image pixel. For example the optical density of the $ji^{th}$ image input pixel is $Im_{ji}$=50. The total input pixel image density has been "expanded" to provide three values, $Im_{jik}$, k=1 to 3, to associate with three subintervals, $S_{jik}$, k=1 to 3. These expanded input pixel density values are displayed as a row of three values separated by a dashed vertical line. The expanded input pixel optical density values sum to the square bracketed optical density of the input pixel area. For this example image, the image input data was rich enough to generate three individual input image values for each subinterval within each pixel, rather than using an average value for all three subintervals. For the $ji^{th}$ pixel of the input image 100, the subinterval values are as follows: $Im_{ji1}$=25, $Im_{ji2}$=10 and $Im_{ji3}$=15.

An intermediate output pixel image 101 is generated in FIG. 28 by following a Floyd-Steinberg error diffusion process in analogous fashion to that explained with respect to FIGS. 11 and 12. The constant threshold value used was 42.5, the average value of a printed and non-printed subinterval of liquid, wherein it is assumed that $OD_{max}$=255 and is provided by three printed subintervals of liquid per output pixel area 46, and $OD_{min}$=0 and results when no subintervals of fluid are printed in an output pixel area 46. The output image is schematically illustrated using the same conventions as was described for the input image 100. The total quantized optical density for each output image pixel 46 is shown in brackets and the quantized optical density associated with each subinterval is shown as a lower row of values separated by dotted vertical lines. The output image subinterval values are all either 85 or 0, $Om_{jik}$=[85 or 0], illustrating the binary nature of the output image.

It is convenient to use the simpler notation of a subinterval index "s", s=N(i−1)+k, to step along rows of the input and output image. The error diffusion mask describing how errors are distributed to neighboring subintervals is such that the error produced at the subinterval being decided, the $js^{th}$, is passed ($\frac{7}{16}E_{js}$) to the next subinterval, the $j(s+1)^{th}$, ($\frac{5}{16}E_{js}$) to the next subinterval and down to the next jet, the $(j+1)(s+1)^{th}$, ($\frac{3}{16}E_{js}$) down to the same subinterval for the next jet, the $(j+1)s^{th}$, and ($\frac{1}{16}E_{js}$) to the subinterval down one jet and back one subinterval, the $(j+1)(s-1)^{th}$. This procedure was used starting with the $j(i-2)^{th}$ pixel, across the $j^{th}$ row, then down to the $(j+1)(i-2)^{th}$ pixel and across the $(j+1)^{th}$ row. The print, non-print decisions are reflected in the output image subinterval entries (85 or 0) illustrated in the intermediate output image 102. Floyd-Steinberg error values 39 that need to be propagated to adjacent subintervals outside the 2 by 6 pixel grid portion illustrated are indicated in the margins adjacent the intermediate output image pixel grid.

The output pixel values 102 illustrated in the lower half of FIG. 28 are termed "intermediate" because the application of a standard thresholding and error diffusion method does not account for the non-print drop volume rule requiring that non-print drops must be at least some minimum multiple, M, of the small drop volume, in our example M=3. Certain results of the thresholding and error diffusion process yield isolated or "orphan" subintervals coded as "0" or non-print liquid subintervals. These subintervals are indicated in FIG. 27 with double line boxes.

FIG. 29 illustrates schematically the same intermediate output pixel print/non-print decision information in the form of a time interval diagram for the $j^{th}$ and $(j+1)^{th}$ jets. This illustration assumes that the subinterval immediately preceding those shown was coded "0" for both jets. Print and non-print drops are formed by causing drop forming pulses at the lead and trail ends of every subinterval coded "1" and by omitting drop forming pulses 41 between subintervals coded "0" unless the sequence of "0" coded subintervals would combine to form too large a non-print drop for guttering reliability. The addition of a rule for maximum numbers of consecutive "0" subintervals, without inserting an intervening drop forming pulse, will be discussed later. Drop forming pulse 47 illustrated in FIG. 29 was added according to such a "maximum non-print drop rule".

The "0" subintervals highlighted with double line boxes in FIG. 28 are illustrated as hollow circles in FIG. 29. The halftone thresholding and error diffusion procedure resulted in some single non-print subintervals sandwiched among print subintervals, some orphan non-print subintervals. The portions of fluid emitted during these subintervals cannot be properly differentiated from the print drops and captured in the gutter apparatus. If the jet stimulation heaters for jets j and j+1 were pulsed in the sequence illustrated in FIG. 29, the open circle fluid portions 35 would print as extra, undesirable print drops.

The problem of extraneous print drops illustrated by FIGS. 28 and 29 may be rectified by applying a "non-print drop rule" before the print/non-print labeling is finalized for any subinterval. Essentially the non-print drop rule introduces a new logical test that may override the binarization process results. Several examples of non-print drop constraints were explained above with respect to Equations 3-5 and FIGS. 18-26. These same non-print drop rules could be applied to the intermediate output image data illustrated in FIG. 28 to "repair" the orphan subintervals. The only difference is that the intermediate image data 101 in the case of FIG. 28 was generated using the 2-D Floyd Steinberg error diffusion process whereas the intermediate image data 101 in FIG. 18 was generated by a simple binary threshold process, without error diffusion. The operation of the several example non-print drop rules described may proceed after any desired binarization process has been carried out on the input image data.

Figure 30:
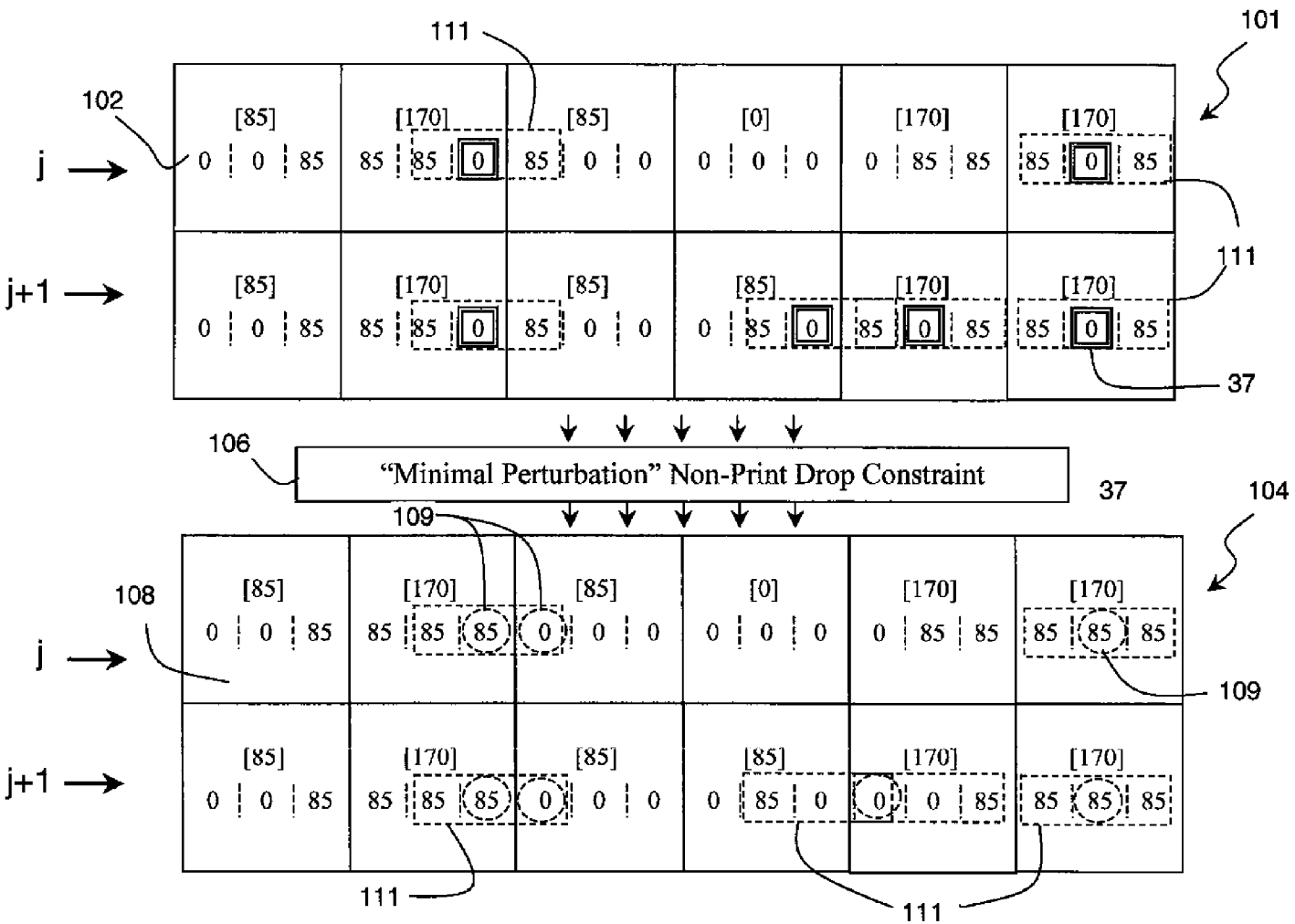
FIG. 30 illustrates the complete application of the embodiment of the present invention including an error diffusion procedure and a minimal perturbation non-print drop constraint.

A further example non-print drop rule, termed a "minimal perturbation" non-print constraint, is applied to the intermediate output image 101 of FIG. 28 to illustrate the operation of a non-print drop rule on binarized image data that has been error diffused. The results of applying this non-print drop constraint is shown in FIG. 30, wherein the final output image 104 is generated free of orphan subintervals. The example minimal perturbation algorithm is applied by considering the M subintervals in the vicinity of each orphan subinterval. In the example of FIG. 30, M=3, and the orphan subinterval is considered as well as the preceding and following subintervals. The minimal perturbation constraint window 111 is denoted by the dashed rectangles in FIG. 30. The intermediate output pixel values 102 within each minimal perturbation constraint window are treated as an M-bit binary word. All the possible $2^M$ binary words (eight possibilities in this example) are considered as replacements for the intermediate image values within the minimum perturbation constraint window. From these possibilities, sequences that repair the orphan subinterval and do not generate new orphans are selected. These choices are then examined for their closeness in root-mean-square deviation from the original input image data (FIG. 28) for the windowed subintervals. The M-bit sequence that both repairs the orphan and has the smallest root-mean-square deviation from the original input image data is then selected as the final image subinterval value 108, illustrated in FIG. 30. This will repair the orphan subinterval with a minimal perturbation of the final output image away from the original input image.

While the perturbation window in the example of FIG. 30 is taken to be an M-bit linear window, the window in which the minimal perturbation principle is applied is not envisioned by the inventors to be restricted to M-bits in length nor to subintervals in only one dimension, that is along a single line j. For example, a two dimensional window centered on subinterval j,s of size 2M+1, the subinterval indices ranging from j−M to j+M and from s−M to s+M could equally be examined per the above criteria.

The inventors of the present invention also have recognized that the application of a non-print drop rule may be beneficially embedded in the binarization process so that orphan subintervals are immediately corrected. For error diffusion binarization processes this approach will also allow the image error correction methods to correct for image errors introduced by the "repair" of orphan subintervals resulting from application of the non-print drop rule. Such an embedded application of the non-print drop rule is termed an "on-the-fly" method as distinct from a process that is carried out after fully binarizing an input image, as was discussed above with respect to FIGS. 18-30.

An example on-the-fly non-print drop rule of particular merit simultaneously combines a constraint rule and a type of error diffusion procedure applied sequentially to one subinterval after another, starting with a subinterval (j, s) and proceeding to increment s and then j. This procedure has been developed by the inventors of the present invention by recognizing that the non-print drop rule or procedure is preferably based on examining previously decided subinterval decisions only. Thus, it may be appreciated that the problem of an orphan non-print subinterval arises because a succession of non-print subintervals is ended before reaching the minimum number, M, because a "print" subinterval is selected. Selection of a non-print subinterval can never cause an orphan subinterval or orphan sequence. The new non-print subinterval either adds another non-print subinterval to a sequence of non-print subintervals, or it begins a new non-print subinterval sequence.

Consequently, a first logical test of the second example non-print drop selection rule may be expressed as Equation 6:

$$\text{if } Om_{js}' = 0, \text{ then } Om_{js} = 0. \tag{6}$$

As was explained above, $Om_{js}'$, with the prime sign designates an intermediate output image data set, before the application of a non-print drop rule. $Om_{js}$ is the final output image data set that includes both binary image processing for image rendition as well as the application of a non-print drop rule to ensure that non-print drops are of a minimum required volume.

Similarly, selection of a new print subinterval following a previous print subinterval cannot cause an orphan subinterval. Addition of a next print drop merely continues a sequence of print drops but does not isolate any non-print liquid. Consequently, a second logical test of the example non-print drop rule may be expressed as Equation 7:

$$\text{if } Om_{js}' = 1 \text{ and } Om_{j(s-1)} = 1, \text{ then } Om_{js} = 1. \tag{7}$$

What may cause an orphan is the selection of a print subinterval immediately following a non-print subinterval, possibly truncating a succession of non-print subintervals short of the minimum number, M. Therefore, the third and final logical test of the example "on-the-fly" non-print drop rule is to test if there are at least the minimum number, M, of non-print subintervals preceding the current subinterval. If there are, it is permitted to code the subinterval "print". If not, then the subinterval should be made a non-print subinterval. Any additional error this application of the "non-print drop rule" causes will then be diffused to adjacent pixels.

The third logical test of the example non-print drop rule may be expressed as Equation 8:

$$\text{if } Om_{js}' = 1,\ Om_{j(s-1)} = 0 \text{ and } \Sigma_{s=(s-M)\ to\ (s-2)} Om_{js} = 0, \text{ then } Om_{js} = 1, \text{ else } Om_{js} = 0. \quad (8)$$

The three logical tests expressed as Equations 6, 7 and 8, are an example of an on-the-fly non-print drop rule according to the present invention.

When the on-the-fly drop rule is applied to the intermediate results of selecting binary output image subintervals according to binary image processing techniques, new, final results are generated that are consistent with the requirement that non-print drops be formed of the fluid associated with at least a minimum number, M, of adjacent subintervals. The rule has the effect of adding from one to M−1 non-print subintervals in an image area once a single non-print drop subinterval is selected. It operates in similar fashion to the "add zeros" non-print drop rule discussed with respect to FIG. 20, except that here, the under abundance of print subintervals introduced will be corrected by the Floyd-Steinberg error diffusion processing that carries the "light density" errors to adjacent subintervals.

Figure 31:
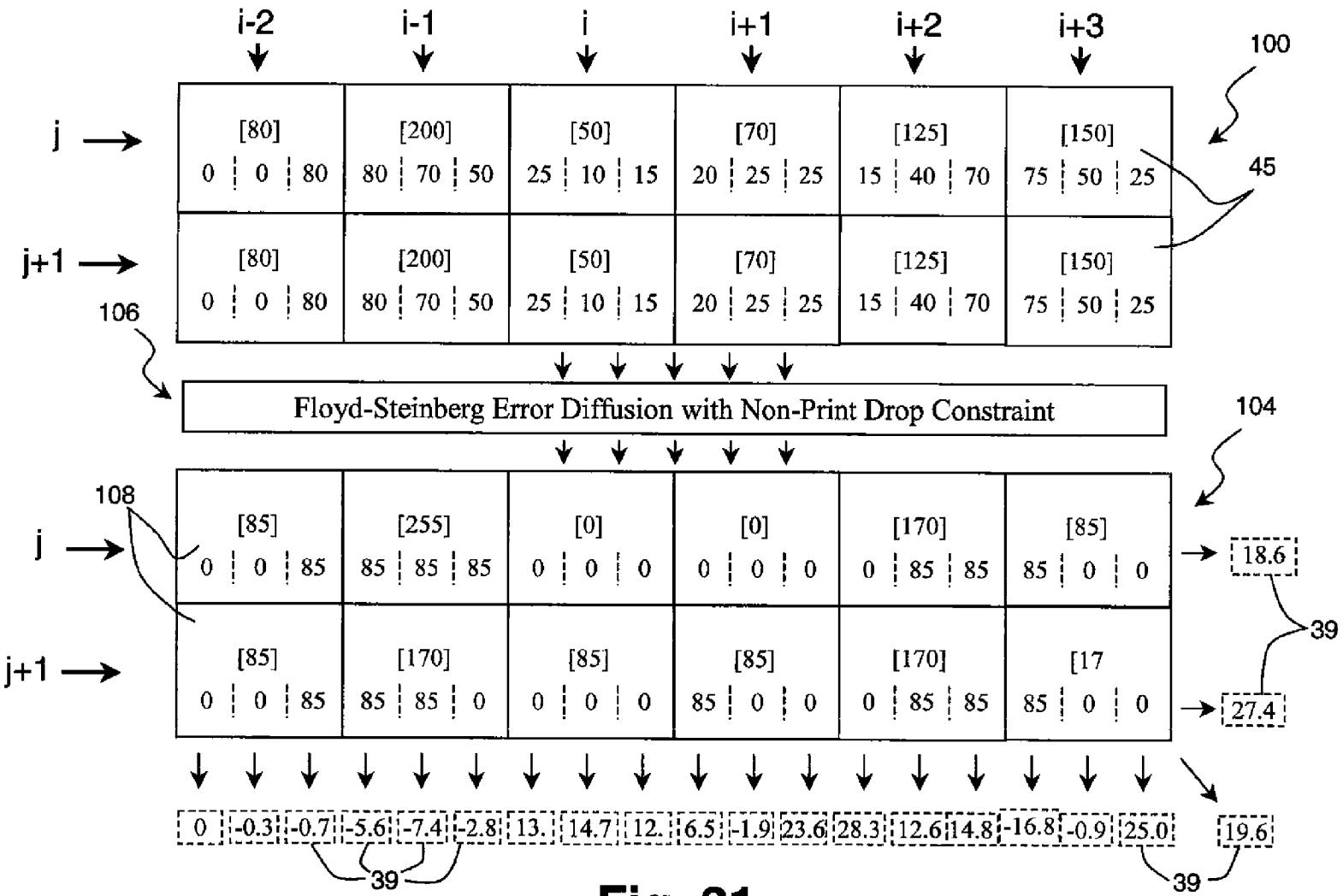
FIG. 31 illustrates the complete application of the embodiment of the present invention illustrated in FIGS. 16, 17, and 27 including an error diffusion procedure and a non-print drop rule.
Figure 32:
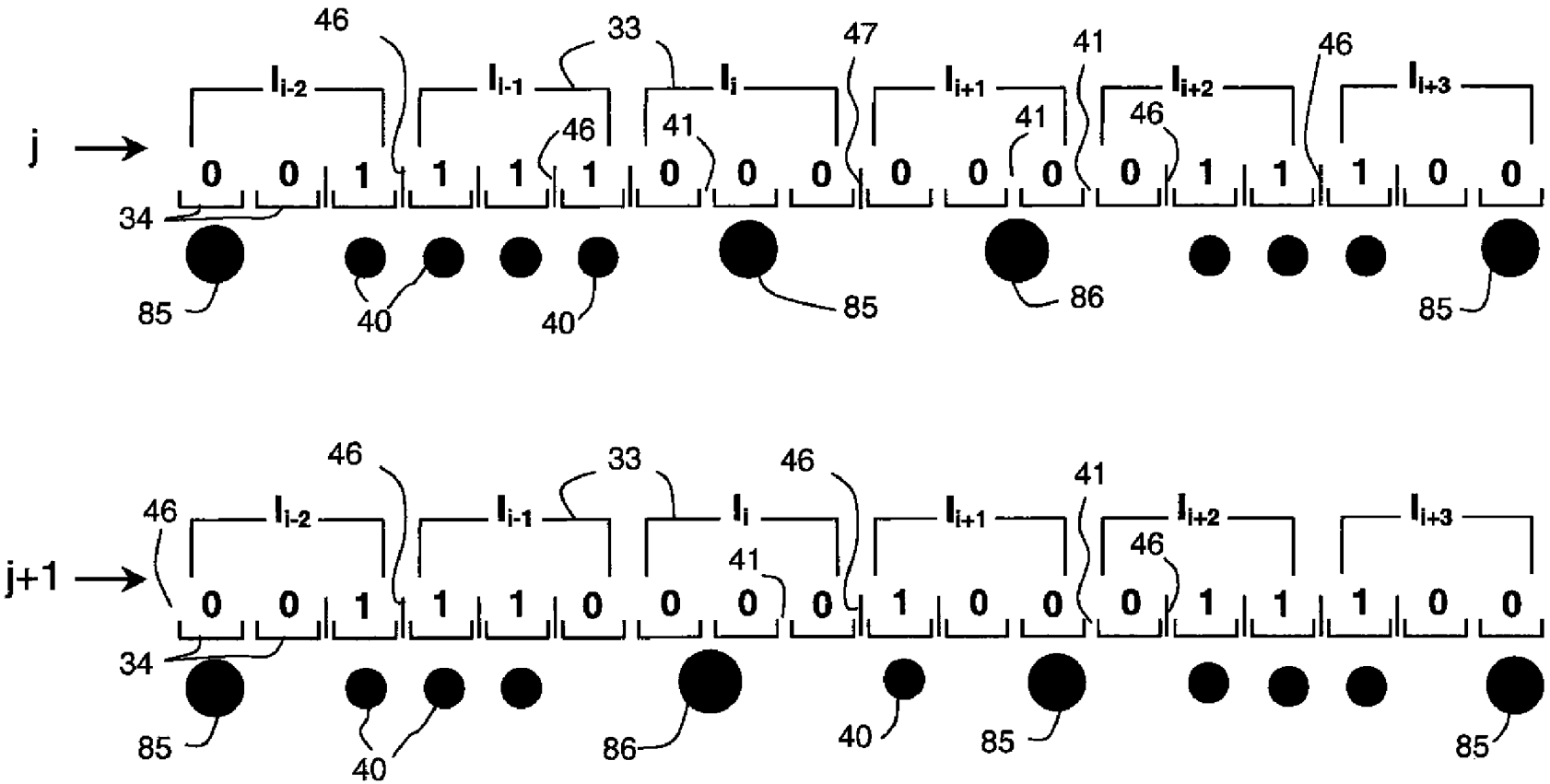
FIG. 32 illustrates the formation of print and non-print and drops that would result from the procedure illustrated in FIG. 31 according to the present invention.

FIGS. 31 and 32 illustrate the application of a constant threshold test (Equation 2, with test threshold=42.5), followed by the application of the just discussed example non-print drop rule (Equations 6, 7 and 8) and concurrently with application of a Floyd-Steinberg error diffusion procedure at each subinterval in the same manner as was done in calculating the values in FIG. 28. FIG. 31 illustrates input image pixel and subinterval values identical to those used in FIG. 28. The output print, non-print subinterval coding is illustrated in FIG. 31 in similar fashion to that explained with respect to FIG. 29.

FIG. 32 illustrates schematically the same output pixel print/non-print decision information in the form of a time interval diagram for the $j^{th}$ and $(j+1)^{th}$ jets. This illustration assumes that the subinterval immediately preceding those shown was coded "0" for both jets. Print and non-print drops are formed by causing drop forming pulses at the lead and trail ends of every subinterval coded "1" and by omitting drop forming pulses 41 between subintervals coded "0" unless the sequence of "0" coded subintervals would combine to form too large a non-print drop for guttering reliability. One such occurrence of the insertion of a drop forming pulse to prevent formation of too large a non-print drop is illustrated by drop forming pulse 47. The addition of a maximum non-print drop rule will be discussed below.

It may be understood from close comparison of FIGS. 28 and 31 that the application of the example on-the-fly non-print drop rule has caused fewer output print drops to be used over the twelve pixel areas illustrated. The magnitudes of the diffused errors 39 emerging from the processed pixel areas 46 of FIG. 31 are larger and positive as compared to the errors diffusing from the intermediate image pixel areas 102 in FIG. 28. The errors introduced by adding non-print subintervals will be "caught up" in nearby pixel areas not yet processed by the addition of extra print subintervals.

The application of a binary image processing algorithm, followed by altering some results using a non-print drop rule, and then, optionally, ameliorating errors using an error diffusion procedure results in a final desired output image, $Om_{js}$, that specifies for every time subinterval, $S_{js}$, of the emitted fluid from every jet, j, whether or not that fluid is to print or to not be printed. However, in arriving at the sequence of drop forming pulses that leads to this output image result, an additional "rule" or logical test, a maximum non-print drop rule, is invoked to place an upper bound on the volume liquid that is directed into a single non-print drop, i.e. the largest non-print drop permitted has a volume of $QV_0$, where Q is an integer greater than M.

The inventors of the present invention have found that non-print drop capturing and guttering apparatus operate most reliably if the range of non-print drop volumes is kept relatively low. It has been previously explained that there is a minimum multiple of time subintervals, M, that may be formed into a non-print drop and reliably differentiated from print drops and captured by the guttering apparatus. For a preferred embodiment of a maximum non-print drop rule, it is further assumed that non-print drops of volumes: $MV_0$, $(M+1)V_0$, . . . , $(2M-1)V_0$ may be reliably captured and guttered. Therefore, one preferred choice for Q is Q=(2M−1). For the examples above wherein M=3, this assumption is that non-print drop volumes of $3V_0$, $4V_0$ and $5V_0$ may be reliably captured and guttered by the printing apparatus, Q=5.

It is further useful in understanding the operation of a maximum drop rule to make a distinction between the previously discussed binary output image $Om_{js}$, and the sequence of drop forming pulses that is applied to the stimulation heaters of every jet to create the associated small print drops and large non-print drops. In FIG. 30, an eighteen-subinterval portion output image $Om_{js}$ for jets j and (j+1) may be seen to be the 1's and 0's shown. The drop forming pulse sequence, on the other hand, is the sequence of drop forming pulses that are applied between every subinterval 34, consisting of some "deleted" pulses 41, some drop forming pulses 46, and a few drop forming pulses 47 (only one shown in FIG. 30) that arise from application of a maximum non-print drop rule.

To make the distinction between the output image, $Om_{js}$, and the drop forming pulse sequence more clear, a drop forming pulse matrix, $Dp_{js}$, is useful. The drop forming pulse matrix specifies, for every subinterval, $S_{js}$, for every jet j, whether ("1") or not ("0") a drop forming pulse is inserted at the end of that subinterval. That is, the drop forming pulse matrix specifies the drop forming trailing pulses.

It is not necessary to specify leading drop forming pulses other than to note that an image must always be initiated with a drop forming pulse at the beginning of the very first subinterval of the image. In practice, a continuous drop emitter will be idling by generating non-print drops, pending the command to begin printing a new output image. Therefore, the first leading drop forming pulse will be provided by the trailing pulse that forms the last non-print drop before commencing the first time subinterval of the image to be printed, $Dp_{j1}$. If the very first time subinterval of liquid emitted by the $j^{th}$ jet is to be a print drop, then $Dp_{ji}=1$, specifying the application of a trailing drop forming energy pulse to the stimulation heater of the $j^{th}$ jet, after the $j1^{th}$ subinterval. If the first subinterval of liquid emitted by the $j^{th}$ jet is to be part of a non-print drop, then $Dp_{j1}=0$, and a trailing drop forming energy pulse will not be applied.

The drop forming pulse matrix, $Dp_{js}$, is constructed from the previously calculated output image matrix, $Om_{js}$, by the application of a maximum non-print drop rule that operates to examine the sequence of print and non-print time subintervals for each jet individually, and determines, for every subinterval, whether or not to insert a trailing drop forming pulse. The completed drop forming pulse matrix, $Dp_{js}$, should result in four characteristics: (1) the specified output image, $Om_{js}$, is printed by the application of $Dp_{js}$ to the jet stimulators; (2) every print drop in the output image is defined by single time subintervals having drop forming pulses at both their leading and trailing ends; (3) every non-print drop is composed of at least M consecutive time subintervals having a leading and trailing drop forming pulse and no intervening drop forming pulses between time subintervals; and (4) every non-print drop is composed of no more than Q consecutive time subintervals having a leading and trailing drop forming pulse and no intervening drop forming pulses between time subintervals.

A preferred example maximum non-print drop rule that has been developed by the inventors of the present invention may be used to derive $Dp_{js}$ from $Om_{js}$ using only a small range of subintervals of $Om_{js}$ to determine each value of $Dp_{js}$. This preferred example maximum non-print drop rule may be understood as follows. First, it is recognized that every subinterval in $Om_{js}$ that specifies a print drop, needs a trailing drop forming pulse. If the next subinterval, $Om_{j(s+1)}$ is coded "1" to print, then that subinterval will need a leading pulse, that must be supplied as a trailing pulse of the present subinterval. So, a first part of the preferred example maximum non-print drop rule is expressed as logical test or Equation 9:

$$\text{If } Om_{js} \text{ or } Om_{j(s+1)} = 1, \text{ then } Dp_{js} = 1. \tag{9}$$

This first part of the maximum non-print drop rule takes care of providing drop forming pulses in $Dp_{js}$ for print drop coded time subintervals.

A second part of the maximum non-print drop rule determines when to insert trailing drop forming pulses that will result in forming at least minimum volume non-print drops, $MV_0$, but not non-print drops larger than $QV_0$ drops. For this preferred example, Q=(2M−1). It may be appreciated that there is no need to insert trailing drop forming pulses based on the maximum non-print drop volume requirement for sequences of time subintervals coded non-print that are equal to or shorter than Q. The first rule will take care of providing leading and trailing drop forming pulses for all such sequences. Also, the application of the non-print drop rule has ensured that there are no sequences of time subintervals in $Om_{js}$ coded "0" that are shorter than M.

The second part of the maximum non-print drop rule is applied to subintervals of $Om_{js}$ that are coded "0" to test whether they are in the $M^{th}$ position of a sequence of non-print subintervals, and, if so, are there also enough upcoming time subintervals to form another minimum volume non-print drop? If not, then a non-print drop, $V_{np}$, having volume, $MV_0 < V_{np} \leqq (2M-1)V_0$, is being formed. For our preferred example embodiment, $V_{np} \leqq QV_0$, therefore, no trailing pulse is needed, it will be provided by next upcoming "0" to "1" transition in $Om_{js}$, according to Equation 9. If the present subinterval is the $M^{th}$ subinterval in a sequence of non-print subintervals, and there are at least M more such subintervals coming up in the $Om_{js}$ sequence, then it is "safe" and desirable to insert a drop forming pulse for the present subinterval, i.e. to set $Dp_{js}=1$. Consequently, the second part of the preferred example maximum drop forming rule is expressed as the following logical test or Equation 10:

$$\begin{aligned} &\text{if } Om_{js} = 0, \\ &\text{and } \Sigma_{r=1 \text{ to } (M-1)} DP_{j(s-r)} = 0, \text{ and } \Sigma_{r=1 \text{ to } M} Om_{j(s+r)} = 0, \\ &\text{then } Dp_{js} = 1, \text{ else } Dp_{js} = 0. \end{aligned} \tag{10}$$

Figure 33:
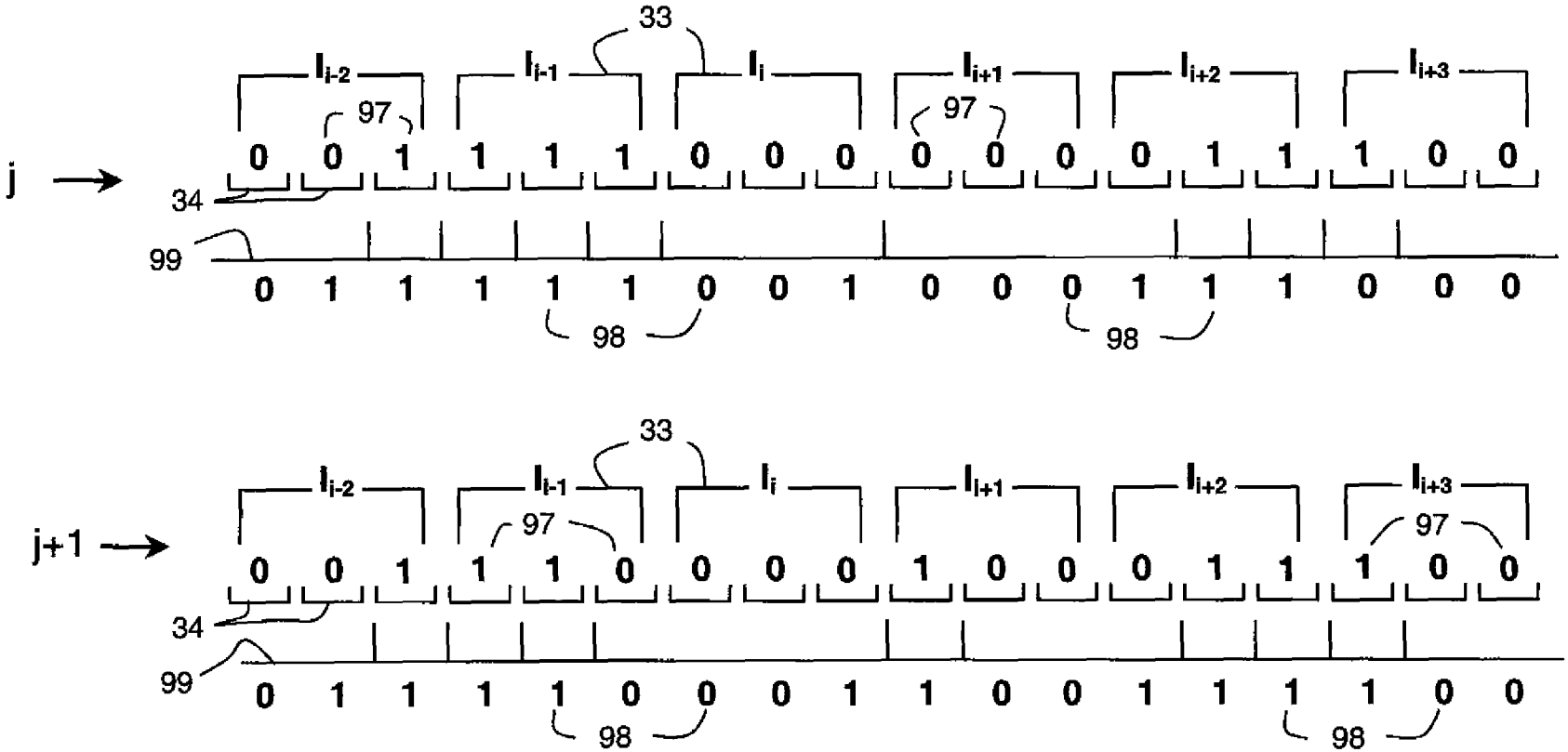
FIG. 33 illustrates the formation of the drop forming pulse matrix values and pulse sequence result from the procedure illustrated in FIG. 31 followed by the application of a maximum non-print drop rule according to the present invention.

The time subinterval diagrams illustrated in FIG. 32 are shown in FIG. 33 except that instead of illustrating small print drops and large non-print drops, the values 98 ("1" or "0") of $Dp_{js}$ and the applied drop forming pulse sequences 99 for the $j^{th}$ and $+1)^{th}$ jet are shown schematically. The values 97 of $Om_{js}$ that were used to form the $Dp_{js}$ values 98 are included. Note that $Dp_{js}=1$ means that a drop forming pulse 46 will be applied trailing that time subinterval. $Dp_{js}=0$ means that no drop forming pulse will be applied at the trail end of that time subinterval.

Drop forming pulse sequences 99 that may be applied to each jet j are the culmination of the small drop printing methods of the present invention. The drop forming pulse sequences may be constructed by utilizing a time subinterval block structure as was discussed with respect the first, second, third and fourth sets of embodiments above. In which case, drop forming pulses are inserted trailing all blocks of subintervals and trailing all subintervals within blocks that are coded as print blocks. Drop forming pulses are not inserted trailing subintervals within blocks coded as non-print blocks. Alternatively, drop forming pulse sequences may be constructed by utilizing the fifth set of embodiments, individual subinterval methods, wherein all subintervals are individually coded according to associated input image data and are then further examined according to a non-print drop rule and a maximum non-print drop rule. For any of the embodiments of the present invention, error diffusion techniques may or may not be used to ameliorate output image errors introduced by either the initial binary image processing procedures or by the application of the non-print drop rule.

The invention has been described in detail with particular reference to certain preferred embodiments thereof, but it will be understood that variations and modifications can be effected within the spirit and scope of the invention.

PARTS LIST

10 printer system
12 drop nozzle front face layer
13 passivation layer
14 stimulation heater control circuits
15 drop generator substrate
16 continuous liquid drop emission printhead
17 drop capture gutter
18 receiving or recording medium
19 working liquid, ink
20 liquid recycling unit outlet from printhead
21 nozzle opening with effective diameter, $D_{dn}$
22 jet stimulation heater surrounding jet
23 printhead electrical connector
24 individual transistor per jet to power heat pulses
25 via contact to power transistor
26 working liquid pressure regulator
27 working liquid inlet to printhead
28 working liquid reservoir
29 working liquid supply chamber
30 liquid per subinterval, $V_0$

31 cluster of 3 printed drops
32 printed drop, output image spot or dot
33 time interval, $I_i$, associated with the $i^{th}$ pixel area
34 subinterval of time interval, $I_i$
35 undersized non-print drop, cannot be guttered reliably
36 block of subintervals
37 disallowed non-print drop result
38 non-printing drop, volume, $mV_0$, $m \geqq 2$
39 diffused error value
40 printing drop, volume, $V_0$
41 absence of drop forming pulses
42 intra-block drop forming energy pulse
43 inter-block drop forming energy pulse
44 output image pixel areas
45 input image pixel areas
46 drop forming energy pulse
47 drop forming energy pulse inserted to form non-print drops less than a permitted maximum volume
48 pressurized deflection gas flow
49 positive pressure source inlet
50 image or pattern data source
51 positive gas pressure control
52 positive gas pressure source
53 stimulation heater address electrode
54 common heater address electrode
55 working liquid recycling unit
56 drop capture lip of drop capture gutter
57 gutter opening
58 position of repaired disallowed non-print drop result
59 subinterval whose value was changed by a post-constraint error diffuse algorithm
60 gas flow deflection plenum
70 continuous stream of working liquid
72 stimulated surface waves on the continuous stream of liquid
74 operating break-off length due to controlled stimulation
80 stream of drops of having one pre-determined volume, $V_0$
82 stream of drops of having multiple predetermined volumes, $\sim mV_0$
83 non-printing drop, volume, $\sim 2V_0$
84 multiple drop volume stream with deflected printing drops
85 non-printing drop, volume, $\sim 3V_0$
86 non-printing drop, volume, $\sim 4V_0$
87 non-printing drop, volume, $\sim 5V_0$
88 non-printing drop, volume, $\sim 8V_0$
91 pulse sequence for large drop of volume $3V_0$
92 pulse sequence for large drop of volume $4V_0$
94 pulse sequence for large drop of volume $8V_0$
96 change value used in applying a non-print drop rule
97 values of the output image, $Om_{jik}$ or $Om_{js}$
98 values of the drop forming pulse matrix $Dp_{js}$
99 drop forming pulse sequence
100 input image
101 intermediate output pixel image
102 intermediate output image pixel area
103 new input pixel value with diffused error contribution
104 final output image
105 Floyd-Steinberg error diffusion mask
106 input-to-output subinterval image processing algorithms
107 random binary number string for orphan replacement
108 final output image pixel area
109 subinterval changed by application of a minimum non-print drop volume rule
110 new post-error diffusion intermediate output image having changed subintervals
111 minimal perturbation constraint window
112 media positioning and transport system
113 media transport infeed drive rollers
114 media transport outfeed drive rollers
115 print drop impact point at media 18
116 transport control system
120 printing system controller
A deflecting air-flow direction
$A_n$ nozzle array axis
B number of blocks
$B_{ik}$ $k^{th}$ block of subintervals in the $i^{th}$ time interval
$BOL_0$ operating break-off length
C centroid of printed drops within a pixel area
$D_d$ drop diameter
$D_{dn}$ nozzle diameter
$Dp_{js}$ drop forming pulse matrix
Eji error arising at the $ji^{th}$ pixel from the difference between input and output optical density or liquid pattern data amount
F fast scan direction
$I_{ji}$ time interval associated with an $i^{th}$ pixel area in the $j^{th}$ scanline during a printing pass
$Im_{ji}$ input image or pattern data at the $ji^{th}$ pixel area
M minimum number of subintervals that can be formed into a reliable non-print drop volume
N number of subintervals associated with a time interval $I_i$
$N_p$ number of subintervals coded to print within a time interval
$N_B$ number of blocks in a time interval
$N_k$ number of subintervals in block k
$N_x$ total number of input and output pixels in the x-direction, maximum value of index "i"
$N_y$ total number of input and output pixels in the y-direction, maximum value of index "j"
$OD_{jik}$ input image or pattern data associated with the $k^{th}$ time subinterval in the $ji^{th}$ pixel area
$Om_{jik}$ output image or pattern data at the $ji^{th}$ pixel area, $k^{th}$ subinterval (alternately, $Om_{js}$)
$Om_{js}'$ intermediate output image or pattern data at the $ji^{th}$ pixel area, $s^{th}$ subinterval
$Or_{js}$ orphan calculation matrix identifying non-print drops formed of less than M subintervals
Q maximum number of subintervals that may be combined to form a non-print drop
s index for each time subinterval combining the indices i and k, $s=N(i-1)+k$
S slow scan direction
$S_{ijk}$ time subinterval for the $j^{th}$ jet or scanline, the $i^{th}$ pixel during the $k^{th}$ subinterval
$S_{dn}$ nozzle spacing
$S_f$ output pixel spacing in the fast scan direction
$S_k$ time subinterval k
$v_d$ drop and liquid stream velocity
$v_M$ media transport velocity
$V_P$ Volume of a print drop
$V_{np}$ Volume of a non-print drop
$V_{tp}$ desired volume of working liquid to be applied to a pixel area according to pattern data

The invention claimed is:

1. A method of forming a liquid pattern according to liquid pattern data on a receiving medium using a liquid drop emitter that emits a continuous stream of liquid from a nozzle that is broken into drops of predetermined volumes by the application of drop forming energy pulses comprising:

associating a pixel area of the receiving medium with a nozzle and with a time interval during which a plurality of fluid drops ejected from the nozzle can impinge within the associated pixel area of the receiving medium;

dividing the time interval into a plurality of subintervals;

grouping the plurality of subintervals into blocks;

defining each block as a printing block or a non-printing block;

associating a drop forming energy pulse between each pair of consecutive blocks;

associating a drop forming energy pulse between subintervals of each printing block;

associating no drop forming energy pulse between each subinterval of each non-printing block; and causing drops to be emitted from the nozzle based on the associated sequence of drop energy forming pulses and wherein the liquid pattern is formed on the receiving medium of print drops formed of liquid emitted during subintervals associated with printing blocks and liquid emitted during subintervals associated with non-printing blocks is formed into non-print drops and captured before reaching the receiving medium.

2. The method of claim 1 wherein the liquid is an ink and the liquid pattern is a desired output image.

3. The method according to claim 1, wherein the volume of each print drop, $V_p$, is comprised of the volume of liquid emitted during one subinterval, $V_0$; $V_p=V_0$.

4. The method according to claim 1, wherein the volume of each non-print drop, $V_{np}$, is comprised of the liquid emitted during at least two subintervals, $2V_0$; $V_{np}\geqq 2V_0$.

5. The method according to claim 1, wherein each subinterval is of the same duration.

6. The method according to claim 1, wherein all subintervals are completely positioned within a block.

7. The method according to claim 1, wherein each block includes the same number of subintervals, $N_B$.

8. The method according to claim 1, wherein the liquid drop emitter is comprised of a plurality of nozzles emitting a plurality of continuous streams of liquid and a plurality of stream stimulation means for applying a corresponding plurality of independent sequences of drop forming pulses according to the method of claim 1 applied to each of the plurality of continuous streams of liquid independently.

9. The method according to claim 1, wherein the time interval is comprised of a number, N, of printable subintervals that may be formed into N print drops each associated with the fluid emitted during a printable subinterval and having substantially equal volume, $V_0$, the method further comprising:

obtaining a desired total liquid volume, $V_{tp}$, of the printed drops located within the pixel area from liquid pattern data; and defining as printing blocks a number of blocks of the time interval that include a total of number of printable subintervals, $N_p$, and defining as non-printing blocks any remaining blocks of the time interval such that the total liquid volume of the printed drops, $N_pV_0$, substantially equals the desired total liquid volume.

10. The method according to claim 9, wherein an error difference between the desired total liquid volume and the total liquid volume of the printed drops is diffused to other pixel areas of the recording medium in accordance with a diffusion mask.

11. The method according to claim 9, wherein each block of subintervals is comprised of an equal number of subintervals, $N_B$, and the number of liquid drops that can be printed during the time interval, N, comprises an integer multiple of the number of subintervals in a block.

12. The method according to claim 9, wherein the number of printable subintervals in a time interval, N, is divided among a plurality of blocks including at least two different numbers, $N_B$, of subintervals per block.

13. The method according to claim 12, wherein the volume of a non-print drop must be formed from the liquid emitted during a minimum number, M, of subintervals, and each block includes at least M subintervals; all $N_B\geqq M$.

14. The method according to claim 13, wherein the volume of a non-print drop must be formed from the liquid emitted during a maximum number, Q, of subintervals or less, and each block includes no more than Q subintervals; all $N_B\leqq Q$.

15. A method of forming a liquid pattern according to liquid pattern data on a receiving medium using a liquid drop emitter that emits a continuous stream of liquid from a nozzle that is broken into drops of predetermined volumes by the application of drop forming energy pulses comprising:

associating a pixel area of the receiving medium with a nozzle and a time interval during which a plurality of fluid drops ejected from the nozzle can impinge the pixel area of the receiving medium;

dividing the dine interval into a plurality of subintervals;

grouping the plurality of subintervals into blocks;

defining each block as a printing block or a non-printing block;

associating a drop forming energy pulse between each pair of consecutive blocks;

associating a drop forming energy pulse between subintervals of each printing block;

associating no drop forming energy pulse between each subinterval of each non-printing block; and causing drops to be emitted from the nozzle based on the associated sequence of drop energy forming pulses and wherein the liquid pattern is formed on the receiver of print drops formed of liquid emitted during subintervals associated with minting blocks and liquid emitted during subintervals associated with non-printing blocks is formed into non-print drops and captured before reaching the receiving medium, wherein each block includes the same number of subintervals, $N_B$ and wherein the volume of a non-print drop must be formed from the liquid emitted during a minimum number, M, of subintervals, and each block includes at least M subintervals; $N_B\geqq M$.

16. The method according to claim 15, wherein the volume of a non-print drop must be formed from the liquid emitted during a maximum number, Q, of subintervals or less, and each block includes no more than Q subintervals; $N_B\leqq Q$.

17. The method according to claim 1, wherein the drop forming energy pulses are applied by resistive heater means.

18. A method of forming a liquid pattern according to liquid pattern data on a receiving medium using a liquid drop emitter that emits a continuous stream of liquid from a nozzle that is broken into drops of predetermined volumes by the application of drop forming energy pulses comprising;

associating a pixel area of the receiving medium with a nozzle and a time interval during which a plurality of fluid drops ejected from the nozzle can impinge the pixel area of the receiving medium;

dividing the time interval into a plurality of subintervals;

grouping the plurality of subintervals into blocks;

defining each block as a printing block or a non-printing block;

associating a drop forming energy pulse between each pair of consecutive blocks;

associating a drop forming energy pulse between subintervals of each printing block;

associating no drop forming energy pulse between each subinterval of each non-printing block; and causing drops to be emitted from the nozzle based on the associated sequence of drop energy forming pulses and wherein the liquid pattern is formed on the receiver of print drops formed of liquid emitted during subintervals associated with printing blocks and liquid emitted during subintervals associated with non-printing blocks is formed into non-print drops and captured before reaching the receiving medium, wherein the time interval is comprised of a number, N, of printable subintervals that may be formed into N print drops each associated with the fluid emitted during a printable subinterval and having substantially equal volume $V_0$, the method further comprising:

obtaining a desired total liquid volume, $V_{tp}$, of the printed drops located within the pixel area from liquid pattern data;

defining as printing blocks a number of blocks of the time interval that include a total of number of printable subintervals, $N_p$, and defining as non-printing blocks any remaining blocks of the time interval such that the total liquid volume of the printed drops, substantially equals the desired total liquid volume; and obtaining a location of the desired centroid of the printed drops located within the pixel area from liquid pattern data; and defining the printing blocks and non-printing blocks based on the location of the desired centroid.

19. A method of forming a liquid pattern according to liquid pattern data on a receiving medium using a liquid drop emitter that emits a continuous steam of liquid from a nozzle that is broken into drops of predetermined volumes by the application of drop forming energy pulses comprising:

associating a pixel area of the receiving medium with a nozzle and a time interval during which a plurality of fluid drops ejected from the nozzle can impinge the pixel area of the receiving medium;

dividing the time interval into a plurality of subintervals:

grouping the plurality of subintervals into blocks;

defining each block as a printing block or a non-printing block;

associating a drop forming energy pulse between each pair of consecutive blocks;

associating a drop forming energy pulse between subintervals of each printing block;

associating no drop forming energy pulse between each subinterval of each non-printing block; and causing drops to be emitted from the nozzle based on the associated sequence of drop energy forming pulses and wherein the liquid pattern is formed on the receiver of print drops formed of liquid emitted during subintervals associated with printing blocks and liquid emitted during subintervals associated with non-printing blocks is formed into non-print drops and captured before reaching the receiving medium, wherein the time interval is comprised of a number, N, of printable subintervals that may be formed into N print drops each associated with the fluid emitted during a printable subinterval and having substantially equal volume, $V_0$, the method further comprising:

obtaining a desired total liquid volume, $V_{tp}$, of the printed drops located within the pixel area from liquid pattern data;

defining printing blocks a number of blocks of the lime interval that include a total of number of printable subintervals, $N_p$, and defining as non-printing blocks any remaining blocks of the time interval such that the total liquid volume of the printed drops, $N_pV_0$, substantially equals the desired total liquid volume; and obtaining a desired resulting shape of the printed drops located within the pixel area from liquid pattern data; and defining the printing blocks and non-printing blocks based on the desired resulting shape.

20. A method of forming a liquid pattern according to liquid pattern data on a receiving medium using a liquid drop emitter that emits a continuous stream of liquid from a nozzle that is broken into drops of predetermined volumes by the application of drop forming energy pulses comprising:

associating a pixel area of the receiving medium with a nozzle and a time interval during which a plurality of fluid drops ejected from the nozzle can impinge the pixel area of the receiving medium;

dividing the time interval into a plurality of subintervals;

grouping the plurality of subintervals into blocks;

defining each block as a printing block or a non-printing block;

associating a drop forming energy pulse between each pair of consecutive blocks;

associating a drop forming energy pulse between subintervals of each printing block;

associating no drop forming energy pulse between each subinterval of each non-printing block; and causing drops to be emitted from the nozzle based on the associated sequence of drop energy forming pulses and wherein the liquid pattern is formed on the receiver of print drops formed of liquid emitted during subintervals associated with printing blocks and liquid emitted during subintervals associated with non-printing blocks is formed into non-print drops and captured before reaching the receiving medium, wherein the time interval is comprised of a number, N, of printable subintervals that may be formed into N print drops each associated with the fluid emitted during a printable subinterval and having substantially equal volume, $V_0$, the method further comprising:

obtaining a desired total liquid volume, $V_{tp}$, of the printed drops located within the pixel area from liquid pattern data; and defining as printing blocks a number of blocks of the time interval that include a total of number of printable subintervals, $N_p$, and defining as non-printing blocks any remaining blocks of the time interval such that the total liquid volume of the printed drops, $N_pV_0$, substantially equals the desired total liquid volume, wherein the volume of a non-print drop must be formed from the liquid emitted during a minimum number, M, of subintervals; the number of printable subintervals in a time interval, N, is divided among a plurality of blocks according to the liquid pattern data; and wherein any block having a number of subintervals that is less than M must be defined as a printing block.

21. The method according to claim 20, wherein the time interval is further comprised of at least M non-printable subintervals, and the total number of subintervals, N+M, is divided among a plurality of blocks according to liquid pattern data.

* * * * *

UNITED STATES PATENT AND TRADEMARK OFFICE

CERTIFICATE OF CORRECTION

PATENT NO. : 7,651,206 B2
APPLICATION NO. : 11/612694
DATED : January 26, 2010
INVENTOR(S) : Gilbert Allen Hawkins et al.

It is certified that error appears in the above-identified patent and that said Letters Patent is hereby corrected as shown below:

| Issued Patent Column | Issued Patent Line | Description of Error |
|---|---|---|
| 44 | 18 | In Claim 15, delete "dine" and insert -- time --, therefor. |
| 44 | 32 | In Claim 15, delete "minting" and insert -- printing --, therefor. |
| 44 | 51 | In Claim 18, delete "comprising;" and insert -- comprising: --, therefor. |
| 45 | 19 | In Claim 18, after "drops," insert -- $N_pV_0$ --. |
| 45 | 27 | In Claim 19, delete "steam" and insert -- stream --, therefor. |
| 45 | 34 | In Claim 19, delete "subintervals:" and insert -- subintervals; --, therefor. |
| 45 | 60 | In Claim 19, after "defining" insert -- as --. |
| 45 | 60 | In Claim 19, delete "lime" and insert -- time --, therefor. |

Signed and Sealed this
Twenty-third Day of August, 2011

David J. Kappos

David J. Kappos
*Director of the United States Patent and Trademark Office*